US009353917B2

(12) United States Patent
Pickard et al.

(10) Patent No.: US 9,353,917 B2
(45) Date of Patent: May 31, 2016

(54) HIGH EFFICIENCY LIGHTING DEVICE INCLUDING ONE OR MORE SOLID STATE LIGHT EMITTERS, AND METHOD OF LIGHTING

(71) Applicant: CREE, INC., Durham, NC (US)

(72) Inventors: Paul Kenneth Pickard, Morrisville, NC (US); Jason Taylor, Cary, NC (US); Antony Paul Van De Ven, Hong Kong (CN)

(73) Assignee: Cree, Inc., Durham, NC (US)

( * ) Notice: Subject to any disclaimer, the term of this patent is extended or adjusted under 35 U.S.C. 154(b) by 401 days.

(21) Appl. No.: 13/804,935

(22) Filed: Mar. 14, 2013

(65) Prior Publication Data

US 2014/0078715 A1 Mar. 20, 2014

Related U.S. Application Data

(60) Provisional application No. 61/701,027, filed on Sep. 14, 2012, provisional application No. 61/758,081, filed on Jan. 29, 2013.

(51) Int. Cl.
*F21V 9/00* (2015.01)
*F21K 99/00* (2016.01)

(52) U.S. Cl.
CPC .... *F21K 9/54* (2013.01); *F21K 9/30* (2013.01)

(58) Field of Classification Search
CPC ..... F21V 9/00; F21K 9/54; F21K 9/30
USPC ..... 362/249.02
IPC ..... F21V 9/00
See application file for complete search history.

(56) References Cited

U.S. PATENT DOCUMENTS 4,710,699 A 12/1987 Miyamoto
5,803,579 A 9/1998 Turnbull et al.

(Continued)

FOREIGN PATENT DOCUMENTS

EP 1 837 386 9/2007
JP 10-163531 6/1998

(Continued)

OTHER PUBLICATIONS

Van de Ven et al.; "Warm White Illumination with High CRI and High Efficacy by Combining 455 nm Excited Yellowish Phosphor LEDs and Red AlInGaP LEDs", First International Conference on White LEDs and Solid State Lighting.

(Continued)

*Primary Examiner* — Anabel Ton
(74) *Attorney, Agent, or Firm* — Burr & Brown, PLLC

(57) ABSTRACT

A lighting device comprising first and second groups of solid state light emitters, that emit light having approximate dominant wavelength (in nm) of 441-448 (or 442-450, 444-455, 444-446, 442-445 or 444-452) and 555 nm to 585 nm, respectively. If the first and second groups are illuminated, a mixture of light would, in the absence of any additional light, have a color point within one or more of first, second, third, fourth and fifth areas on the 1931 CIE Chromaticity Diagram. In some embodiment, the lighting device further comprises a third group that emits light having approximate dominant wavelength (in nm) of 600-640 (or 605-610, 605-607, 600-606, 602-606 or 615-620). Also, methods of lighting.

23 Claims, 14 Drawing Sheets

(56) References Cited

U.S. PATENT DOCUMENTS

| | | | | |
|---|---|---|---|---|
| 6,132,072 | A | 10/2000 | Turnbull et al. | |
| 6,153,971 | A | 11/2000 | Shimizu et al. | |
| 6,212,213 | B1 | 4/2001 | Weber et al. | |
| 6,234,648 | B1 | 5/2001 | Borner et al. | |
| 6,441,558 | B1 | 8/2002 | Muthu et al. | |
| 6,513,949 | B1 | 2/2003 | Marshall et al. | |
| 6,538,371 | B1 | 3/2003 | Duggal et al. | |
| 6,550,949 | B1 | 4/2003 | Bauer et al. | |
| 6,552,495 | B1 | 4/2003 | Chang | |
| 6,577,073 | B2 | 6/2003 | Shimizu et al. | |
| 6,692,136 | B2 | 2/2004 | Marshall et al. | |
| 6,784,463 | B2 | 8/2004 | Camras et al. | |
| 6,817,735 | B2 | 11/2004 | Shimizu et al. | |
| 6,841,804 | B1 | 1/2005 | Chen et al. | |
| 6,914,267 | B2 | 7/2005 | Fukasawa et al. | |
| 6,936,857 | B2 | 8/2005 | Doxsee et al. | |
| 7,005,679 | B2 | 2/2006 | Tarsa et al. | |
| 7,008,078 | B2 | 3/2006 | Shimizu et al. | |
| 7,014,336 | B1 | 3/2006 | Ducharme et al. | |
| 7,061,454 | B2 | 6/2006 | Sasuga et al. | |
| 7,066,623 | B2 | 6/2006 | Lee et al. | |
| 7,095,056 | B2 | 8/2006 | Vitta | |
| 7,144,121 | B2 | 12/2006 | Minano et al. | |
| 7,213,940 | B1 | 5/2007 | Van De Ven et al. | |
| 7,358,954 | B2 | 4/2008 | Negley | |
| 7,365,485 | B2 | 4/2008 | Fukasawa et al. | |
| 8,029,155 | B2 * | 10/2011 | Van De Ven | F21K 9/00 257/89 |
| 8,038,317 | B2 * | 10/2011 | Van De Ven | F21K 9/00 362/231 |
| 8,148,897 | B2 | 4/2012 | Cho et al. | |
| 2002/0140880 | A1 | 10/2002 | Weindorf et al. | |
| 2003/0030063 | A1 | 2/2003 | Sosniak et al. | |
| 2003/0146411 | A1 | 8/2003 | Srivastava et al. | |
| 2003/0218180 | A1 | 11/2003 | Fujiwara | |
| 2004/0105261 | A1 | 6/2004 | Ducharme et al. | |
| 2004/0105264 | A1 | 6/2004 | Spero | |
| 2004/0217364 | A1 | 11/2004 | Tarsa et al. | |
| 2004/0264193 | A1 | 12/2004 | Okumura | |
| 2005/0030744 | A1 | 2/2005 | Ducharme et al. | |
| 2005/0082974 | A1 | 4/2005 | Fukasawa et al. | |
| 2005/0093442 | A1 | 5/2005 | Setlur et al. | |
| 2005/0110034 | A1 | 5/2005 | Fujiwara | |
| 2006/0012989 | A1 | 1/2006 | Lee et al. | |
| 2006/0105482 | A1 | 5/2006 | Alferink et al. | |
| 2006/0152140 | A1 | 7/2006 | Brandes | |
| 2007/0139920 | A1 | 6/2007 | Van de Ven | |
| 2007/0139923 | A1 | 6/2007 | Van De Ven et al. | |
| 2007/0159091 | A1 | 7/2007 | Hirosaki et al. | |
| 2007/0170447 | A1 | 7/2007 | Negley | |
| 2007/0171145 | A1 | 7/2007 | Coleman | |
| 2007/0223219 | A1 | 9/2007 | Medendorp, Jr. | |
| 2007/0236911 | A1 | 10/2007 | Negley | |
| 2007/0267983 | A1 | 11/2007 | Van de Ven | |
| 2007/0278934 | A1 | 12/2007 | Van de Ven | |
| 2007/0279903 | A1 | 12/2007 | Negley | |
| 2008/0084685 | A1 | 4/2008 | Van de Ven | |
| 2008/0106895 | A1 | 5/2008 | Van de Ven | |
| 2008/0130265 | A1 | 6/2008 | Negley | |
| 2008/0130285 | A1 | 6/2008 | Negley | |
| 2008/0136313 | A1 | 6/2008 | Van de Ven | |
| 2008/0259589 | A1 | 10/2008 | Van de Ven | |
| 2008/0278928 | A1 | 11/2008 | Van de Ven | |
| 2008/0278940 | A1 | 11/2008 | Van de Ven | |
| 2008/0304260 | A1 | 12/2008 | Van de Ven | |
| 2008/0304261 | A1 | 12/2008 | Van de Ven | |
| 2008/0310154 | A1 | 12/2008 | Van de Ven | |
| 2009/0246895 | A1 | 10/2009 | You | |
| 2009/0296384 | A1 | 12/2009 | Van de Ven | |
| 2011/0220920 | A1 | 9/2011 | Collins et al. | |
| 2011/0220929 | A1 | 9/2011 | Collins et al. | |
| 2011/0279015 | A1 | 11/2011 | Negley et al. | |
| 2012/0176788 | A1 | 7/2012 | Van de Ven | |
| 2012/0218747 | A1 * | 8/2012 | Lee | 362/230 |
| 2013/0277643 | A1 * | 10/2013 | Williamson et al. | 257/13 |
| 2013/0328073 | A1 * | 12/2013 | Lowes et al. | 257/89 |

FOREIGN PATENT DOCUMENTS

| | | |
|---|---|---|
| JP | 10-163535 | 6/1998 |
| JP | 2000-261039 | 9/2000 |
| JP | 2003-515956 | 5/2003 |
| JP | 2003-529889 | 10/2003 |
| JP | 2003-317979 | 11/2003 |
| JP | 2003-347588 | 12/2003 |
| JP | 2004-080046 | 3/2004 |
| JP | 2004-103443 | 4/2004 |
| JP | 2004-311791 | 11/2004 |
| JP | 2004-356116 | 12/2004 |
| JP | 2005-142311 | 6/2005 |
| JP | 2005-228979 | 8/2005 |
| JP | 2006-310856 | 11/2006 |
| WO | 03/019072 | 3/2003 |
| WO | WO 2005/124877 | 12/2005 |

OTHER PUBLICATIONS

Cree® XLamp® 7090 XR-E Series LED Binning and Labeling.
U.S. Appl. No. 61/075,513, filed Jun. 25, 2008, Roberts.
U.S. Appl. No. 61/037,365, filed Mar. 18, 2008, Van de Ven.
U.S. Appl. No. 60/990,439, filed Nov. 27, 2007, Negley.
U.S. Appl. No. 12/248,220, filed Oct. 9, 2008.
U.S. Appl. No. 12/277,745, filed Nov. 25, 2008.
U.S. Appl. No. 13/042,663, filed Mar. 8, 2011, Van de Ven et al.
U.S. Appl. No. 13/804,935, filed Mar. 14, 2013, Pickard et al.
U.S. Appl. No. 13/740,911, filed Jan. 14, 2013, Van de Ven.
U.S. Appl. No. 13/859,855, filed Apr. 10, 2013, Van de Ven.

* cited by examiner

HIGH EFFICIENCY LIGHTING DEVICE INCLUDING ONE OR MORE SOLID STATE LIGHT EMITTERS, AND METHOD OF LIGHTING

CROSS-REFERENCE TO RELATED APPLICATIONS

This application claims the benefit of U.S. Provisional Patent Application No. 61/701,027, filed Sep. 14, 2012, the entirety of which is incorporated herein by reference as if set forth in its entirety.

This application claims the benefit of U.S. Provisional Patent Application No. 61/758,081, filed Jan. 29, 2013, the entirety of which is incorporated herein by reference as if set forth in its entirety.

FIELD OF THE INVENTIVE SUBJECT MATTER

The present inventive subject matter relates to a lighting device, in particular, a device that includes one or more solid state light emitters.

The present inventive subject matter also relates to a lighting device, in particular, a device which includes one or more light emitting diodes and one or more luminescent materials (e.g., one or more phosphors).

The present inventive subject matter is also directed to lighting methods.

BACKGROUND

There is an ongoing effort to develop systems that are more energy-efficient. A large proportion (some estimates are as high as twenty-five percent) of the electricity generated in the United States each year goes to lighting, a large portion of which is general illumination (e.g., downlights, flood lights, spotlights and other general residential or commercial illumination products). Accordingly, there is an ongoing need to provide lighting that is more energy-efficient.

Solid state light emitters (e.g., light emitting diodes and luminescent materials) are receiving much attention due to their energy efficiency. It is well known that incandescent light bulbs are very energy-inefficient light sources—about ninety percent of the electricity they consume is released as heat rather than light. Fluorescent light bulbs are more efficient than incandescent light bulbs (by a factor of about 10) but are still less efficient than solid state light emitters, such as light emitting diodes.

In addition, as compared to the normal lifetimes of solid state light emitters, e.g., light emitting diodes, incandescent light bulbs have relatively short lifetimes, i.e., typically about 750-1000 hours. In comparison, light emitting diodes, for example, have typical lifetimes between 50,000 and 70,000 hours. Fluorescent bulbs have longer lifetimes than incandescent lights (e.g., fluorescent bulbs typically have lifetimes of 10,000-20,000 hours), but provide less favorable color reproduction. The typical lifetime of conventional fixtures is about 20 years, corresponding to a light-producing device usage of at least about 44,000 hours (based on usage of 6 hours per day for 20 years). Where the light-producing device lifetime of the light emitter is less than the lifetime of the fixture, the need for periodic change-outs is presented. The impact of the need to replace light emitters is particularly pronounced where access is difficult (e.g., vaulted ceilings, bridges, high buildings, highway tunnels) and/or where change-out costs are extremely high.

LED lighting systems can offer a long operational lifetime relative to conventional incandescent and fluorescent bulbs. LED lighting system lifetime is typically measured by an "L70 lifetime", i.e., a number of operational hours in which the light output of the LED lighting system does not degrade by more than 30%. Typically, an L70 lifetime of at least 25,000 hours is desirable, and has become a standard design goal. As used herein, L70 lifetime is defined by Illuminating Engineering Society Standard LM-80-08, entitled "*IES Approved Method for Measuring Lumen Maintenance of LED Light Sources*", Sep. 22, 2008, ISBN No. 978-0-87995-227-3, also referred to herein as "LM-80", the disclosure of which is hereby incorporated herein by reference in its entirety as if set forth fully herein.

LEDs also may be energy efficient, so as to satisfy ENERGY STAR® program requirements. ENERGY STAR program requirements for LEDs are defined in "*ENERGY STAR® Program Requirements for Solid State Lighting Luminaires, Eligibility Criteria—Version* 1.1", Final: Dec. 19, 2008, the disclosure of which is hereby incorporated herein by reference in its entirety as if set forth fully herein.

General illumination devices are typically rated in terms of their color reproduction. Color reproduction is typically measured using the Color Rendering Index (CRI Ra). CRI Ra is a modified average of the relative measurements of how the color rendition of an illumination system compares to that of a reference radiator when illuminating eight reference colors, i.e., it is a relative measure of the shift in surface color of an object when lit by a particular lighting device. The CRI Ra equals 100 if the color coordinates of a set of test colors being illuminated by the illumination system are the same as the coordinates of the same test colors being irradiated by the reference radiator.

Daylight has a high CRI (Ra of approximately 100), with incandescent bulbs also being relatively close (Ra greater than 95), and fluorescent lighting being less accurate (typical Ra of 70-80). Certain types of specialized lighting have very low CRI (e.g., mercury vapor or sodium lamps have Ra as low as about 40 or even lower). Sodium lights are used, e.g., to light highways, but driver response time significantly decreases with lower CRI Ra values (for any given brightness, legibility decreases with lower CRI Ra).

The color of visible light output by a light emitter, and/or the color of blended visible light output by a plurality of light emitters can be represented on either the 1931 CIE (Commission International de I'Eclairage) Chromaticity Diagram or the 1976 CIE Chromaticity Diagram. Persons of skill in the art are familiar with these diagrams, and these diagrams are readily available (e.g., by searching "CIE Chromaticity Diagram" on the internet).

The CIE Chromaticity Diagrams map out the human color perception in terms of coordinates x and y (in the case of the 1931 diagram) or u' and v' (in the case of the 1976 diagram). Each point (i.e., each "color point") on the respective Diagrams corresponds to a particular hue. For a technical description of CIE chromaticity diagrams, see, for example, "Encyclopedia of Physical Science and Technology", vol. 7, 230-231 (Robert A Meyers ed., 1987). The spectral colors are distributed around the boundary of the outlined space, which includes all of the hues perceived by the human eye. The boundary represents maximum saturation for the spectral colors.

The 1931 CIE Chromaticity Diagram can be used to define colors as weighted sums of different hues. The 1976 CIE Chromaticity Diagram is similar to the 1931 Diagram, except that similar distances on the 1976 Diagram represent similar perceived differences in color.

The expression "hue", as used herein, means light that has a color shade and saturation that correspond to a specific point on a CIE Chromaticity Diagram, i.e., a point that can be characterized with x, y coordinates on the 1931 CIE Chromaticity Diagram or with u', v' coordinates on the 1976 CIE Chromaticity Diagram.

In the 1931 Diagram, deviation from a point on the Diagram (i.e., "color point") can be expressed either in terms of the x, y coordinates or, alternatively, in order to give an indication as to the extent of the perceived difference in color, in terms of MacAdam ellipses. For example, a locus of points defined as being ten MacAdam ellipses from a specified hue defined by a particular set of coordinates on the 1931 Diagram consists of hues that would each be perceived as differing from the specified hue to a common extent (and likewise for loci of points defined as being spaced from a particular hue by other quantities of MacAdam ellipses).

A typical human eye is able to differentiate between hues that are spaced from each other by more than seven MacAdam ellipses (but is not able to differentiate between hues that are spaced from each other by seven or fewer MacAdam ellipses).

Since similar distances on the 1976 Diagram represent similar perceived differences in color, deviation from a point on the 1976 Diagram can be expressed in terms of the coordinates, u' and v', e.g., distance from the point=$(\Delta u'^2+\Delta v'^2)^{1/2}$. This formula gives a value, in the scale of the u' v' coordinates, corresponding to the distance between points. The hues defined by a locus of points that are each a common distance from a specified color point consist of hues that would each be perceived as differing from the specified hue to a common extent. For example, a statement that a point is spaced from another point by a particular fraction of a u', v' unit on a 1976 CIE Chromaticity Diagram (e.g., "each point within the first region spaced from each point within the second region by at least 0.01 u', v' units on a 1976 CIE Chromaticity Diagram") indicates that the distance between the respective points (equal to $\Delta u'^2+\Delta v'^2)^{1/2}$ is at least equal to the specified fraction.

In many situations (e.g., lighting devices used for general illuminations), the color of light output that is desired differs from the color of light that is output from a single solid state light emitter, and so in many of such situations, combinations of two or more types of solid state light emitters that emit light of different hues are employed. Where such combinations are used, there is often a desire for the light output from the lighting device to have a particular degree of uniformity, i.e., to reduce the variance of the color of light emitted by the lighting device at a particular minimum distance or distances.

The most common type of general illumination is white light (or near white light), i.e., light that is close to the blackbody locus, e.g., within about 10 MacAdam ellipses of at least one point on the blackbody locus on a 1931 CIE Chromaticity Diagram. Light with such proximity to the blackbody locus is referred to as "white" light in terms of its illumination, even though some light that is within 10 MacAdam ellipses of the blackbody locus is tinted to some degree, e.g., light from incandescent bulbs is called "white" even though it sometimes has a golden or reddish tint; also, if the light having a correlated color temperature of 1500 K or less is excluded, the very red light along the blackbody locus is excluded.

"White" solid state light emitting lamps have been produced by providing devices that mix different colors of light, e.g., by using light emitting diodes that emit light of differing respective colors and/or by converting some or all of the light emitted from the light emitting diodes using luminescent material. For example, as is well known, some lamps (referred to as "RGB lamps") use red, green and blue light emitting diodes, and other lamps use (1) one or more light emitting diodes that generate blue light and (2) luminescent material (e.g., one or more phosphor materials) that emits yellow light in response to excitation by light emitted by the light emitting diode, whereby the blue light and the yellow light, when mixed, produce light that is perceived as white light. While there is a need for more efficient white lighting, there is in general a need for more efficient lighting in all hues.

In order to encourage development and deployment of highly energy efficient solid state lighting (SSL) products to replace several of the most common lighting products currently used in the United States, including 60-Watt A19 incandescent and PAR 38 halogen incandescent lamps, the Bright Tomorrow Lighting Competition (L Prize™) has been authorized in the Energy Independence and Security Act of 2007 (EISA). The L Prize is described in "*Bright Tomorrow Lighting Competition* (*L Prize*™)", May 28, 2008, Document No. 08NT006643, the disclosure of which is hereby incorporated herein by reference in its entirety as if set forth fully herein. The L Prize winner must conform to many product requirements including light output, wattage, color rendering index, correlated color temperature, expected lifetime, dimensions and base type.

BRIEF SUMMARY

There is therefore a need for high efficiency light sources that emit light with acceptable CRI Ra.

In accordance with a first aspect of the present inventive subject matter, it has unexpectedly been found that surprisingly high energy efficiency can be obtained by (1) illuminating or exciting one or more solid state light emitters that emit light having a dominant wavelength in the range of from about 441 nm to about 448 nm, and (2) exciting one or more luminescent materials that emit light having a dominant wavelength in the range of from about 555 nm to about 585 nm, such that:

a combination of light exiting the lighting device which was emitted by (1) the one or more solid state light emitters that emit light having a dominant wavelength in the range of from about 441 nm to about 448 nm, and (2) the one or more luminescent materials that emit light having a dominant wavelength in the range of from about 555 nm to about 585 nm would, in an absence of any additional light, produce a sub-mixture of light having x, y color coordinates which define a point which is within one or more of first, second, third, fourth and fifth areas on the 1931 CIE Chromaticity Diagram, the first area enclosed by first, second, third, fourth and fifth line segments, the first line segment connecting a first point to a second point, the second line segment connecting the second point to a third point, the third line segment connecting the third point to a fourth point, the fourth line segment connecting the fourth point to a fifth point, and the fifth line segment connecting the fifth point to the first point, the first point having x, y coordinates of 0.32, 0.40, the second point having x, y coordinates of 0.36, 0.48, the third point having x, y coordinates of 0.43, 0.45, the fourth point having x, y coordinates of 0.42, 0.42, and the fifth point having x, y coordinates of 0.36, 0.38;

the second area enclosed by sixth, seventh, eighth, ninth and tenth line segments, the sixth line segment connecting a sixth point to a seventh point, the seventh line segment connecting the seventh point to a eighth point, the eighth line segment connecting the eighth point to a ninth point, the ninth line segment connecting the ninth point to a tenth point, and the tenth line segment connecting the tenth point to the sixth point, the sixth point having x, y coordinates of 0.29, 0.36, the seventh point having x, y coordinates of 0.32, 0.35, the eighth point having x, y coordinates of 0.41, 0.43, the ninth point having x, y coordinates of 0.44, 0.49, and the tenth point having x, y coordinates of 0.38, 0.53;

the third area enclosed by eleventh, twelfth, thirteenth, fourteenth and fifteenth line segments, the eleventh line segment connecting a eleventh point to a twelfth point, the twelfth line segment connecting the twelfth point to a thirteenth point, the thirteenth line segment connecting the thirteenth point to a fourteenth point, the fourteenth line segment connecting the fourteenth point to a fifteenth point, and the fifteenth line segment connecting the fifteenth point to the eleventh point, the eleventh point having x, y coordinates of 0.35, 0.48, the twelfth point having x, y coordinates of 0.26, 0.50, the thirteenth point having x, y coordinates of 0.13, 0.26, the fourteenth point having x, y coordinates of 0.15, 0.20, and the fifteenth point having x, y coordinates of 0.26, 0.28;

the fourth area enclosed by sixteenth, seventeenth, eighteenth and nineteenth line segments, the sixteenth line segment connecting a sixteenth point to a seventeenth point, the seventeenth line segment connecting the seventeenth point to a eighteenth point, the eighteenth line segment connecting the eighteenth point to a nineteenth point, the nineteenth line segment connecting the nineteenth point to the sixteenth point, the sixteenth point having x, y coordinates of 0.21, 0.28, the seventeenth point having x, y coordinates of 0.26, 0.28, the eighteenth point having x, y coordinates of 0.32, 0.42, and the nineteenth point having x, y coordinates of 0.28, 0.44; and the fifth area enclosed by twentieth, twenty-first, twenty-second and twenty-third line segments, the twentieth line segment connecting a twentieth point to a twenty-first point, the twenty-first line segment connecting a twenty-first point to a twenty-second point, the twenty-second line segment connecting the twenty-second point to a twenty-third point, the twenty-third line segment connecting the twenty-third point to the twentieth point, the twentieth point having x, y coordinates of 0.30, 0.49, the twenty-first point having x, y coordinates of 0.35, 0.48, the twenty-second point having x, y coordinates of 0.32, 0.42, and the twenty-third point having x, y coordinates of 0.28, 0.44.

In addition, in accordance with a second aspect of the present inventive subject matter, it has unexpectedly been found that surprisingly high energy efficiency can be obtained, with acceptable CRI Ra, by (1) illuminating or exciting one or more solid state light emitters that emit light having a dominant wavelength in the range of from about 441 nm to about 448 nm, (2) exciting one or more luminescent materials that emit light having a dominant wavelength in the range of from about 555 nm to about 585 nm, and (3) illuminating or exciting one or more solid state light emitters that emit light having a having a dominant wavelength in the range of from about 615 nm to about 620 nm, such that:

a combination of light exiting a lighting device which was emitted by (1) the one or more solid state light emitters that emit light having a dominant wavelength in the range of from about 441 nm to about 448 nm, (2) the one or more luminescent materials that emit light having a dominant wavelength in the range of from about 555 nm to about 585 nm and (3) the one or more solid state light emitters that emit light having a having a dominant wavelength in the range of from about 615 nm to about 620 nm produces a mixture of light having x, y coordinates on a 1931 CIE Chromaticity Diagram which define a point which is within ten MacAdam ellipses of at least one point on the blackbody locus on a 1931 CIE Chromaticity Diagram, and a combination of light exiting the lighting device which was emitted by (1) the one or more solid state light emitters that emit light having a dominant wavelength in the range of from about 441 nm to about 448 nm, and (2) the one or more luminescent materials that emit light having a dominant wavelength in the range of from about 555 nm to about 585 nm would, in an absence of any additional light, produce a sub-mixture of light having x, y color coordinates which define a point which is within one or more of the first, second, third, fourth and fifth areas on the 1931 CIE Chromaticity Diagram as defined above.

In accordance with a third aspect of the present inventive subject matter, it has unexpectedly been found that surprisingly high energy efficiency can be obtained by (1) illuminating or exciting one or more solid state light emitters that emit light having a dominant wavelength in the range of from about 442 nm to about 450 nm (and in some embodiments from about 442 nm to about 445 nm), e.g., about 442 nm, about 443 nm, about 444 nm, about 445 nm, about 446 nm, about 447 nm, about 448 nm, about 449 nm, or about 450 nm, and (2) exciting one or more luminescent materials that emit light having a dominant wavelength in the range of from about 555 nm to about 585 nm, such that:

a combination of light exiting the lighting device which was emitted by (1) the one or more solid state light emitters that emit light having a dominant wavelength in the range of from about 442 nm to about 450 nm, and (2) the one or more luminescent materials that emit light having a dominant wavelength in the range of from about 555 nm to about 585 nm would, in an absence of any additional light, produce a sub-mixture of light having x, y color coordinates which define a point which is within one or more of first, second, third, fourth and fifth areas on the 1931 CIE Chromaticity Diagram, the first area enclosed by first, second, third, fourth and fifth line segments, the first line segment connecting a first point to a second point, the second line segment connecting the second point to a third point, the third line segment connecting the third point to a fourth point, the fourth line segment connecting the fourth point to a fifth point, and the fifth line segment connecting the fifth point to the first point, the first point having x, y coordinates of 0.32, 0.40, the second point having x, y coordinates of 0.36, 0.48, the third point having x, y coordinates of 0.43, 0.45, the fourth point having x, y coordinates of 0.42, 0.42, and the fifth point having x, y coordinates of 0.36, 0.38;

the second area enclosed by sixth, seventh, eighth, ninth and tenth line segments, the sixth line segment connecting a sixth point to a seventh point, the seventh line segment connecting the seventh point to a eighth point, the eighth line segment connecting the eighth point to a ninth point, the ninth line segment connecting the ninth point to a tenth point, and the tenth line segment connecting the tenth point to the sixth point, the sixth point having x, y coordinates of 0.29, 0.36, the seventh point having x, y coordinates of 0.32, 0.35, the eighth point having x, y coordinates of 0.41, 0.43, the ninth point having x, y coordinates of 0.44, 0.49, and the tenth point having x, y coordinates of 0.38, 0.53;

the third area enclosed by eleventh, twelfth, thirteenth, fourteenth and fifteenth line segments, the eleventh line segment connecting a eleventh point to a twelfth point, the twelfth line segment connecting the twelfth point to a thirteenth point, the thirteenth line segment connecting the thirteenth point to a fourteenth point, the fourteenth line segment connecting the fourteenth point to a fifteenth point, and the fifteenth line segment connecting the fifteenth point to the eleventh point, the eleventh point having x, y coordinates of 0.35, 0.48, the twelfth point having x, y coordinates of 0.26, 0.50, the thirteenth point having x, y coordinates of 0.13, 0.26, the fourteenth point having x, y coordinates of 0.15, 0.20, and the fifteenth point having x, y coordinates of 0.26, 0.28;

the fourth area enclosed by sixteenth, seventeenth, eighteenth and nineteenth line segments, the sixteenth line segment connecting a sixteenth point to a seventeenth point, the seventeenth line segment connecting the seventeenth point to a eighteenth point, the eighteenth line segment connecting the eighteenth point to a nineteenth point, the nineteenth line segment connecting the nineteenth point to the sixteenth point, the sixteenth point having x, y coordinates of 0.21, 0.28, the seventeenth point having x, y coordinates of 0.26, 0.28, the eighteenth point having x, y coordinates of 0.32, 0.42, and the nineteenth point having x, y coordinates of 0.28, 0.44; and the fifth area enclosed by twentieth, twenty-first, twenty-second and twenty-third line segments, the twentieth line segment connecting a twentieth point to a twenty-first point, the twenty-first line segment connecting a twenty-first point to a twenty-second point, the twenty-second line segment connecting the twenty-second point to a twenty-third point, the twenty-third line segment connecting the twenty-third point to the twentieth point, the twentieth point having x, y coordinates of 0.30, 0.49, the twenty-first point having x, y coordinates of 0.35, 0.48, the twenty-second point having x, y coordinates of 0.32, 0.42, and the twenty-third point having x, y coordinates of 0.28, 0.44.

In addition, in accordance with a fourth aspect of the present inventive subject matter, it has unexpectedly been found that surprisingly high energy efficiency can be obtained, with acceptable CRI Ra, by (1) illuminating or exciting one or more solid state light emitters that emit light having a dominant wavelength in the range of from about 442 nm to about 450 nm (and in some embodiments from about 442 nm to about 445 nm), e.g., about 442 nm, about 443 nm, about 444 nm, about 445 nm, about 446 nm, about 447 nm, about 448 nm, about 449 nm, or about 450 nm, (2) exciting one or more luminescent materials that emit light having a dominant wavelength in the range of from about 555 nm to about 585 nm, and (3) illuminating or exciting one or more solid state light emitters that emit light having a having a dominant wavelength in the range of from about 605 nm to about 610 nm, e.g., about 605 nm, about 606 nm, about 607 nm, about 608 nm, about 609 nm or about 610 nm, such that:

a combination of light exiting a lighting device which was emitted by (1) the one or more solid state light emitters that emit light having a dominant wavelength in the range of from about 442 nm to about 450 nm, (2) the one or more luminescent materials that emit light having a dominant wavelength in the range of from about 555 nm to about 585 nm and (3) the one or more solid state light emitters that emit light having a having a dominant wavelength in the range of from about 605 nm to about 610 nm produces a mixture of light having x, y coordinates on a 1931 CIE Chromaticity Diagram which define a point which is within ten MacAdam ellipses (and in some cases within seven MacAdam ellipses) of at least one point on the blackbody locus on a 1931 CIE Chromaticity Diagram, and a combination of light exiting the lighting device which was emitted by (1) the one or more solid state light emitters that emit light having a dominant wavelength in the range of from about 442 nm to about 450 nm, and (2) the one or more luminescent materials that emit light having a dominant wavelength in the range of from about 555 nm to about 585 nm would, in an absence of any additional light, produce a sub-mixture of light having x, y color coordinates which define a point which is within one or more of the first, second, third, fourth and fifth areas on the 1931 CIE Chromaticity Diagram as defined above.

In some embodiments in accordance with the fourth aspect of the present inventive subject matter, a combination of light exiting a lighting device which was emitted by (1) the one or more solid state light emitters that emit light having a dominant wavelength in the range of from about 442 nm to about 450 nm (and in some embodiments, in the range of from about 442 nm to about 445 nm), e.g., about 442 nm, about 443 nm, about 444 nm, about 445 nm, about 446 nm, about 447 nm, about 448 nm, about 449 nm, or about 450 nm, (2) the one or more luminescent materials that emit light having a dominant wavelength in the range of from about 555 nm to about 585 nm and (3) the one or more solid state light emitters that emit light having a having a dominant wavelength in the range of from about 605 nm to about 610 nm, e.g., about 605 nm, about 606 nm, about 607 nm, about 608 nm, about 609 nm or about 610 nm, produces a mixture of light having a color temperature (or a correlated color temperature) of 3000 K or less.

In accordance with a fifth aspect of the present inventive subject matter, it has unexpectedly been found that surprisingly high energy efficiency can be obtained by (1) illuminating or exciting one or more solid state light emitters that emit light having a dominant wavelength in the range of from about 444 nm to about 455 nm (and in some embodiments from about 444 nm to about 452 nm), e.g., about 444 nm, about 445 nm, about 446 nm, about 447 nm, about 448 nm, about 449 nm, about 450 nm, about 451 nm, about 452 nm, about 453 nm, about 454 nm or about 455 nm, and (2) exciting one or more luminescent materials that emit light having a dominant wavelength in the range of from about 555 nm to about 585 nm, such that:

a combination of light exiting the lighting device which was emitted by (1) the one or more solid state light emitters that emit light having a dominant wavelength in the range of from about 444 nm to about 455 nm, and (2) the one or more luminescent materials that emit light having a dominant wavelength in the range of from about 555 nm to about 585 nm would, in an absence of any additional light, produce a sub-mixture of light having x, y color coordinates which define a point which is within one or more of first, second, third, fourth and fifth areas on the 1931 CIE Chromaticity Diagram, the first area enclosed by first, second, third, fourth and fifth line segments, the first line segment connecting a first point to a second point, the second line segment connecting the second point to a third point, the third line segment connecting the third point to a fourth point, the fourth line segment connecting the fourth point to a fifth point, and the fifth line segment connecting the fifth point to the first point, the first point having x, y coordinates of 0.32, 0.40, the second point having x, y coordinates of 0.36, 0.48, the third point having x, y coordinates of 0.43, 0.45, the fourth point having x, y coordinates of 0.42, 0.42, and the fifth point having x, y coordinates of 0.36, 0.38;

the second area enclosed by sixth, seventh, eighth, ninth and tenth line segments, the sixth line segment connecting a sixth point to a seventh point, the seventh line segment connecting the seventh point to a eighth point, the eighth line segment connecting the eighth point to a ninth point, the ninth line segment connecting the ninth point to a tenth point, and the tenth line segment connecting the tenth point to the sixth point, the sixth point having x, y coordinates of 0.29, 0.36, the seventh point having x, y coordinates of 0.32, 0.35, the eighth point having x, y coordinates of 0.41, 0.43, the ninth point having x, y coordinates of 0.44, 0.49, and the tenth point having x, y coordinates of 0.38, 0.53;

the third area enclosed by eleventh, twelfth, thirteenth, fourteenth and fifteenth line segments, the eleventh line segment connecting a eleventh point to a twelfth point, the twelfth line segment connecting the twelfth point to a thirteenth point, the thirteenth line segment connecting the thirteenth point to a fourteenth point, the fourteenth line segment connecting the fourteenth point to a fifteenth point, and the fifteenth line segment connecting the fifteenth point to the eleventh point, the eleventh point having x, y coordinates of 0.35, 0.48, the twelfth point having x, y coordinates of 0.26, 0.50, the thirteenth point having x, y coordinates of 0.13, 0.26, the fourteenth point having x, y coordinates of 0.15, 0.20, and the fifteenth point having x, y coordinates of 0.26, 0.28;

the fourth area enclosed by sixteenth, seventeenth, eighteenth and nineteenth line segments, the sixteenth line segment connecting a sixteenth point to a seventeenth point, the seventeenth line segment connecting the seventeenth point to a eighteenth point, the eighteenth line segment connecting the eighteenth point to a nineteenth point, the nineteenth line segment connecting the nineteenth point to the sixteenth point, the sixteenth point having x, y coordinates of 0.21, 0.28, the seventeenth point having x, y coordinates of 0.26, 0.28, the eighteenth point having x, y coordinates of 0.32, 0.42, and the nineteenth point having x, y coordinates of 0.28, 0.44; and the fifth area enclosed by twentieth, twenty-first, twenty-second and twenty-third line segments, the twentieth line segment connecting a twentieth point to a twenty-first point, the twenty-first line segment connecting a twenty-first point to a twenty-second point, the twenty-second line segment connecting the twenty-second point to a twenty-third point, the twenty-third line segment connecting the twenty-third point to the twentieth point, the twentieth point having x, y coordinates of 0.30, 0.49, the twenty-first point having x, y coordinates of 0.35, 0.48, the twenty-second point having x, y coordinates of 0.32, 0.42, and the twenty-third point having x, y coordinates of 0.28, 0.44.

In addition, in accordance with a sixth aspect of the present inventive subject matter, it has unexpectedly been found that surprisingly high energy efficiency can be obtained, with acceptable CRI Ra, by (1) illuminating or exciting one or more solid state light emitters that emit light having a dominant wavelength in the range of from about 444 nm to about 455 nm (and in some embodiments, in the range of from about 444 nm to about 452 nm), e.g., about 444 nm, about 445 nm, about 446 nm, about 447 nm, about 448 nm, about 449 nm, about 450 nm, about 451 nm, about 452 nm, about 453 nm, about 454 nm or about 455 nm, (2) exciting one or more luminescent materials that emit light having a dominant wavelength in the range of from about 555 nm to about 585 nm, and (3) illuminating or exciting one or more solid state light emitters that emit light having a having a dominant wavelength in the range of from about 600 nm to about 606 nm (and in some embodiments, in the range of from about 602 nm to about 606 nm), e.g., about 600 nm, about 601 nm, about 602 nm, about 603 nm, about 604 nm, about 605 nm or about 606 nm such that:

a combination of light exiting a lighting device which was emitted by (1) the one or more solid state light emitters that emit light having a dominant wavelength in the range of from about 444 nm to about 455 nm, (2) the one or more luminescent materials that emit light having a dominant wavelength in the range of from about 555 nm to about 585 nm and (3) the one or more solid state light emitters that emit light having a having a dominant wavelength in the range of from about 600 nm to about 606 nm produces a mixture of light having x, y coordinates on a 1931 CIE Chromaticity Diagram which define a point which is within ten MacAdam ellipses (and in some cases within seven MacAdam ellipses) of at least one point on the blackbody locus on a 1931 CIE Chromaticity Diagram, and a combination of light exiting the lighting device which was emitted by (1) the one or more solid state light emitters that emit light having a dominant wavelength in the range of from about 444 nm to about 455 nm, and (2) the one or more luminescent materials that emit light having a dominant wavelength in the range of from about 555 nm to about 585 nm would, in an absence of any additional light, produce a sub-mixture of light having x, y color coordinates which define a point which is within one or more of the first, second, third, fourth and fifth areas on the 1931 CTE Chromaticity Diagram as defined above.

In some embodiments in accordance with the sixth aspect of the present inventive subject matter, a combination of light exiting a lighting device which was emitted by (1) the one or more solid state light emitters that emit light having a dominant wavelength in the range of from about 444 nm to about 455 nm (and in some instances in the range of from about 444 nm to about 452 nm), e.g., about 444 nm, about 445 nm, about 446 nm, about 447 nm, about 448 nm, about 449 nm, about 450 nm, about 451 nm, about 452 nm, about 453 nm, about 454 nm or about 455 nm, (2) the one or more luminescent materials that emit light having a dominant wavelength in the range of from about 555 nm to about 585 nm and (3) the one or more solid state light emitters that emit light having a having a dominant wavelength in the range of from about 600 nm to about 606 nm (and in some instances in the range of from about 602 nm to about 606 nm), e.g., about 600 nm, about 601 nm, about 602 nm, about 603 nm, about 604 nm, about 605 nm or about 606 nm produces a mixture of light having a color temperature (or a correlated color temperature) of 3000 K or more.

In comparison to some available lighting devices, some embodiments of lighting devices in accordance with the present inventive subject matter have moderately reduced CRI Ra (for example, in some embodiments, in the range of 84 to 86, or in some cases in the range of 75 to 85, e.g., about 80), but they provide excellent efficiency. In such instances, despite the moderate reduction in CRI Ra, such devices, with their increased efficiency, can be used in situations where the moderately reduced CRI Ra is acceptable (or deemed to be acceptable), and/or in situations where even more significantly reduced CRI Ra would not be considered to be a problem (for example, in some general illumination, security lighting, street lighting and/or emergency lighting).

In some embodiments according to the present inventive subject matter, including some embodiments that include or do not include any of the features as discussed herein, there is provided a lighting device that comprises (1) a first group of solid state light emitters that emits light having a dominant wavelength in the range of from about 441 nm to about 448 nm, and (2) a second group of solid state light emitters that emits light having a dominant wavelength in the range of from about 555 nm to about 585 nm, in which any of the solid state light emitters can comprise a light emitting diode and/or one or more luminescent materials.

In some embodiments according to the present inventive subject matter, including some embodiments that include or do not include any of the features as discussed herein, there is provided a lighting device that comprises (1) a first group of solid state light emitters that emits light having a dominant wavelength in the range of from about 442 nm to about 450 nm, and (2) a second group of solid state light emitters that emits light having a dominant wavelength in the range of from about 555 nm to about 585 nm, in which any of the solid state light emitters can comprise a light emitting diode and/or one or more luminescent materials.

In some embodiments according to the present inventive subject matter, including some embodiments that include or do not include any of the features as discussed herein, there is provided a lighting device that comprises (1) a first group of solid state light emitters that emits light having a dominant wavelength in the range of from about 444 nm to about 455 nm, and (2) a second group of solid state light emitters that emits light having a dominant wavelength in the range of from about 555 nm to about 585 nm, in which any of the solid state light emitters can comprise a light emitting diode and/or one or more luminescent materials.

In some embodiments according to the present inventive subject matter, including some embodiments that include or do not include any of the features as discussed herein, there is provided a lighting device that comprises (1) a first group of solid state light emitters that emits light having a dominant wavelength in the range of from about 441 nm to about 448 nm, (2) a second group of solid state light emitters that emits light having a dominant wavelength in the range of from about 555 nm to about 585 nm, and (3) a third group of solid state light emitters that emits light having a dominant wavelength in the range of from about 600 nm to about 640 nm, in which any of the solid state light emitters can comprise a light emitting diode and/or one or more luminescent materials.

In some embodiments according to the present inventive subject matter, including some embodiments that include or do not include any of the features as discussed herein, there is provided a lighting device that comprises (1) a first group of solid state light emitters that emits light having a dominant wavelength in the range of from about 442 nm to about 450 nm, (2) a second group of solid state light emitters that emits light having a dominant wavelength in the range of from about 555 nm to about 585 nm, and (3) a third group of solid state light emitters that emits light having a dominant wavelength in the range of from about 605 nm to about 610 nm, in which any of the solid state light emitters can comprise a light emitting diode and/or one or more luminescent materials.

In some embodiments according to the present inventive subject matter, including some embodiments that include or do not include any of the features as discussed herein, there is provided a lighting device that comprises (1) a first group of solid state light emitters that emits light having a dominant wavelength in the range of from about 444 nm to about 455 nm, (2) a second group of solid state light emitters that emits light having a dominant wavelength in the range of from about 555 nm to about 585 nm, and (3) a third group of solid state light emitters that emits light having a dominant wavelength in the range of from about 600 nm to about 606 nm, in which any of the solid state light emitters can comprise a light emitting diode and/or one or more luminescent materials.

In some embodiments according to the present inventive subject matter, including some embodiments that include or do not include any of the features as discussed herein, there is provided a method of lighting that comprises (1) illuminating a first group of solid state light emitters to emit light having a dominant wavelength in the range of from about 441 nm to about 448 nm, and (2) illuminating a second group of solid state light emitters to emit light having a dominant wavelength in the range of from about 555 nm to about 585 nm, in which any of the solid state light emitters can comprise a light emitting diode and/or one or more luminescent materials.

In some embodiments according to the present inventive subject matter, including some embodiments that include or do not include any of the features as discussed herein, there is provided a method of lighting that comprises (1) illuminating a first group of solid state light emitters to emit light having a dominant wavelength in the range of from about 442 nm to about 450 nm, and (2) illuminating a second group of solid state light emitters to emit light having a dominant wavelength in the range of from about 555 nm to about 585 nm, in which any of the solid state light emitters can comprise a light emitting diode and/or one or more luminescent materials.

In some embodiments according to the present inventive subject matter, including some embodiments that include or do not include any of the features as discussed herein, there is provided a method of lighting that comprises (1) illuminating a first group of solid state light emitters to emit light having a dominant wavelength in the range of from about 444 nm to about 455 nm, and (2) illuminating a second group of solid state light emitters to emit light having a dominant wavelength in the range of from about 555 nm to about 585 nm, in which any of the solid state light emitters can comprise a light emitting diode and/or one or more luminescent materials.

In some embodiments according to the present inventive subject matter, including some embodiments that include or do not include any of the features as discussed herein, there is provided a method of lighting that comprises (1) illuminating a first group of solid state light emitters to emit light having a dominant wavelength in the range of from about 441 nm to about 448 nm, (2) illuminating a second group of solid state light emitters to emit light having a dominant wavelength in the range of from about 555 nm to about 585 nm, and (3) illuminating a third group of solid state light emitters to emit light having a dominant wavelength in the range of from about 600 nm to about 640 nm, in which any of the solid state light emitters can comprise a light emitting diode and/or one or more luminescent materials.

In some embodiments according to the present inventive subject matter, including some embodiments that include or do not include any of the features as discussed herein, there is provided a method of lighting that comprises (1) illuminating a first group of solid state light emitters to emit light having a dominant wavelength in the range of from about 442 nm to about 450 nm, (2) illuminating a second group of solid state light emitters to emit light having a dominant wavelength in the range of from about 555 nm to about 585 nm, and (3) illuminating a third group of solid state light emitters to emit light having a dominant wavelength in the range of from about 605 nm to about 610 nm, in which any of the solid state light emitters can comprise a light emitting diode and/or one or more luminescent materials.

In some embodiments according to the present inventive subject matter, including some embodiments that include or do not include any of the features as discussed herein, there is provided a method of lighting that comprises (1) illuminating a first group of solid state light emitters to emit light having a dominant wavelength in the range of from about 444 nm to about 455 nm, (2) illuminating a second group of solid state light emitters to emit light having a dominant wavelength in the range of from about 555 nm to about 585 nm, and (3) illuminating a third group of solid state light emitters to emit light having a dominant wavelength in the range of from about 602 nm to about 606 nm, in which any of the solid state light emitters can comprise a light emitting diode and/or one or more luminescent materials.

In accordance with a seventh aspect of the present inventive subject matter, there is provided a lighting device comprising:

a first group of solid state light emitters, the first group of solid state light emitters including at least one solid state light emitter; and a second group of solid state light emitters, the second group of solid state light emitters including at least one solid state light emitter, the first group of solid state light emitters, if illuminated, emits light having a dominant wavelength in the range of from about 441 nm to about 448 nm;

the second group of solid state light emitters, if illuminated, emits light having a dominant wavelength in the range of from about 555 nm to about 585 nm;

if the first group of solid state light emitters is illuminated and the second group of solid state light emitters is illuminated, a mixture of (1) light exiting the lighting device that was emitted from the first group of solid state light emitters and (2) light exiting the lighting device that was emitted from the second group of solid state light emitters would, in the absence of any additional light, have a first group-second group mixed illumination having x, y color coordinates which define a point which is within one or more of first, second, third, fourth and fifth areas on the 1931 CIE Chromaticity Diagram, the first area enclosed by first, second, third, fourth and fifth line segments, the first line segment connecting a first point to a second point, the second line segment connecting the second point to a third point, the third line segment connecting the third point to a fourth point, the fourth line segment connecting the fourth point to a fifth point, and the fifth line segment connecting the fifth point to the first point, the first point having x, y coordinates of 0.32, 0.40, the second point having x, y coordinates of 0.36, 0.48, the third point having x, y coordinates of 0.43, 0.45, the fourth point having x, y coordinates of 0.42, 0.42, and the fifth point having x, y coordinates of 0.36, 0.38;

the second area enclosed by sixth, seventh, eighth, ninth and tenth line segments, the sixth line segment connecting a sixth point to a seventh point, the seventh line segment connecting the seventh point to a eighth point, the eighth line segment connecting the eighth point to a ninth point, the ninth line segment connecting the ninth point to a tenth point, and the tenth line segment connecting the tenth point to the sixth point, the sixth point having x, y coordinates of 0.29, 0.36, the seventh point having x, y coordinates of 0.32, 0.35, the eighth point having x, y coordinates of 0.41, 0.43, the ninth point having x, y coordinates of 0.44, 0.49, and the tenth point having x, y coordinates of 0.38, 0.53;

the third area enclosed by eleventh, twelfth, thirteenth, fourteenth and fifteenth line segments, the eleventh line segment connecting a eleventh point to a twelfth point, the twelfth line segment connecting the twelfth point to a thirteenth point, the thirteenth line segment connecting the thirteenth point to a fourteenth point, the fourteenth line segment connecting the fourteenth point to a fifteenth point, and the fifteenth line segment connecting the fifteenth point to the eleventh point, the eleventh point having x, y coordinates of 0.35, 0.48, the twelfth point having x, y coordinates of 0.26, 0.50, the thirteenth point having x, y coordinates of 0.13, 0.26, the fourteenth point having x, y coordinates of 0.15, 0.20, and the fifteenth point having x, y coordinates of 0.26, 0.28;

the fourth area enclosed by sixteenth, seventeenth, eighteenth and nineteenth line segments, the sixteenth line segment connecting a sixteenth point to a seventeenth point, the seventeenth line segment connecting the seventeenth point to a eighteenth point, the eighteenth line segment connecting the eighteenth point to a nineteenth point, the nineteenth line segment connecting the nineteenth point to the sixteenth point, the sixteenth point having x, y coordinates of 0.21, 0.28, the seventeenth point having x, y coordinates of 0.26, 0.28, the eighteenth point having x, y coordinates of 0.32, 0.42, and the nineteenth point having x, y coordinates of 0.28, 0.44; and the fifth area enclosed by twentieth, twenty-first, twenty-second and twenty-third line segments, the twentieth line segment connecting a twentieth point to a twenty-first point, the twenty-first line segment connecting a twenty-first point to a twenty-second point, the twenty-second line segment connecting the twenty-second point to a twenty-third point, the twenty-third line segment connecting the twenty-third point to the twentieth point, the twentieth point having x, y coordinates of 0.30, 0.49, the twenty-first point having x, y coordinates of 0.35, 0.48, the twenty-second point having x, y coordinates of 0.32, 0.42, and the twenty-third point having x, y coordinates of 0.28, 0.44.

In accordance with an eighth aspect of the present inventive subject matter, there is provided a lighting device comprising:

a first group of solid state light emitters, the first group of solid state light emitters including at least one solid state light emitter;

a second group of solid state light emitters, the second group of solid state light emitters including at least one solid state light emitter; and at least a first power line, the first group of solid state light emitters, if illuminated, emits light having a dominant wavelength in the range of from about 441 nm to about 448 nm;

the second group of solid state light emitters, if illuminated, emits light having a dominant wavelength in the range of from about 555 nm to about 585 nm;

if electricity is supplied to the first power line, a mixture of (1) light exiting the lighting device that was emitted from the first group of solid state light emitters and (2) light exiting the lighting device that was emitted from the second group of solid state light emitters would, in the absence of any additional light, have a first group-second group mixed illumination having x, y color coordinates which define a point which is within one or more of first, second, third, fourth and fifth areas on the 1931 CIE Chromaticity Diagram, the first area enclosed by first, second, third, fourth and fifth line segments, the first line segment connecting a first point to a second point, the second line segment connecting the second point to a third point, the third line segment connecting the third point to a fourth point, the fourth line segment connecting the fourth point to a fifth point, and the fifth line segment connecting the fifth point to the first point, the first point having x, y coordinates of 0.32, 0.40, the second point having x, y coordinates of 0.36, 0.48, the third point having x, y coordinates of 0.43, 0.45, the fourth point having x, y coordinates of 0.42, 0.42, and the fifth point having x, y coordinates of 0.36, 0.38;

the second area enclosed by sixth, seventh, eighth, ninth and tenth line segments, the sixth line segment connecting a sixth point to a seventh point, the seventh line segment connecting the seventh point to a eighth point, the eighth line segment connecting the eighth point to a ninth point, the ninth line segment connecting the ninth point to a tenth point, and the tenth line segment connecting the tenth point to the sixth point, the sixth point having x, y coordinates of 0.29, 0.36, the seventh point having x, y coordinates of 0.32, 0.35, the eighth point having x, y coordinates of 0.41, 0.43, the ninth point having x, y coordinates of 0.44, 0.49, and the tenth point having x, y coordinates of 0.38, 0.53;

the third area enclosed by eleventh, twelfth, thirteenth, fourteenth and fifteenth line segments, the eleventh line segment connecting a eleventh point to a twelfth point, the twelfth line segment connecting the twelfth point to a thirteenth point, the thirteenth line segment connecting the thirteenth point to a fourteenth point, the fourteenth line segment connecting the fourteenth point to a fifteenth point, and the fifteenth line segment connecting the fifteenth point to the eleventh point, the eleventh point having x, y coordinates of 0.35, 0.48, the twelfth point having x, y coordinates of 0.26, 0.50, the thirteenth point having x, y coordinates of 0.13, 0.26, the fourteenth point having x, y coordinates of 0.15, 0.20, and the fifteenth point having x, y coordinates of 0.26, 0.28;

the fourth area enclosed by sixteenth, seventeenth, eighteenth and nineteenth line segments, the sixteenth line segment connecting a sixteenth point to a seventeenth point, the seventeenth line segment connecting the seventeenth point to a eighteenth point, the eighteenth line segment connecting the eighteenth point to a nineteenth point, the nineteenth line segment connecting the nineteenth point to the sixteenth point, the sixteenth point having x, y coordinates of 0.21, 0.28, the seventeenth point having x, y coordinates of 0.26, 0.28, the eighteenth point having x, y coordinates of 0.32, 0.42, and the nineteenth point having x, y coordinates of 0.28, 0.44; and the fifth area enclosed by twentieth, twenty-first, twenty-second and twenty-third line segments, the twentieth line segment connecting a twentieth point to a twenty-first point, the twenty-first line segment connecting a twenty-first point to a twenty-second point, the twenty-second line segment connecting the twenty-second point to a twenty-third point, the twenty-third line segment connecting the twenty-third point to the twentieth point, the twentieth point having x, y coordinates of 0.30, 0.49, the twenty-first point having x, y coordinates of 0.35, 0.48, the twenty-second point having x, y coordinates of 0.32, 0.42, and the twenty-third point having x, y coordinates of 0.28, 0.44.

In accordance with a ninth aspect of the present inventive subject matter, there is provided a lighting device comprising:

a first group of solid state light emitters, the first group of solid state light emitters including at least one solid state light emitter; and a second group of solid state light emitters, the second group of solid state light emitters including at least one solid state light emitter, the first group of solid state light emitters, if illuminated, emits light having a dominant wavelength in the range of from about 442 nm to about 450 nm;

the second group of solid state light emitters, if illuminated, emits light having a dominant wavelength in the range of from about 555 nm to about 585 nm;

if the first group of solid state light emitters is illuminated and the second group of solid state light emitters is illuminated, a mixture of (1) light exiting the lighting device that was emitted from the first group of solid state light emitters and (2) light exiting the lighting device that was emitted from the second group of solid state light emitters would, in the absence of any additional light, have a first group-second group mixed illumination having x, y color coordinates which define a point which is within one or more of the first, second, third, fourth and fifth areas on the 1931 CIE Chromaticity Diagram described above.

In accordance with a tenth aspect of the present inventive subject matter, there is provided a lighting device comprising:

a first group of solid state light emitters, the first group of solid state light emitters including at least one solid state light emitter;

a second group of solid state light emitters, the second group of solid state light emitters including at least one solid state light emitter; and at least a first power line, the first group of solid state light emitters, if illuminated, emits light having a dominant wavelength in the range of from about 442 nm to about 450 nm;

the second group of solid state light emitters, if illuminated, emits light having a dominant wavelength in the range of from about 555 nm to about 585 nm;

if electricity is supplied to the first power line, a mixture of (1) light exiting the lighting device that was emitted from the first group of solid state light emitters and (2) light exiting the lighting device that was emitted from the second group of solid state light emitters would, in the absence of any additional light, have a first group-second group mixed illumination having x, y color coordinates which define a point which is within one or more of the first, second, third, fourth and fifth areas on the 1931 CIE Chromaticity Diagram described above.

In accordance with an eleventh aspect of the present inventive subject matter, there is provided a lighting device comprising:

a first group of solid state light emitters, the first group of solid state light emitters including at least one solid state light emitter; and a second group of solid state light emitters, the second group of solid state light emitters including at least one solid state light emitter, the first group of solid state light emitters, if illuminated, emits light having a dominant wavelength in the range of from about 444 nm to about 455 nm;

the second group of solid state light emitters, if illuminated, emits light having a dominant wavelength in the range of from about 555 nm to about 585 nm;

if the first group of solid state light emitters is illuminated and the second group of solid state light emitters is illuminated, a mixture of (1) light exiting the lighting device that was emitted from the first group of solid state light emitters and (2) light exiting the lighting device that was emitted from the second group of solid state light emitters would, in the absence of any additional light, have a first group-second group mixed illumination having x, y color coordinates which define a point which is within one or more of the first, second, third, fourth and fifth areas on the 1931 CIE Chromaticity Diagram described above.

In accordance with a twelfth aspect of the present inventive subject matter, there is provided a lighting device comprising:

a first group of solid state light emitters, the first group of solid state light emitters including at least one solid state light emitter;

a second group of solid state light emitters, the second group of solid state light emitters including at least one solid state light emitter; and at least a first power line, the first group of solid state light emitters, if illuminated, emits light having a dominant wavelength in the range of from about 444 nm to about 455 nm;

the second group of solid state light emitters, if illuminated, emits light having a dominant wavelength in the range of from about 555 nm to about 585 nm;

if electricity is supplied to the first power line, a mixture of (1) light exiting the lighting device that was emitted from the first group of solid state light emitters and (2) light exiting the lighting device that was emitted from the second group of solid state light emitters would, in the absence of any additional light, have a first group-second group mixed illumination having x, y color coordinates which define a point which is within one or more of the first, second, third, fourth and fifth areas on the 1931 CIE Chromaticity Diagram described above.

In some embodiments in accordance with the eighth, tenth and twelfth aspects of the present inventive subject matter described above, including some embodiments that include or do not include any of the features as discussed herein, each of the first group of solid state light emitters is electrically connected to the first power line.

In some embodiments in accordance with any of the aspects of the present inventive subject matter described above, including some embodiments that include or do not include any of the features as discussed herein, the first group of solid state light emitters, if illuminated, emits light having a dominant wavelength in the range of from about 444 nm to about 446 nm, or the range of from about 442 nm to about 445 nm, or in the range of from about 444 nm to about 452 nm.

In some embodiments in accordance with any aspects of the present inventive subject matter described above, including some embodiments that include or do not include any of the features as discussed herein, (1) the lighting device further comprises a third group of solid state light emitters, (2) the third group of solid state light emitters includes at least one solid state light emitter, and (3) the third group of solid state light emitters, if illuminated, emits light having a dominant wavelength in the range of from about 600 nm to about 640 nm (and in some embodiments, in the range of from about 615 nm to about 620 nm, the range of from about 605 nm to about 610 nm, the range of from about 600 nm to about 606 nm, or the range of from about 602 nm to about 606 nm). In some of such embodiments:

the third group of solid state light emitters comprises one or more light emitting diodes;

the third group of solid state light emitters comprises at least a second luminescent material;

if the first group of solid state light emitters is illuminated, the second group of solid state light emitters and the third group of solid state light emitters is illuminated, a mixture of (1) light exiting the lighting device which was emitted by the first group of solid state light emitters, (2) light exiting the lighting device which was emitted by the second group of solid state light emitters, and (3) light exiting the lighting device which was emitted by the third group of solid state light emitters would, in an absence of any additional light, produce a first group-second group-third group mixed illumination having x, y coordinates on a 1931 CIE Chromaticity Diagram which define a point which is within ten MacAdam ellipses of at least one point on the blackbody locus on a 1931 CIE Chromaticity Diagram; and/or if electricity is supplied to the lighting device (1) the lighting device emits light having a CRI Ra of at least 70 (and in some cases at least 75, in some cases at least 80, in some cases at least 85, in some cases at least 90 and in some cases at least 95), and (2) the wall plug efficiency of the lighting device, based on the brightness of light emitted from the lighting device and the energy supplied to the lighting device, is at least 25 lumens per watt, in some cases at least 35 lumens per watt, in some cases at least 50 lumens per watt, in some cases at least 60 lumens per watt, in some cases at least 70 lumens per watt, and in some cases at least 80 lumens per watt, and in some cases at least 90 lumens per watt, and in some cases at least 100 lumens per watt, and in some cases at least 110 lumens per watt, and in some cases at least 120 lumens per watt.

In some embodiments in accordance with any of the aspects of the present inventive subject matter as described herein including some embodiments that include or do not include any of the features as discussed herein:

(1) the first group of solid state light emitters comprises one or more light emitting diodes, (2) the second group of solid state light emitters comprises at least a first luminescent material, and (3) if all of the light emitting diodes in the first group of solid state light emitters are illuminated, at least some of the first luminescent material in the second group of solid state light emitters would be excited by light emitted from the first group of solid state light emitters.

In accordance with a thirteenth aspect of the present inventive subject matter, there is provided a method of lighting comprising:

illuminating a first group of solid state light emitters, the first group of solid state light emitters including at least one solid state light emitter, such that the first group of solid state light emitters emits light having a dominant wavelength in the range of from about 441 nm to about 448 nm; and illuminating a second group of solid state light emitters, the second group of solid state light emitters including at least one solid state light emitter, such that the second group of solid state light emitters emits light having a dominant wavelength in the range of from about 555 nm to about 585 nm, the first group of solid state light emitters and the second group of solid state light emitters in a lighting device, a mixture of (1) light exiting the lighting device that was emitted from the first group of solid state light emitters and (2) light exiting the lighting device that was emitted from the second group of solid state light emitters would, in the absence of any additional light, have a first group-second group mixed illumination having x, y color coordinates which define a point which is within one or more of first, second, third, fourth and fifth areas on the 1931 CIE Chromaticity Diagram, the first area enclosed by first, second, third, fourth and fifth line segments, the first line segment connecting a first point to a second point, the second line segment connecting the second point to a third point, the third line segment connecting the third point to a fourth point, the fourth line segment connecting the fourth point to a fifth point, and the fifth line segment connecting the fifth point to the first point, the first point having x, y coordinates of 0.32, 0.40, the second point having x, y coordinates of 0.36, 0.48, the third point having x, y coordinates of 0.43, 0.45, the fourth point having x, y coordinates of 0.42, 0.42, and the fifth point having x, y coordinates of 0.36, 0.38;

the second area enclosed by sixth, seventh, eighth, ninth and tenth line segments, the sixth line segment connecting a sixth point to a seventh point, the seventh line segment connecting the seventh point to a eighth point, the eighth line segment connecting the eighth point to a ninth point, the ninth line segment connecting the ninth point to a tenth point, and the tenth line segment connecting the tenth point to the sixth point, the sixth point having x, y coordinates of 0.29, 0.36, the seventh point having x, y coordinates of 0.32, 0.35, the eighth point having x, y coordinates of 0.41, 0.43, the ninth point having x, y coordinates of 0.44, 0.49, and the tenth point having x, y coordinates of 0.38, 0.53;

the third area enclosed by eleventh, twelfth, thirteenth, fourteenth and fifteenth line segments, the eleventh line segment connecting a eleventh point to a twelfth point, the twelfth line segment connecting the twelfth point to a thirteenth point, the thirteenth line segment connecting the thirteenth point to a fourteenth point, the fourteenth line segment connecting the fourteenth point to a fifteenth point, and the fifteenth line segment connecting the fifteenth point to the eleventh point, the eleventh point having x, y coordinates of 0.35, 0.48, the twelfth point having x, y coordinates of 0.26, 0.50, the thirteenth point having x, y coordinates of 0.13, 0.26, the fourteenth point having x, y coordinates of 0.15, 0.20, and the fifteenth point having x, y coordinates of 0.26, 0.28;

the fourth area enclosed by sixteenth, seventeenth, eighteenth and nineteenth line segments, the sixteenth line segment connecting a sixteenth point to a seventeenth point, the seventeenth line segment connecting the seventeenth point to a eighteenth point, the eighteenth line segment connecting the eighteenth point to a nineteenth point, the nineteenth line segment connecting the nineteenth point to the sixteenth point, the sixteenth point having x, y coordinates of 0.21, 0.28, the seventeenth point having x, y coordinates of 0.26, 0.28, the eighteenth point having x, y coordinates of 0.32, 0.42, and the nineteenth point having x, y coordinates of 0.28, 0.44; and the fifth area enclosed by twentieth, twenty-first, twenty-second and twenty-third line segments, the twentieth line segment connecting a twentieth point to a twenty-first point, the twenty-first line segment connecting a twenty-first point to a twenty-second point, the twenty-second line segment connecting the twenty-second point to a twenty-third point, the twenty-third line segment connecting the twenty-third point to the twentieth point, the twentieth point having x, y coordinates of 0.30, 0.49, the twenty-first point having x, y coordinates of 0.35, 0.48, the twenty-second point having x, y coordinates of 0.32, 0.42, and the twenty-third point having x, y coordinates of 0.28, 0.44.

In accordance with a fourteenth aspect of the present inventive subject matter, there is provided a method of lighting comprising:

illuminating a first group of solid state light emitters, the first group of solid state light emitters including at least one solid state light emitter, such that the first group of solid state light emitters emits light having a dominant wavelength in the range of from about 442 nm to about 450 nm; and illuminating a second group of solid state light emitters, the second group of solid state light emitters including at least one solid state light emitter, such that the second group of solid state light emitters emits light having a dominant wavelength in the range of from about 555 nm to about 585 nm, the first group of solid state light emitters and the second group of solid state light emitters in a lighting device, a mixture of (1) light exiting the lighting device that was emitted from the first group of solid state light emitters and (2) light exiting the lighting device that was emitted from the second group of solid state light emitters would, in the absence of any additional light, have a first group-second group mixed illumination having x, y color coordinates which define a point which is within one or more of the first, second, third, fourth and fifth areas on the 1931 CIE Chromaticity Diagram described above.

In accordance with a fifteenth aspect of the present inventive subject matter, there is provided a method of lighting comprising:

illuminating a first group of solid state light emitters, the first group of solid state light emitters including at least one solid state light emitter, such that the first group of solid state light emitters emits light having a dominant wavelength in the range of from about 444 nm to about 455 nm; and illuminating a second group of solid state light emitters, the second group of solid state light emitters including at least one solid state light emitter, such that the second group of solid state light emitters emits light having a dominant wavelength in the range of from about 555 nm to about 585 nm, the first group of solid state light emitters and the second group of solid state light emitters in a lighting device, a mixture of (1) light exiting the lighting device that was emitted from the first group of solid state light emitters and (2) light exiting the lighting device that was emitted from the second group of solid state light emitters would, in the absence of any additional light, have a first group-second group mixed illumination having x, y color coordinates which define a point which is within one or more of the first, second, third, fourth and fifth areas on the 1931 CIE Chromaticity Diagram as described above.

In some embodiments in accordance with the thirteenth, fourteenth or fifteenth aspects of the present inventive subject matter, including some embodiments that include or do not include any of the features as discussed herein, the first group of solid state light emitters emits light having a dominant wavelength in the range of from about 444 nm to about 446 nm (or in the wavelength range of from about 442 nm to about 450 nm, or in the wavelength range of from about 444 nm to about 455 nm).

In some embodiments in accordance with the thirteenth, fourteenth or fifteenth aspects of the present inventive subject matter, including some embodiments that include or do not include any of the features as discussed herein, the method further comprises illuminating a third group of solid state light emitters, the third group of solid state light emitters includes at least one solid state light emitter, such that the third group of solid state light emitters emits light having a dominant wavelength in the range of from about 600 nm to about 640 nm (and in some embodiments, in the range of from about 615 nm to about 640 nm, or in the range of from about 605 nm to about 610 nm, or in the range of from about 600 nm to about 606 nm)). In some of such embodiments:

the third group of solid state light emitters comprises one or more light emitting diodes;

the third group of solid state light emitters comprises at least a second luminescent material;

a mixture of (1) light exiting the lighting device that was emitted from the first group of solid state light emitters, (2) light exiting the lighting device that was emitted from the second group of solid state light emitters and (3) light exiting the lighting device that was emitted from the third group of solid state light emitters would, in the absence of any additional light, produce a first group-second group-third group mixed illumination having x, y coordinates on a 1931 CIE Chromaticity Diagram which define a point which is within ten MacAdam ellipses of at least one point on the blackbody locus on a 1931 CIE Chromaticity Diagram; and/or (1) the lighting device emits light having a CRI Ra of at least 70 (and in some cases at least 75, in some cases at least 80, in some cases at least 85, in some cases at least 90 and in some cases at least 95), and (2) the wall plug efficiency of the lighting device, based on the brightness of light emitted from the lighting device and the energy supplied to the lighting device, is at least 25 lumens per watt, in some cases at least 35 lumens per watt, in some cases at least 50 lumens per watt, in some cases at least 60 lumens per watt, in some cases at least 70 lumens per watt, and in some cases at least 80 lumens per watt, and in some cases at least 90 lumens per watt, and in some cases at least 100 lumens per watt, and in some cases at least 110 lumens per watt, and in some cases at least 120 lumens per watt.

In some embodiments in accordance with the thirteenth, fourteenth or fifteenth aspect of the present inventive subject matter, including some embodiments that include or do not include any of the features as discussed herein, (1) the first group of solid state light emitters comprises one or more light emitting diodes, (2) the second group of solid state light emitters comprises at least a first luminescent material, and (3) at least some of the first luminescent material in the second group of solid state light emitters is excited by light emitted from the first group of solid state light emitters.

In some embodiments in accordance with the thirteenth, fourteenth or fifteenth aspect of the present inventive subject matter, including some embodiments that include or do not include any of the features as discussed herein, (1) the first group of solid state light emitters are electrically connected to a first power line, and (2) the first group of solid state light emitters are illuminated by supplying current to the first power line.

In some embodiments in accordance with any of the aspects of the present inventive subject matter described above, including some embodiments that include or do not include any of the features as discussed herein, the first group of solid state light emitters comprises one or more light emitting diodes.

In some embodiments in accordance with any of the aspects of the present inventive subject matter described above, including some embodiments that include or do not include any of the features as discussed herein, the second group of solid state light emitters comprises at least a first luminescent material.

In some embodiments in accordance with any of the aspects of the present inventive subject matter as described above, including some embodiments that include or do not include any of the features as discussed herein, (1) the first group of solid state light emitters comprises one or more light emitting diodes, (2) the second group of solid state light emitters comprises at least a first luminescent material, and (3) at least one of the light emitting diodes from the first group of solid state light emitters is embedded within an encapsulant element in which at least some of the first luminescent material is also embedded.

The present inventive subject matter may be more fully understood with reference to the accompanying drawings and the following detailed description of the inventive subject matter.

BRIEF DESCRIPTION OF THE DRAWING FIGURES

DETAILED DESCRIPTION

Figure 1:
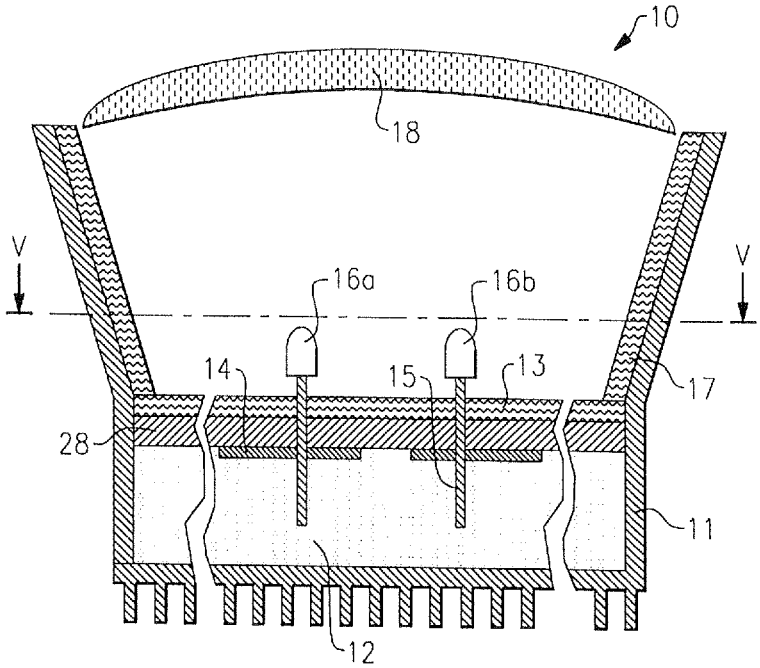
FIG. 1 depicts a first embodiment of a lighting device in accordance with the present inventive subject matter.

The present inventive subject matter now will be described more fully hereinafter with reference to the accompanying drawings, in which embodiments of the inventive subject matter are shown. However, this inventive subject matter should not be construed as being limited to the embodiments set forth herein. Rather, these embodiments are provided so that this disclosure will be thorough and complete, and will fully convey the scope of the inventive subject matter to those skilled in the art. Like numbers refer to like elements throughout.

As used herein the term "and/or" includes any and all combinations of one or more of the associated listed items.

The terminology used herein is for the purpose of describing particular embodiments only and is not intended to be limiting of the inventive subject matter. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

When an element such as a layer, region or substrate is referred to herein as being "on", being mounted "on", being mounted "to", or extending "onto" another element, it can be in or on the other element, and/or it can be directly on the other element, and/or it can extend directly onto the other element, and it can be in direct contact or indirect contact with the other element (e.g., intervening elements may also be present). In contrast, when an element is referred to herein as being "directly on" or extending "directly onto" another element, there are no intervening elements present. Also, when an element is referred to herein as being "connected" or "coupled" to another element, it can be directly connected or coupled to the other element, or intervening elements may be present. In contrast, when an element is referred to herein as being "directly connected" or "directly coupled" to another element, there are no intervening elements present. In addition, a statement that a first element is "on" a second element is synonymous with a statement that the second element is "on" the first element.

The expression "in contact with", as used herein, means that the first structure that is in contact with a second structure is in direct contact with the second structure or is in indirect contact with the second structure. The expression "in indirect contact with" means that the first structure is not in direct contact with the second structure, but that there are a plurality of structures (including the first and second structures), and each of the plurality of structures is in direct contact with at least one other of the plurality of structures (e.g., the first and second structures are in a stack and are separated by one or more intervening layers). The expression "direct contact", as used in the present specification, means that the first structure which is "in direct contact" with a second structure is touching the second structure and there are no intervening structures between the first and second structures at least at some location.

A statement herein that two components in a device are "electrically connected," means that there are no components electrically between the components that affect the function or functions provided by the device. For example, two components can be referred to as being electrically connected, even though they may have a small resistor between them which does not materially affect the function or functions provided by the device (indeed, a wire connecting two components can be thought of as a small resistor); likewise, two components can be referred to as being electrically connected, even though they may have an additional electrical component between them which allows the device to perform an additional function, while not materially affecting the function or functions provided by a device which is identical except for not including the additional component; similarly, two components which are directly connected to each other, or which are directly connected to opposite ends of a wire or a trace on a circuit board, are electrically connected. A statement herein that two components in a device are "electrically connected" is distinguishable from a statement that the two components are "directly electrically connected", which means that there are no components electrically between the two components.

Although the terms "first", "second", etc. may be used herein to describe various elements, components, regions, layers, sections and/or parameters, these elements, components, regions, layers, sections and/or parameters should not be limited by these terms. These terms are only used to distinguish one element, component, region, layer or section from another region, layer or section. Thus, a first element, component, region, layer or section discussed below could be termed a second element, component, region, layer or section without departing from the teachings of the present inventive subject matter.

Relative terms, such as "lower", "bottom", "upper" or "top" may be used herein to describe one element's relationship to another element, e.g., as illustrated in the Figures. Such relative terms are intended to encompass different orientations of the device in addition to the orientation depicted in the Figures or described herein. For example, if a device is turned over, elements described as being on the "lower" side of other elements would then be oriented on "upper" sides of the other elements. The exemplary term "lower" can therefore encompass both an orientation of "lower" and "upper," depending on the particular orientation. Similarly, if a device is turned over, elements described as "below" other elements would then be oriented "above" the other elements. The exemplary term "below" can therefore encompass both an orientation of above and below.

The expression "illumination" (or "illuminated"), as used herein when referring to a solid state light emitter, means that the solid state light emitter is emitting at least some light (e.g., if the solid state light emitter is a light emitting diode, electricity is being supplied to the light emitting diode to cause the light emitting diode to emit light; if the solid state light emitter is a luminescent material, electromagnetic radiation (e.g., visible light, UV light or infrared light) is being absorbed by the luminescent material so that the luminescent material emits light). The expression "illuminated" encompasses situations where the solid state light emitter emits light continuously, or intermittently at a rate such that a human eye would perceive it as emitting light continuously or intermittently, or where a plurality of solid state light emitters of the same color or different colors are emitting light intermittently and/or alternatingly (with or without overlap in "on" times) in such a way that a human eye would perceive them as emitting light continuously or intermittently (and, in some cases where different colors are emitted, as a mixture of those colors).

The expression "excited", as used herein when referring to luminescent material, means that at least some electromagnetic radiation (e.g., visible light, UV light or infrared light) is being absorbed by the luminescent material, causing the luminescent material to emit at least some light. The expression "excited" encompasses situations where the luminescent material emits light continuously, or intermittently at a rate such that a human eye would perceive it as emitting light continuously or intermittently, or where a plurality of luminescent materials of the same color or different colors are emitting light intermittently and/or alternatingly (with or without overlap in "on" times) in such a way that a human eye would perceive them as emitting light continuously or intermittently (and, in some cases where different colors are emitted, as a mixture of those colors).

The expression "lighting device", as used herein, is not limited, except that it indicates that the device is capable of emitting light. That is, a lighting device can be a device which illuminates an area or volume, e.g., a structure, a swimming pool or spa, a room, a warehouse, an indicator, a road, a parking lot, a vehicle, signage, e.g., road signs, a billboard, a ship, a toy, a mirror, a vessel, an electronic device, a boat, an aircraft, a stadium, a computer, a remote audio device, a remote video device, a cell phone, a tree, a window, an LCD display, a cave, a tunnel, a yard, a lamppost, or a device or array of devices that illuminate an enclosure, or a device that is used for edge or back-lighting (e.g., back light poster, signage, LCD displays), bulb replacements (e.g., for replacing AC incandescent lights, low voltage lights, fluorescent lights, etc.), lights used for outdoor lighting, lights used for security lighting, lights used for exterior residential lighting (wall mounts, post/column mounts), ceiling fixtures/wall sconces, under cabinet lighting, lamps (floor and/or table and/or desk), landscape lighting, track lighting, task lighting, specialty lighting, ceiling fan lighting, archival/art display lighting, high vibration/impact lighting—work lights, etc., mirrors/vanity lighting, or any other light emitting device.

The present inventive subject matter further relates to an illuminated enclosure (the volume of which can be illuminated uniformly or non-uniformly), comprising an enclosed space and at least one lighting device according to the present inventive subject matter, wherein the lighting device illuminates at least a portion of the enclosed space (uniformly or non-uniformly).

Some embodiments of the present inventive subject matter comprise at least a first power line, and some embodiments of the present inventive subject matter are directed to a structure comprising a surface and at least one lighting device corresponding to any embodiment of a lighting device according to the present inventive subject matter as described herein, wherein if current is supplied to the first power line, and/or if at least one solid state light emitter in the lighting device is illuminated, the lighting device would illuminate at least a portion of the surface.

The present inventive subject matter is further directed to an illuminated area, comprising at least one item, e.g., selected from among the group consisting of a structure, a swimming pool or spa, a room, a warehouse, an indicator, a road, a parking lot, a vehicle, signage, e.g., road signs, a billboard, a ship, a toy, a mirror, a vessel, an electronic device, a boat, an aircraft, a stadium, a computer, a remote audio device, a remote video device, a cell phone, a tree, a window, an LCD display, a cave, a tunnel, a yard, a lamppost, etc., having mounted therein or thereon at least one lighting device as described herein.

The expression "dominant emission wavelength", as used herein, means (1) in the case of a solid state light emitter, the dominant wavelength of light that the solid state light emitter emits if it is illuminated, and (2) in the case of a luminescent material, the dominant wavelength of light that the luminescent material emits if it is excited.

The expression "wall plug efficiency", as used herein, is measured in lumens per watt, and means the lumens exiting a lighting device (resulting from supplying energy to the lighting device, i.e., not including light generated from any other source of energy, e.g., it would not include any electromagnetic radiation generated from the presence of any radioactive material, any phosphorescence resulting from previously supplied energy, etc.), divided by the quantity of energy supplied to the lighting device to create the light, as opposed to values for individual components and/or assemblies of components. Accordingly, wall plug efficiency, as used herein, accounts for all losses, including, inter alia, any quantum losses, i.e., losses generated in converting line voltage into current supplied to light emitters, the ratio of the number of photons emitted by luminescent material(s) divided by the number of photons absorbed by the luminescent material(s), any Stokes losses, i.e., losses due to the change in frequency involved in the absorption of light and the re-emission of visible light (e.g., by luminescent material(s)), and any optical losses involved in the light emitted by a component of the lighting device actually exiting the lighting device. In some embodiments, the lighting devices in accordance with the present inventive subject matter provide the wall plug efficiencies specified herein when they are supplied with AC power (i.e., where the AC power is converted to DC power before being supplied to some or all components, the lighting device also experiences losses from such conversion), e.g., AC line voltage. The expression "line voltage" is used in accordance with its well known usage to refer to electricity supplied by an energy source, e.g., electricity supplied from a grid, including AC and DC.

As used herein, the term "substantially" means at least about 90% correspondence with the feature recited.

An expression in the form "[x] nm to [y] nm solid state light emitter," where [x] is a first integer and [y] is a second integer, means any solid state light emitter which, if illuminated, would emit light having a dominant wavelength in the range of from about [x] nm to about [y] nm (and analogously for other analogous expressions, e.g., the expression "[x] nm to [y] nm solid state light emitter" or the like means any solid state light emitter which, if illuminated, would emit light having a dominant wavelength in the range of from about [x] nm to about [y] nm), e.g., the expression "441 nm to 448 nm solid state light emitter" means any solid state light emitter which, if illuminated, would emit light having a dominant wavelength in the range of from about 441 nm to about 448 nm.

An expression in the form "[x] nm to [y] nm light emitting diode" (or the like), where [x] is a first integer and [y] is a second integer, means any luminescent material which, if excited, would emit light having a dominant wavelength in the range of from about [x] nm to about [y] urn, e.g., the expression "441 nm to 448 nm light emitting diode" means any light emitting diode which, if illuminated, would emit light having a dominant wavelength in the range of from about 441 nm to about 448 nm.

An expression in the form "[x] nm to [y] nm luminescent material" (or the like), where [x] is a first integer and [y] is a second integer, means any luminescent material which, if excited, would emit light having a dominant wavelength in the range of from about [x] nm to about [y] nm, e.g., the expression "555 nm to 585 nm luminescent material" means any luminescent material which, if illuminated, would emit light having a dominant wavelength in the range of from about 555 nm to about 585 nm, All references herein to "some embodiments of the present inventive subject matter" can include embodiments of the present inventive subject matter that include or do not include any of the features as discussed herein.

Unless otherwise defined, all terms (including technical and scientific terms) used herein have the same meaning as commonly understood by one of ordinary skill in the art to which this inventive subject matter belongs. It will be further understood that terms, such as those defined in commonly used dictionaries, should be interpreted as having a meaning that is consistent with their meaning in the context of the relevant art and the present disclosure and will not be interpreted in an idealized or overly formal sense unless expressly so defined herein. It will also be appreciated by those of skill in the art that references to a structure or feature that is disposed "adjacent" another feature may have portions that overlap or underlie the adjacent feature.

As discussed above, lighting devices in accordance with the present inventive subject matter comprise solid state light emitters.

Persons of skill in the art are familiar with, and have ready access to, a wide variety of solid state light emitters, and any suitable solid state light emitters can be employed in the lighting devices according to the present inventive subject matter. Representative examples of solid state light emitters include light emitting diodes (inorganic or organic, including polymer light emitting diodes (PLEDs)) and a wide variety of luminescent materials, as well as combinations (e.g., one or more light emitting diodes and/or one or more luminescent materials, such as a package comprising a light emitting diode and a luminescent material).

Light emitting diodes are semiconductor devices that convert electrical current into light. A wide variety of light emitting diodes are used in increasingly diverse fields for an ever-expanding range of purposes. More specifically, light emitting diodes are semiconducting devices that emit light (ultraviolet, visible, or infrared) when a potential difference is applied across a p-n junction structure. There are a number of well known ways to make light emitting diodes and many associated structures, and the present inventive subject matter can employ any such devices.

A light emitting diode produces light by exciting electrons across the band gap between a conduction band and a valence band of a semiconductor active (light-emitting) layer. The electron transition generates light at a wavelength that depends on the band gap. Thus, the color of the light (wavelength) and/or the type of electromagnetic radiation (e.g., infrared light, visible light, ultraviolet light, near ultraviolet light, etc., and any combinations thereof) emitted by a light emitting diode depends on the semiconductor materials of the active layers of the light emitting diode.

The expression "light emitting diode" is used herein to refer to the basic semiconductor diode structure (i.e., the chip). The commonly recognized and commercially available "LED" that is sold (for example) in electronics stores typically represents a "packaged" device made up of a number of parts. These packaged devices typically include a semiconductor based light emitting diode, various wire connections, and a package that encapsulates the light emitting diode.

A luminescent material is a material that emits a responsive radiation (e.g., visible light) when excited by a source of exciting radiation. In many instances, the responsive radiation has a wavelength (or hue) that is different from the wavelength (or hue) of the exciting radiation.

Luminescent materials can be categorized as being down-converting, i.e., a material that converts photons to a lower energy level (longer wavelength) or up-converting, i.e., a material that converts photons to a higher energy level (shorter wavelength).

Persons of skill in the art are familiar with, and have ready access to, a variety of luminescent materials that emit light having a desired dominant emission wavelength and/or dominant emission wavelength, or a desired hue, and any of such luminescent materials, or any combinations of such luminescent materials, can be employed, if desired.

One type of luminescent material are phosphors, which are readily available and well known to persons of skill in the art. Other examples of luminescent materials include scintillators, day glow tapes and inks that glow in the visible spectrum upon illumination with ultraviolet light.

One non-limiting representative example of a luminescent material that can be employed in the present inventive subject matter is cerium-doped yttrium aluminum garnet (aka "YAG:Ce" or "YAG"). Another non-limiting representative example of a luminescent material that can be employed in the present inventive subject matter is CaAlSiN:Eu2+(aka "CASN" or "BR01"), and further examples of types of luminescent material are BOSE and LuAG.

The one or more luminescent materials can be provided in any suitable form. For example, the luminescent element can be embedded in a resin (i.e., a polymeric matrix), such as a silicone material, an epoxy material, a glass material or a metal oxide material, and/or can be applied to one or more surfaces of a resin, to provide a lumiphor. Inclusion of luminescent materials in LED devices can be accomplished by adding the luminescent materials to a clear or translucent encapsulant material (e.g., epoxy-based, silicone-based, glass-based or metal oxide-based material) as discussed above, for example by a blending or coating process.

In some embodiments according to the present inventive subject matter, one or more light emitting diode can be included in a package together with one or more luminescent materials, and the one or more luminescent material in the package can optionally be spaced from the one or more light emitting diode chip in the package. In some embodiments according to the present inventive subject matter, two or more luminescent materials can be provided, and two or more of the luminescent materials can optionally be spaced from each other.

For example, a lighting device can include a light emitting diode chip, a bullet-shaped transparent housing to cover the light emitting diode chip, leads to supply current to the light emitting diode chip, and a cup reflector for reflecting the emission of the light emitting diode chip in a uniform direction, in which the light emitting diode chip is encapsulated with a first resin portion, which is further encapsulated with a second resin portion. The first resin portion can be obtained by filling the cup reflector with a resin material and curing it after the light emitting diode chip has been mounted onto the bottom of the cup reflector and then has had its cathode and anode electrodes electrically connected to the leads by way of wires. A luminescent material can be dispersed in the first resin portion so as to be excited with light A that is been emitted from the light emitting diode chip, the excited phosphor produces fluorescence ("light B") that has a longer wavelength than the light A, a portion of the light A is transmitted through the first resin portion including the phosphor, and as a result, light C, as a mixture of the light A and light B, exits the lighting device.

As noted above, in some embodiments in accordance with the present inventive subject matter, which can include or not include, as suitable, any of the other features described herein, light of two or more different colors is emitted by respective solid state light emitters, and is mixed in a mixing chamber (or chambers). The expression "different colors" refers to a device that comprises at least first and second solid state light emitters, the first solid state light emitter configured to emit light within a first region on a 1976 CIE Chromaticity Diagram, the second solid state light emitter configured to emit light within a second region on a 1976 CIE Chromaticity Diagram, each point within the first region spaced from each point within the second region by at least 0.01 u', v' units on a 1976 CIE Chromaticity Diagram.

In general, light of any combination and number of colors can be mixed in lighting devices according to the present inventive subject matter. For instance, examples of colors of light that can be mixed are (1) BSY light (defined below) and red light, and (2) BSG light (defined below) and red light.

Figure 10:
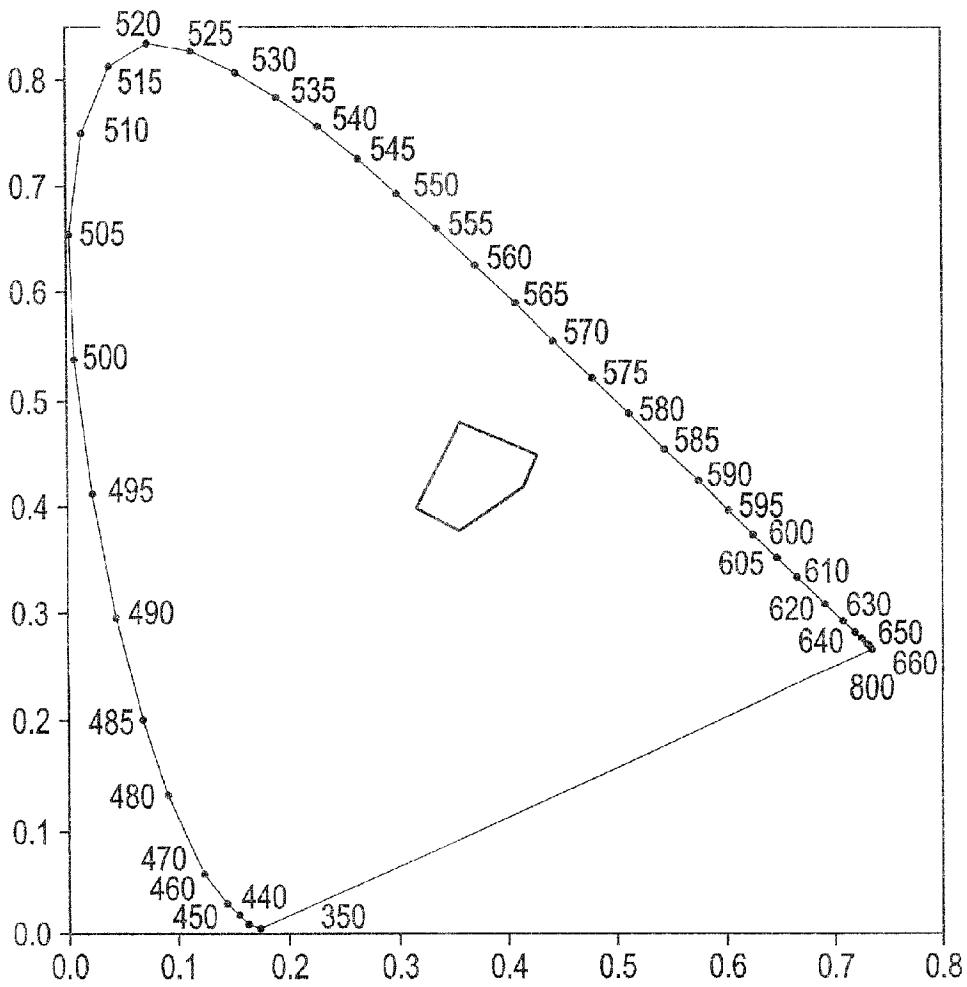
FIG. 10 is a plot of an area on a 1931 CIE Chromaticity Diagram that is discussed below.
Figure 11:
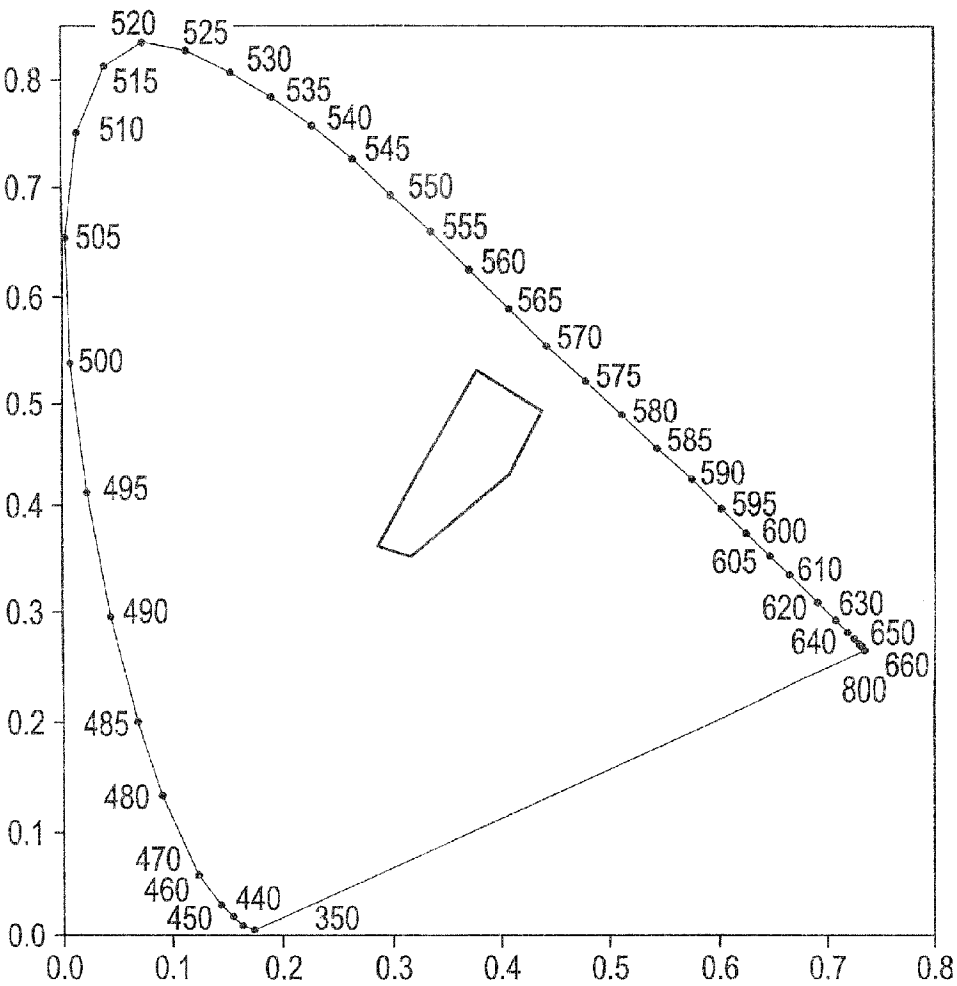
FIG. 11 is a plot of an area on a 1931 CIE Chromaticity Diagram that is discussed below.

The expression "BSY light", as used herein, means light having x, y color coordinates which define a point which is within (1) an area on a 1931 CIE Chromaticity Diagram enclosed by first, second, third, fourth and fifth line segments, the first line segment connecting a first point to a second point, the second line segment connecting the second point to a third point, the third line segment connecting the third point to a fourth point, the fourth line segment connecting the fourth point to a fifth point, and the fifth line segment connecting the fifth point to the first point, the first point having x, y coordinates of 0.32, 0.40, the second point having x, y coordinates of 0.36, 0.48, the third point having x, y coordinates of 0.43, 0.45, the fourth point having x, y coordinates of 0.42, 0.42, and the fifth point having x, y coordinates of 0.36, 0.38 (this area is depicted in FIG. 10), and/or (2) an area on a 1931 CIE Chromaticity Diagram enclosed by first, second, third, fourth and fifth line segments, the first line segment connecting a first point to a second point, the second line segment connecting the second point to a third point, the third line segment connecting the third point to a fourth point, the fourth line segment connecting the fourth point to a fifth point, and the fifth line segment connecting the fifth point to the first point, the first point having x, y coordinates of 0.29, 0.36, the second point having x, y coordinates of 0.32, 0.35, the third point having x, y coordinates of 0.41, 0.43, the fourth point having x, y coordinates of 0.44, 0.49, and the fifth point having x, y coordinates of 0.38, 0.53 (this area is depicted in FIG. 11).

Figure 12:
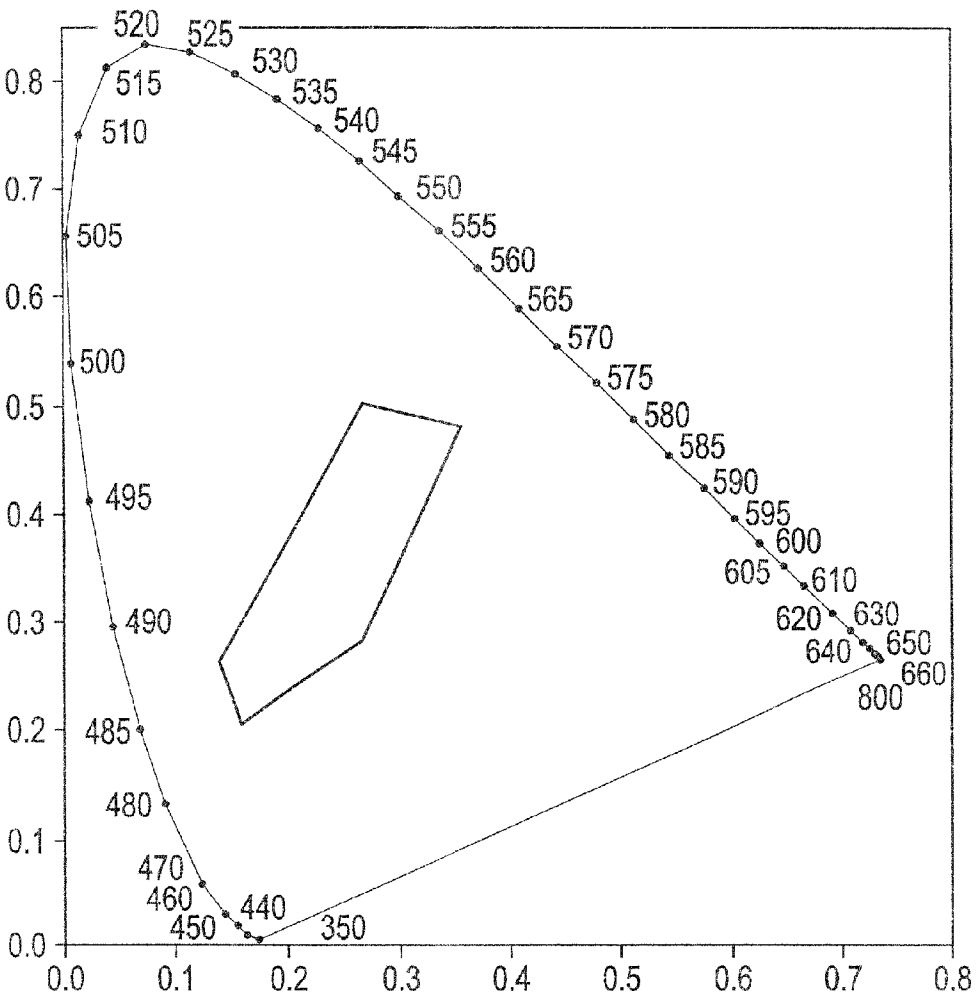
FIG. 12 is a plot of an area on a 1931 CIE Chromaticity Diagram that is discussed below.
Figure 13:
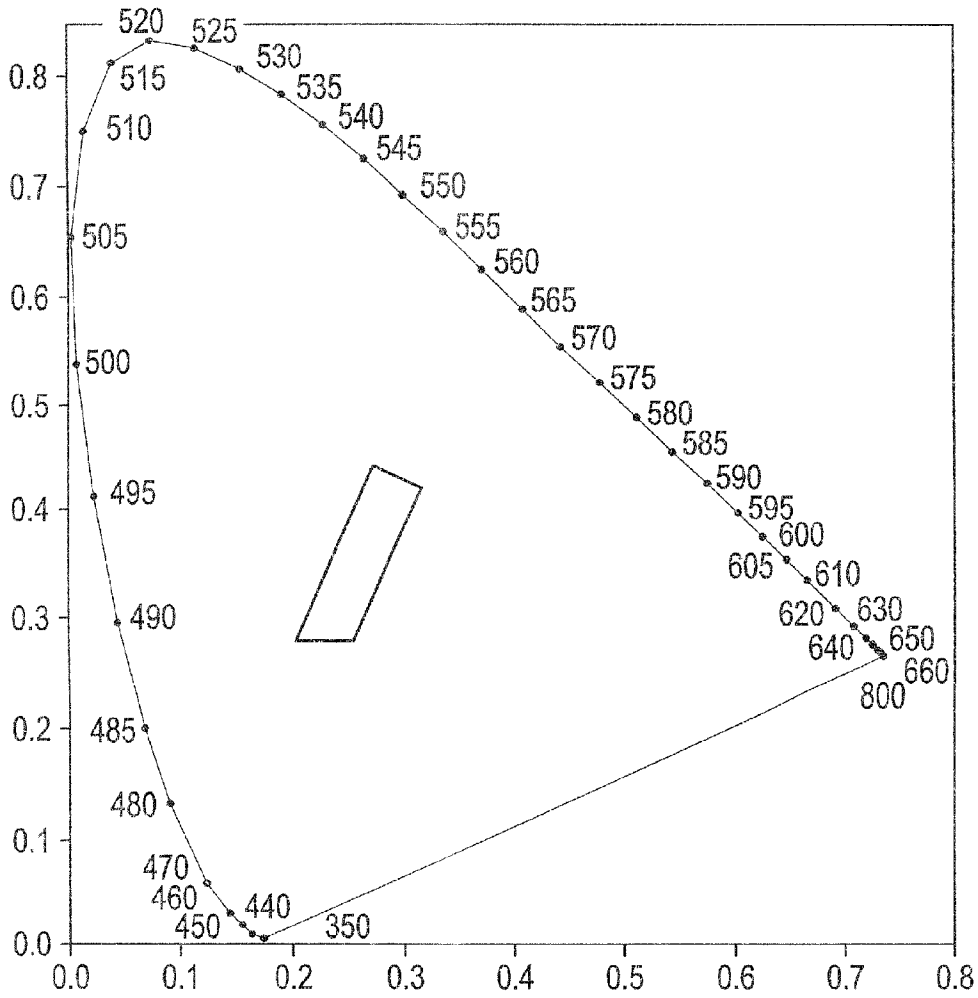
FIG. 13 is a plot of an area on a 1931 CIE Chromaticity Diagram that is discussed below.
Figure 14:
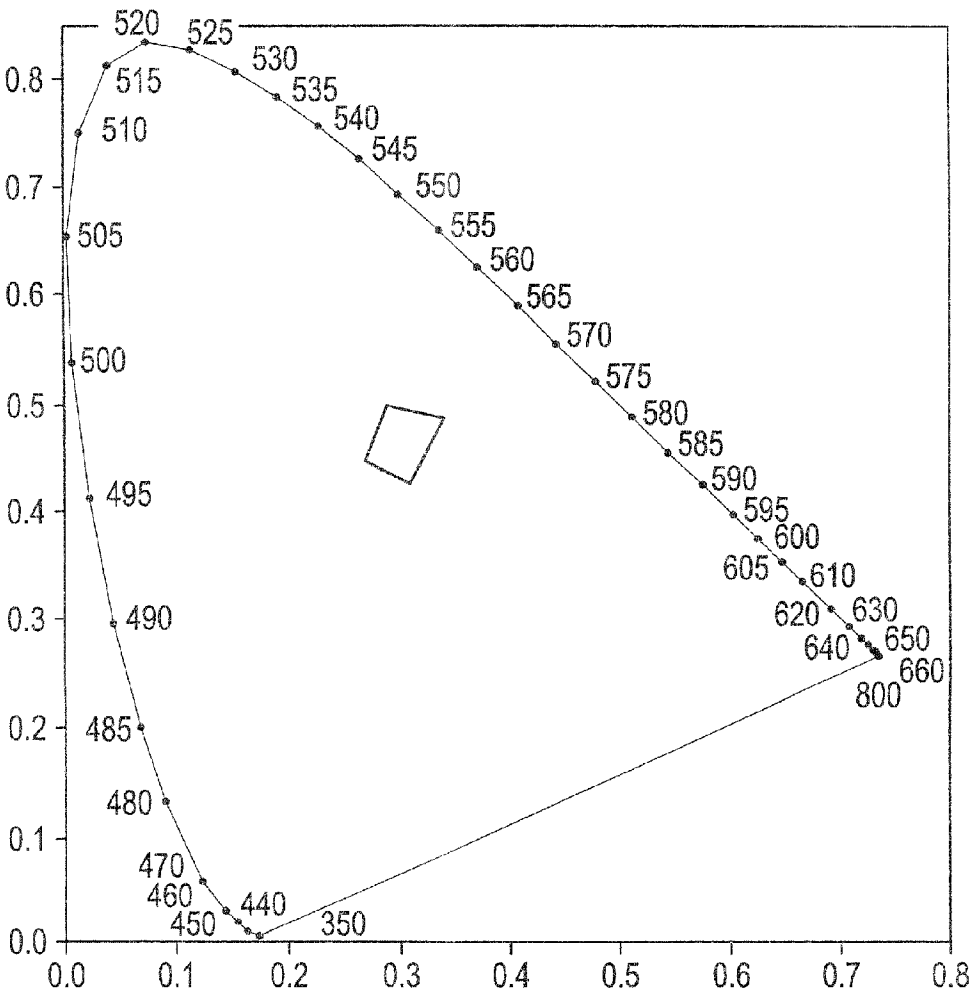
FIG. 14 is a plot of an area on a 1931 CIE Chromaticity Diagram that is discussed below.

The expression "BSG light", as used herein, means light having x, y color coordinates which define a point which is within (1) an area on a 1931 CIE Chromaticity Diagram enclosed by first, second, third, fourth and fifth line segments, the first line segment connecting a first point to a second point, the second line segment connecting the second point to a third point, the third line segment connecting the third point to a fourth point, the fourth line segment connecting the fourth point to a fifth point, and the fifth line segment connecting the fifth point to the first point, the first point having x, y coordinates of 0.35, 0.48, the second point having x, y coordinates of 0.26, 0.50, the third point having x, y coordinates of 0.13, 0.26, the fourth point having x, y coordinates of 0.15, 0.20, and the fifth point having x, y coordinates of 0.26, 0.28 (this area is depicted in FIG. 12), and/or (2) an area on a 1931 CIE Chromaticity Diagram enclosed by first, second, third and fourth line segments, the first line segment connecting a first point to a second point, the second line segment connecting the second point to a third point, the third line segment connecting the third point to a fourth point, the fourth line segment connecting the fourth point to the first point, the first point having x, y coordinates of 0.21, 0.28, the second point having x, y coordinates of 0.26, 0.28, the third point having x, y coordinates of 0.32, 0.42, and the fourth point having x, y coordinates of 0.28, 0.44 (this area is depicted in FIG. 13), and/or (3) an area on a 1931 CIE Chromaticity Diagram enclosed by first, second, third and fourth line segments, the first line segment connecting a first point to a second point, the second line segment connecting the second point to a third point, the third line segment connecting the third point to a fourth point, the fourth line segment connecting the fourth point to the first point, the first point having x, y coordinates of 0.30, 0.49, the second point having x, y coordinates of 0.35, 0.48, the third point having x, y coordinates of 0.32, 0.42, and the fourth point having x, y coordinates of 0.28, 0.44 (this area is depicted in FIG. 14).

The expression "red light" is used to refer to light having a dominant wavelength in the range of from about 600 nm to about 640 nm (i.e., the expression "red light", as used herein, can refer to light that is red or orange-red), in which the light can be emitted by one or more light emitting diode and/or one or more luminescent materials.

As noted above, in some embodiments in accordance with the present inventive subject matter, which can include or not include, as suitable, any of the other features described herein, light exiting from a mixing chamber has good uniformity of color hue. The expression "good uniformity of color hue", as used herein, can indicate that when solid state light emitters are emitting light, each of at least 50 (and in some instances 100, 200, 300, 500 or 1,000) non-overlapping conceptual square regions of approximately equal size (not physically defined, but instead defined by imaginary lines) of the exit region of a mixing chamber have a color hue that is within 0.01 unit of a first color point on a 1976 CIE Chromaticity Diagram (each of the non-overlapping square regions comprising a corresponding percentage of a total surface area of the exit region, e.g., each of 50 square regions comprising 1/50 of the total surface area, or each of 100 square regions comprising 1/100 of the total surface area, or each of 500 square regions comprising 1/500 of the total surface area, etc.). In some situations, "good uniformity of color hue" (and/or "good uniformity of emitted light color") can be assessed based on whether or not the color hue uniformity requirements of the L Prize are met. In some situations, "good uniformity of color hue" (and/or "good uniformity of emitted light color") can mean that there is less than 500 K CCT variation over the surface of the mixing chamber (or over the exit region of the mixing chamber).

Figure 15:
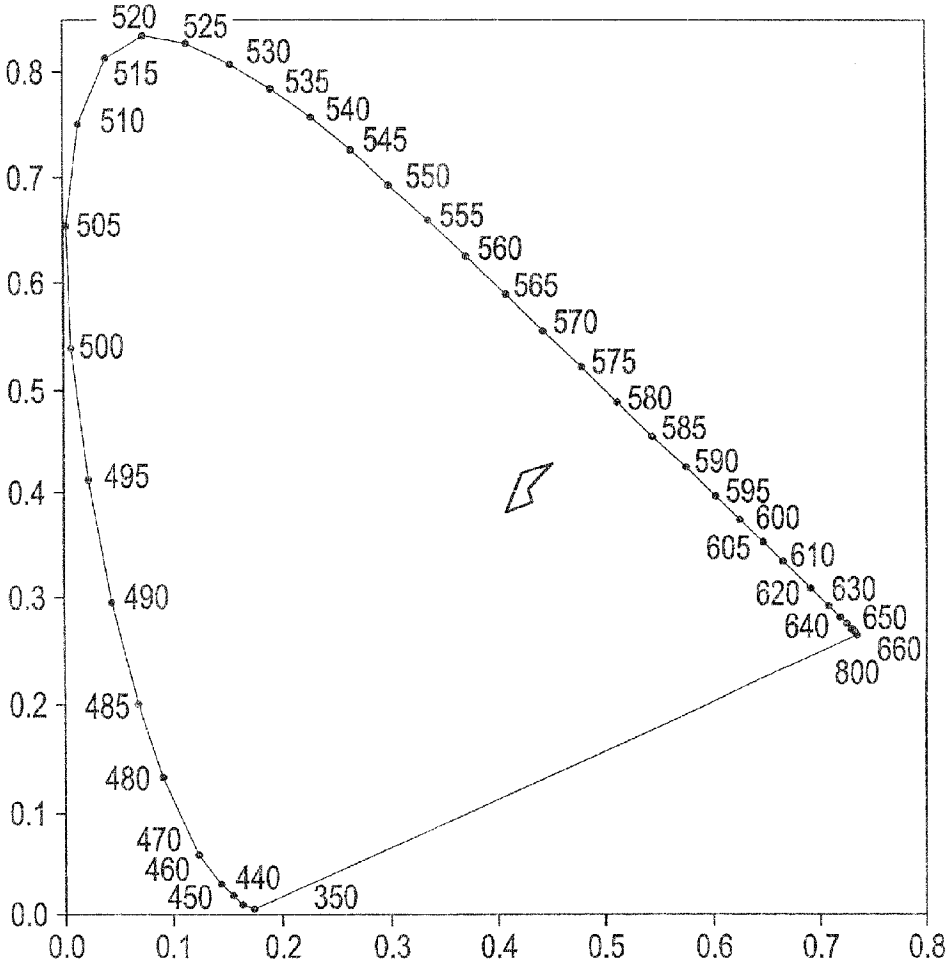
FIG. 15 is a plot of an area on a 1931 CIE Chromaticity Diagram that is discussed below.
Figure 16:
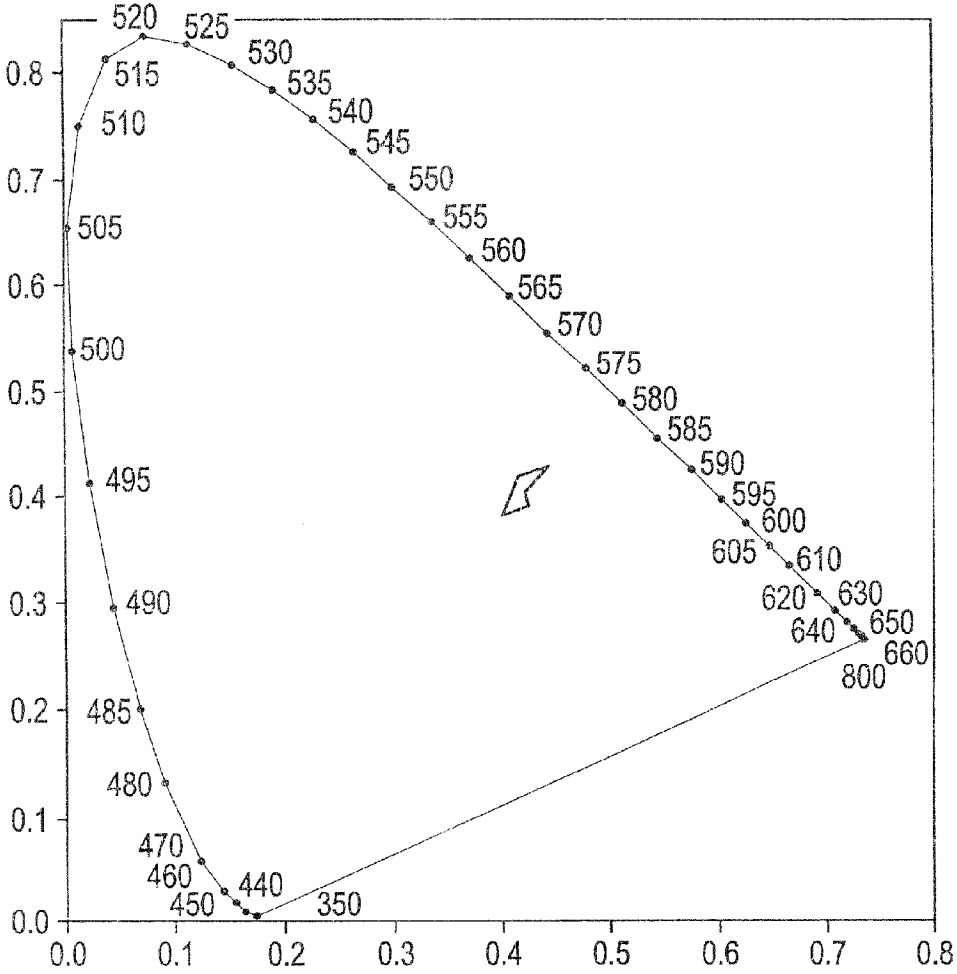
FIG. 16 is a plot of an area on a 1931 CIE Chromaticity Diagram that is discussed below.
Figure 17:
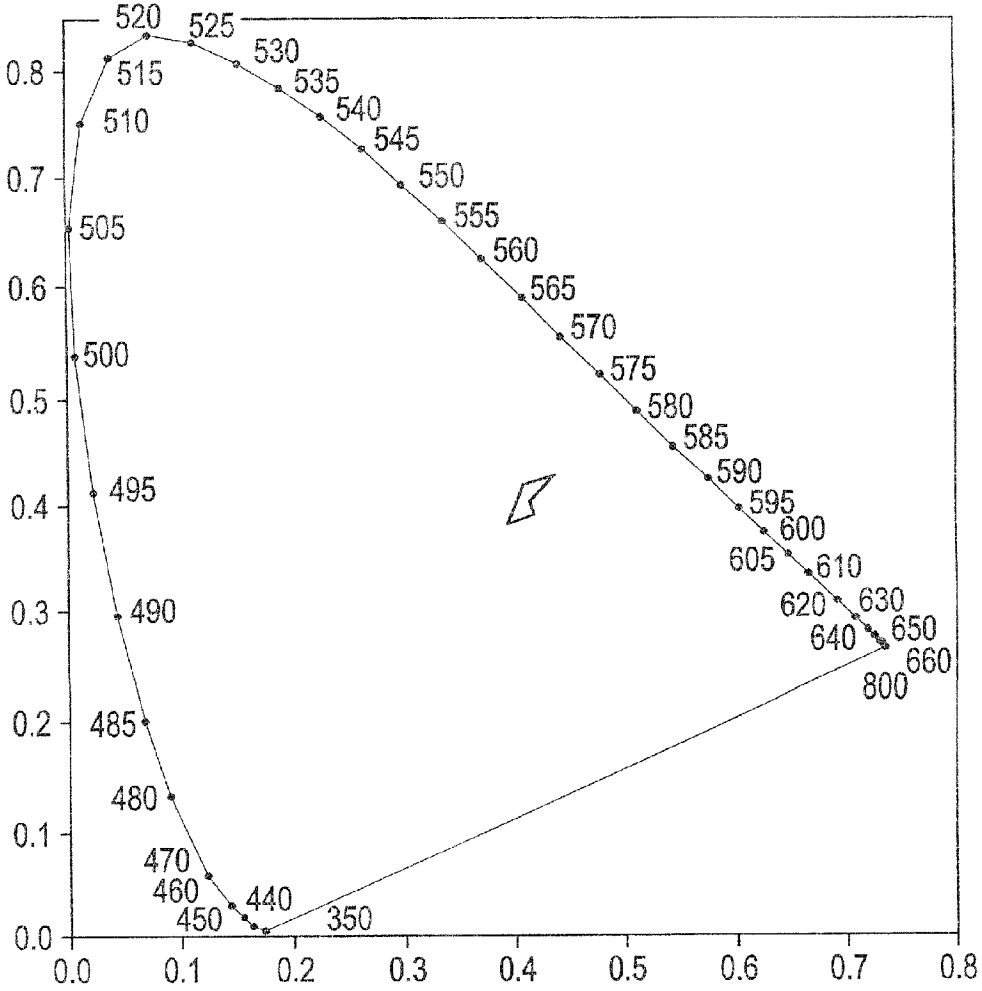
FIG. 17 is a plot of an area on a 1931 CIE Chromaticity Diagram that is discussed below.

With regard to any mixed light described herein in terms of its proximity (e.g., in MacAdam ellipses) to the blackbody locus on a 1931 CIE Chromaticity Diagram and/or on a 1976 CIE Chromaticity Diagram, the present inventive subject matter is further directed to such mixed light in the proximity of light on the blackbody locus having color temperature of 2700 K, 3000 K or 3500 K, namely:

mixed light having x, y color coordinates which define a point which is within a third area on a 1931 CIE Chromaticity Diagram, the third area (this area is depicted in FIG. 15) being enclosed by first, second, third, fourth and fifth line segments, the first line segment connecting a first point to a second point, the second line segment connecting the second point to a third point, the third line segment connecting the third point to a fourth point, the fourth line segment connecting the fourth point to a fifth point, and the fifth line segment connecting the fifth point to the first point, the first point having x, y coordinates of 0.4578, 0.4101, the second point having x, y coordinates of 0.4813, 0.4319, the third point having x, y coordinates of 0.4562, 0.4260, the fourth point having x, y coordinates of 0.4373, 0.3893, and the fifth point having x, y coordinates of 0.4593, 0.3944 (i.e., proximate to 2700 K); or mixed light having x, y color coordinates which define a point which is within a fourth area on a 1931 CIE Chromaticity Diagram, the fourth area (this area is depicted in FIG. 16) being enclosed by first, second, third, fourth and fifth line segments, the first line segment connecting a first point to a second point, the second line segment connecting the second point to a third point, the third line segment connecting the third point to a fourth point, the fourth line segment connecting the fourth point to a fifth point, and the fifth line segment connecting the fifth point to the first point, the first point having x, y coordinates of 0.4338, 0.4030, the second point having x, y coordinates of 0.4562, 0.4260, the third point having x, y coordinates of 0.4299, 0.4165, the fourth point having x, y coordinates of 0.4147, 0.3814, and the fifth point having x, y coordinates of 0.4373, 0.3893 (i.e., proximate to 3000 K); or mixed light having x, y color coordinates which define a point which is within a fifth area (this area is depicted in FIG. 17) on a 1931 CIE Chromaticity Diagram enclosed by first, second, third, fourth and fifth line segments, the first line segment connecting a first point to a second point, the second line segment connecting the second point to a third point, the third line segment connecting the third point to a fourth point, the fourth line segment connecting the fourth point to a fifth point, and the fifth line segment connecting the fifth point to the first point, the first point having x, y coordinates of 0.4073, 0.3930, the second point having x, y coordinates of 0.4299, 0.4165, the third point having x, y coordinates of 0.3996, 0.4015, the fourth point having x, y coordinates of 0.3889, 0.3690, and the fifth point having x, y coordinates of 0.4147, 0.3814 (i.e., proximate to 3500 K).

The solid state light emitters in lighting devices in accordance with the present inventive subject matter can generally be arranged in any suitable way. In some embodiments in accordance with the present inventive subject matter, which can include or not include, as suitable, any of the other features described herein, the solid state light emitters can be relatively tightly packed together, e.g., the surface area a region that has a perimeter that extends around all of the solid state light emitters and that has no inflection points is not much greater (e.g., not more than 10% larger, not more than 15% larger, not more than 20% larger, not more than 25% larger, not more than 30% larger, not more than 35% larger, or not more than 40% larger) than the combined surface area of the emission surfaces of the solid state light emitters.

The expression "points of inflection" as used herein, e.g., in the expression "a perimeter that does not have any points of inflection" refers to a continuous border that can have one or more straight portions, one or more angled portions and/or one or more curved portions that has no inflection points (i.e., no points where the sign of curvature or concavity changes).

Solid state light emitters can be mounted (e.g., on one or more circuit board or directly on a housing, on a mixing chamber, on a light output shaping member, etc.) in any suitable way, e.g., by using chip on heat sink mounting techniques, by soldering (e.g., if the lighting device comprises a metal core printed circuit board (MCPCB), flex circuit or even a standard PCB, such as an FR4 board with thermal vias), for example, light emitting diodes can be mounted using substrate techniques such as from Thermastrate Ltd of Northumberland, UK. If desired, a surface on which solid state light emitters are to be mounted and/or the solid state light emitters can be machined or otherwise formed to be of matching topography so as to provide high heat sink surface area and/or good adhesion or other properties Some embodiments in accordance with the present inventive subject matter comprise a power line. Persons of skill in the art are familiar with, and have ready access to, a variety of structures that can be used as a power line. A power line can be any structure that can carry electrical energy to a solid state light emitter. In some embodiments, a string of solid state light emitters, and/or an arrangement comprising a plurality of strings of solid state light emitters arranged in parallel, is/are arranged in series with a power line, such that current is supplied through a power line and is ultimately supplied to the string or strings. In some embodiments, power is supplied to a power line before and/or after going through a power supply.

Some embodiments of the present inventive subject matter comprise at least a first power line, a first group of solid state light emitters and a second group of solid state light emitters. In some of such embodiments, including some embodiments that include or do not include any of the features as discussed herein, if current is supplied to a first power line, substantially all of the light emitted by the lighting device is emitted by the first group of solid state light emitters and the second group of solid state light emitters.

Some embodiments of the present inventive subject matter comprise at least a first power line, a first group of solid state light emitters, a second group of solid state light emitters and a third group of solid state light emitters. In some of such embodiments, including some embodiments that include or do not include any of the features as discussed herein, if current is supplied to a first power line, substantially all of the light emitted by the lighting device is emitted by the first group of solid state light emitters, the second group of solid state light emitters and the third group of solid state light emitters.

In some embodiments of the present inventive subject matter that comprise at least a first power line, a first group of solid state light emitters and a second group of solid state light emitters comprising at least a first luminescent material, including some embodiments that include or do not include any of the features as discussed herein, if current is supplied to the first power line, the brightness of light emitted by the first group of solid state light emitters and the first luminescent material is at least about 75 percent (in some embodiments at least about 85 percent, and in some embodiments at least about 90 percent, 95 percent) of the total brightness of light being emitted by the lighting device.

In some embodiments of the present inventive subject matter that comprise at least a first power line, a first group of solid state light emitters, a second group of solid state light emitters comprising at least a first luminescent material and a third group of solid state light emitters, including some embodiments that include or do not include any of the features as discussed herein, if current is supplied to the first power line, the brightness of light emitted by the first group of solid state light emitters, the first luminescent material and the third group of solid state light emitters is at least about 75 percent (in some embodiments at least about 85 percent, and in some embodiments at least about 90 percent, 95 percent) of the total brightness of light being emitted by the lighting device.

In some embodiments of the present inventive subject matter that comprise at least a first power line, a first group of solid state light emitters and a second group of solid state light emitters comprising at least a first luminescent material, including some embodiments that include or do not include any of the features as discussed herein, the first and second groups of solid state light emitters are illuminated by supplying current to the first power line.

Respective solid state light emitters or groups of solid state light emitters can be electrically connected in any suitable pattern, e.g., in parallel, in series, in series parallel (e.g., in a series of subsets, each subset comprising two or more (e.g., three) solid state light emitters arranged in parallel), in a single string or in two or more strings, etc.

In some embodiments of the present inventive subject matter, including some embodiments that include or do not include any of the features as discussed herein, a set of parallel solid state light emitter strings (i.e., two or more strings of solid state light emitters arranged in parallel with each other) is arranged in series with a power line, such that current is supplied through the power line to each of the respective strings of solid state light emitter. The expression "string", as used herein, means that at least two solid state light emitters are electrically connected in series. In some such embodiments, the relative quantities of solid state light emitters in the respective strings differ from one string to the next, e.g., a first string contains a first percentage of 441 nm to 446 nm solid state light emitters and a second string contains a second percentage (different from the first percentage) of 600 nm to 640 nm solid state light emitters. As a representative example, first and second strings each contain solely (i.e., 100%) 441 nm to 446 nm solid state light emitters, and a third string contains 50% 441 nm to 446 nm solid state light emitters and 50% 600 nm to 640 nm solid state light emitters (each of the three strings being electrically connected in parallel to each other and in series with a common power line). By doing so, it is possible to easily adjust the relative intensities of light of respective different wavelengths, and thereby effectively navigate within the CIE Diagram and/or compensate for other changes. For example, the brightness of red light can be increased, when necessary, in order to compensate for any reduction of the brightness of the light generated by 600 nm to 640 nm solid state light emitters. Thus, for instance, in the representative example described above, by increasing or decreasing the current supplied to the third power line, and/or by increasing or decreasing the current supplied to the first power line and/or the second power line (and/or by intermittently interrupting the supply of power to the first power line or the second power line), the x, y coordinates of the mixture of light emitted from the lighting device can be appropriately adjusted.

Some embodiments of the present inventive subject matter comprise at least a first power line, a first group of solid state light emitters and a second group of solid state light emitters. In some of such embodiments, including some embodiments that include or do not include any of the features as discussed herein, the lighting device comprises at least a first set of parallel light emitting diode strings (the arrangement of strings are being referred to herein as being "parallel", even though different voltages and/or currents can be applied to the respective strings), the first set of parallel light emitting diode strings comprising at least a first light emitting diode string and a second light emitting diode string, the first set of parallel light emitting diode strings being arranged in series relative to the first power line, and a first ratio differs from a second ratio, the first ratio being equal to (1) a number of light emitting diodes in the second group of solid state light emitters and in the first light emitting diode string, divided by (2) a number of light emitting diodes in the first group of solid state light emitters and in the first light emitting diode string;

the second ratio being equal to (3) a number of light emitting diodes in the second group of solid state light emitters and in the second light emitting diode string, divided by (4) a number of light emitting diodes in the first group of solid state light emitters and in the second light emitting diode string.

In some embodiments according to the present inventive subject matter, including some embodiments that include or do not include any of the features as discussed herein, a lighting device comprises at least one current adjuster directly or switchably electrically connected to at least one of first and second light emitter strings, and the current adjuster, when adjusted, adjusts the current supplied to at least one of the first and second light emitter strings. In some embodiments, a current adjuster is directly or switchably electrically connected to at least one string of solid state light emitters, and in other embodiments, a plurality of current adjusters are each directly or switchably electrically connected to a respective string of solid state light emitters (or strings of solid state light emitters). In some of embodiments, one or more current adjusters is/are automatically adjusted to maintain a mixture of light within a specific desired region, e.g., within ten MacAdam ellipses (or five MacAdam ellipses, or three MacAdam ellipses) of at least one point on the blackbody locus, on a 1931 CIE Chromaticity Diagram.

Persons of skill in the art are familiar with, and have ready access to, a variety of current adjusters, and any of such current adjusters can be employed in embodiments in accordance with the present inventive subject matter.

In some embodiments of the present inventive subject matter, there are further provided one or more switches electrically connected to one or more respective strings, whereby the switch selectively switches on and off current to one or more solid state light emitters on the respective string.

In some embodiments of the present inventive subject matter, one or more current adjusters and/or one or more switches automatically interrupt and/or adjust current passing through one or more respective strings in response to a detected change in the output from the lighting device (e.g., an extent of deviation from the blackbody locus), a detected change in temperature (e.g., in the lighting device or ambient) or in accordance with a desired pattern (e.g., based on the time of day or night, such as altering the correlated color temperature of the combined emitted light).

Some embodiments in accordance with the present inventive subject matter can employ at least one temperature sensor. Persons of skill in the art are familiar with, and have ready access to, a variety of temperature sensors (e.g., thermistors), and any of such temperature sensors can be employed in embodiments in accordance with the present inventive subject matter. Temperature sensors can be used for a variety of purposes, e.g., to provide feedback information to current adjusters.

In some embodiments of the present inventive subject matter, there is/are provided one or more thermistors which detect temperature and, as temperature changes, cause one or more current adjusters and/or one or more switches to automatically interrupt and/or adjust current passing through one or more respective strings in order to compensate for such temperature change. In general, 615 nm to 620 nm light emitting diodes get dimmer as their temperature increases—in such embodiments, fluctuations in brightness caused by such temperature variation can be compensated for.

In some embodiments in accordance with the present inventive subject matter, which can include or not include, as suitable, any of the other features described herein, the lighting device can further comprise a housing. The housing (if included) can generally be of any suitable shape and size, and can be made out of any suitable material or materials. Representative examples of materials that can be used in making a housing include, among a wide variety of other materials, extruded aluminum, powder metallurgy formed aluminum, die cast aluminum, liquid crystal polymer, polyphenylene sulfide (PPS), thermoset bulk molded compound or other composite material. In some embodiments in accordance with the present inventive subject matter, which can include or not include, as suitable, any of the other features described herein, a housing (if included) can comprise a material that can be molded and/or shaped, and/or it can comprise a material that is an effective heat sink (i.e., which has high thermal conductivity and/or high heat capacity).

In some embodiments, a housing can be formed of a material that is an effective heat sink (i.e., that has high thermal conductivity and/or high heat capacity) and/or that is reflective (or that is coated with a reflective material). A representative example of a material out of which the fixture housing can be made is sheet metal. In some embodiments, a housing can include a reflective element (and/or one or more of its surfaces are reflective), so that light is reflected by such reflective surfaces. Such reflective elements (and surfaces) are well-known and readily available to persons skilled in the art. A representative example of a suitable material out of which a reflective element can be made is a material marketed by Furukawa (a Japanese corporation) under the trademark MCPET®.

In some embodiments in accordance with the present inventive subject matter, which can include or not include, as suitable, any of the other features described herein, the lighting device can further comprise a fixture. A fixture (if included) can generally be of any suitable shape and size, and can be made out of any suitable material or materials. Representative examples of materials that can be used in making a housing include, among a wide variety of other materials, extruded aluminum, powder metallurgy formed aluminum, die cast aluminum, liquid crystal polymer, polyphenylene sulfide (PPS), thermoset bulk molded compound or other composite material. In some embodiments in accordance with the present inventive subject matter, which can include or not include, as suitable, any of the other features described herein, a housing (if included) can comprise a material that can be molded and/or shaped, and/or it can comprise a material that is an effective heat sink (i.e., which has high thermal conductivity and/or high heat capacity).

Some embodiments in accordance with the present inventive subject matter include a mixing chamber element (or plural mixing chamber elements), which defines at least a portion of a mixing chamber in which light from one or more solid state light emitters is mixed before exiting the lighting device. A mixing chamber element, when included, can be of any suitable shape and size, and can be made of any suitable material or materials. Representative examples of materials that can be used for making a mixing chamber element include, among a wide variety of other materials, spun aluminum, powder metallurgy formed aluminum, stamped aluminum, die cast aluminum, rolled or stamped steel, hydroformed aluminum, injection molded metal, injection molded thermoplastic, compression molded or injection molded thermoset, molded glass, liquid crystal polymer, polyphenylene sulfide (PPS), clear or tinted acrylic (e.g., poly(methyl methacrylate) (i.e., PMMA)) sheet, cast or injection molded acrylic, thermoset bulk molded compound or other composite material. In some embodiments that include a mixing chamber element, the mixing chamber element can consist of or can comprise a reflective element (and/or one or more of its surfaces can be reflective). Such reflective elements (and surfaces) are well known and readily available to persons skilled in the art. A representative example of a suitable material out of which a reflective element can be made is a material marketed by Furukawa (a Japanese corporation) under the trademark MCPET®. In some embodiments that include a mixing chamber, the mixing chamber is defined (at least in part) by a mixing chamber element and a lens and/or diffuser.

In some embodiments that include a mixing chamber, the mixing chamber is defined (at least in part) by a trim element (e.g., instead of or in addition to a mixing chamber element). In some embodiments that include a mixing chamber, the mixing chamber is defined (at least in part) by a trim element, along with a mixing chamber element, a lens and/or a diffuser.

As noted above, in some embodiments in accordance with the present inventive subject matter, there are provided lighting devices that comprise at least one light output shaping element.

Persons of skill in the art are familiar with, have access to, and can readily make, a wide variety of light output shaping elements. A representative example of a suitable light output shaping element is a reflector, e.g., a reflective surface in any suitable shape, e.g., a hollow frustoconical shape. Another representative example of a suitable light output shaping element is a lens, e.g., a light transmissive material in any suitable shape, e.g., a disc having a flat surface on one side and a convex surface on a second side, a disc having a concave surface on one side and a convex surface on a second side, any of a variety of readily available TIR lenses, etc. A light output shaping element (if included) can comprise one or more light transmissive regions or elements and/or one or more reflective regions or elements).

In embodiments according to the present inventive subject matter that comprise one or more light output shaping elements, a light output shaping element can be made of any suitable material or materials, a wide variety of which are well known to those of skill in the art. For instance, representative examples include any of a wide variety of light transmissive materials (e.g., glass, plastic, SiC, polycarbonate, etc.), and any of a wide variety of reflective materials (e.g., aluminum, plastic, ceramic or glass, any of which can, if desired, be coated with any suitable material, e.g., silver, aluminum, etc.). In embodiments in which one or more materials is/are coated, applied, laminated, mounted, etc. onto another material or materials, such coating, applying, laminating, mounting, etc. can be carried out in any suitable way (e.g., by vacuum metallization, etc.).

In embodiments according to the present inventive subject matter that comprise one or more light output shaping elements, a light output shaping element can have any of a wide range of surface and/or internal structures to assist in heat dissipation, as is well known in the art, e.g., an external surface that faces away from the majority of the light emitted it can be textured, can have grooves, can be faceted, can be painted, etc. (or it can be smooth).

In some embodiments in accordance with the present inventive subject matter, which can include or not include, as suitable, any of the other features described herein, the lighting device can further comprise one or more trim elements and/or one or more accessories. Representative examples of materials that are suitable for making accessories include, among a wide variety of other materials, spun aluminum, powder metallurgy formed aluminum, stamped aluminum, die cast aluminum, rolled or stamped steel, hydroformed aluminum, injection molded metal, injection molded thermoplastic, compression molded or injection molded thermoset, molded glass, liquid crystal polymer, polyphenylene sulfide (PPS), clear or tinted acrylic sheet (e.g., poly(methyl methacrylate) (PMMA)), cast or injection molded acrylic, thermoset bulk molded compound or other composite material.

In some embodiments in accordance with the present inventive subject matter, which can include or not include, as suitable, any of the other features described herein, the lighting device can further comprise a power supply and/or one or more controls (e.g., one or more current regulators, one or more color balance control components, one or more dimming control components), a wide variety of which (and a wide variety of combinations of which) are well known to persons skilled in the art, and any one which (or any combination of which) can be employed in the lighting devices according to the present inventive subject matter.

In embodiments that include a housing and a power supply (and/or one or more components thereof) and/or one or more controls (and/or one or more components thereof), any or all of the power supply and/or the controls (or any component or components thereof) can be inside or outside the housing. In such embodiments, positioning any or all of the power supply and/or the controls (or any component or components thereof) outside the housing can help to reduce the thermal load within the housing.

In some embodiments in accordance with the present inventive subject matter that comprise a power supply, a power supply can comprise any electronic components that are suitable for a lighting device, for example, any of (1) one or more electrical components employed in converting electrical power (e.g., from AC to DC and/or from one voltage to another voltage), (2) one or more electronic components employed in driving one or more solid state light emitters, e.g., running one or more solid state light emitters intermittently and/or adjusting the current supplied to one or more solid state light emitters in response to a user command, a detected change in brightness or color of light output, a detected change in an ambient characteristic such as temperature (e.g., a compensation circuit) or background light, etc., and/or a signal contained in the input power (e.g., a dimming signal in AC power supplied to the lighting device), etc., (3) one or more circuit boards (e.g., a metal core circuit board) for supporting and/or providing current to any electrical components, and/or (4) one or more wires connecting any components (e.g., connecting an Edison socket to a circuit board), etc., e.g. electronic components such as linear current regulated supplies, pulse width modulated current and/or voltage regulated supplies, bridge rectifiers, transformers, power factor controllers etc.

In some embodiments in accordance with the present inventive subject matter, which can include or not include, as suitable, any of the other features described herein, the lighting device can further comprise an electrical connector. Various types of electrical connectors are well known to those skilled in the art, and any of such electrical connectors can be attached within (or attached to) the lighting devices according to the present inventive subject matter. Representative examples of suitable types of electrical connectors include wires (for splicing to a branch circuit), Edison plugs (which are receivable in Edison sockets) and GU24 pins (which are receivable in GU24 sockets). Other well known types of electrical connectors include 2-pin (round) GX5.3, can DC bay, 2-pin GY6.35, recessed single contact R7s, screw terminals, 4 inch leads, 1 inch ribbon leads, 6 inch flex leads, 2-pin GU4, 2-pin GU5.3, 2-pin G4, turn & lock GU7, GU10, G8, G9, 2-pin Pf, min screw E10, DC bay BA15d, min cand E11, med screw E26, mog screw E39, mogul bipost G38, ext. mog end pr GX16d, mod end pr GX16d and med skirted E26/50x39 (see https://www.gecatalogs.com/lighting/software/GELightingCatalogSetup.exe).

In some embodiments in accordance with the present inventive subject matter, which can include or not include, as suitable, any of the other features described herein, some or all of the solid state light emitters in the lighting device can be on one or more circuit boards, a wide variety of which are well known, readily available and able to be made by persons of skill in the art. A representative example of a suitable circuit board (when employed) for use in the lighting devices according to the present inventive subject matter is a metal core printed circuit board.

In some embodiments in accordance with the present inventive subject matter, which can include or not include, as suitable, any of the other features described herein, any of a wide variety of thermal dissipation features can be provided. Persons of skill in the art are familiar with a wide variety of thermal dissipation features, any of which or any combination of which can be employed in any lighting device in accordance with the present inventive subject matter.

For example, in some embodiments in accordance with the present inventive subject matter, which can include or not include, as suitable, any of the other features described herein, a light output shaping element and/or a mixing chamber and/or a housing can be thermally coupled to the solid state light emitters, and/or (as discussed above) there can be provided a light output shaping element and/or a mixing chamber and/or a housing that conducts heat effectively (e.g., it is formed of aluminum) and/or that has high heat capacity, and/or that has one or more surfaces that is/are textured, that has/have grooves, that is/are faceted, that has one or more fins, that is/are painted, etc., and/or there can be provided a light output shaping element and/or a mixing chamber and/or a housing that conducts heat effectively (e.g., it is formed of aluminum) and/or that has high heat capacity, and/or that has one or more surfaces that is/are textured, that has/have grooves, that is/are faceted, that has one or more fins, that is/are painted, etc., and/or there can be provided one or more thermal connector regions (such as a graphite sheet or graphite foam member), a variety of which are known to those of skill in the art.

Some embodiments of lighting devices according to the present inventive subject matter have only passive cooling. On the other hand, some embodiments of lighting devices according to the present inventive subject matter can have active cooling (and can optionally also have passive cooling features). The expression "active cooling" is used herein in a manner that is consistent with its common usage to refer to cooling that is achieved through the use of some form of energy, as opposed to "passive cooling", which is achieved without the use of energy (i.e., while energy is supplied to the solid state light emitters, passive cooling is the cooling that would be achieved without the use of any component(s) that would require additional energy in order to function to provide additional cooling).

Some embodiments in accordance with the present inventive subject matter (which can include or not include any of the features described elsewhere herein) can include one or more lenses, diffusers or light control elements. Persons of skill in the art are familiar with a wide variety of lenses (e.g., Fresnel lenses, prismatic lenses and dome recycling lenses), diffusers and light control elements, can readily envision a variety of materials out of which a lens, a diffuser, or a light control element can be made (e.g., polycarbonate materials, acrylic materials, fused silica, polystyrene, etc.), and are familiar with and/or can envision a wide variety of shapes that lenses, diffusers and light control elements can be. Any of such materials and/or shapes can be employed in a lens and/or a diffuser and/or a light control element in an embodiment that includes a lens and/or a diffuser and/or a light control element. As will be understood by persons skilled in the art, a lens or a diffuser or a light control element in a lighting device according to the present inventive subject matter can be selected to have any desired effect on incident light (or no effect), such as focusing, diffusing, etc. Any such lens and/or diffuser and/or light control element can comprise one or more luminescent materials, e.g., one or more phosphor.

In embodiments in accordance with the present inventive subject matter that include a lens (or plural lenses), the lens (or lenses) can be positioned in any suitable location and orientation.

In embodiments in accordance with the present inventive subject matter that include a diffuser (or plural diffusers), the diffuser (or diffusers) can be positioned in any suitable location and orientation. In some embodiments, which can include or not include any of the features described elsewhere herein, a diffuser can be provided over a top or any other part of the lighting device, and the diffuser can comprise one or more luminescent material (e.g., in particulate form) spread throughout a portion of the diffuser or an entirety of the diffuser.

In embodiments in accordance with the present inventive subject matter that include a light control element (or plural light control elements), the light control element (or light control elements) can be positioned in any suitable location and orientation. Persons of skill in the art are familiar with a variety of light control elements, and any of such light control elements can be employed.

In addition, one or more scattering elements (e.g., layers) can optionally be included in the lighting devices according to the present inventive subject matter. For example, a scattering element can be included in a lumiphor, and/or a separate scattering element can be provided. A wide variety of separate scattering elements and combined luminescent and scattering elements are well known to those of skill in the art, and any such elements can be employed in the lighting devices of the present inventive subject matter.

In some embodiments according to the present inventive subject matter, including some embodiments that include or do not include any of the features as discussed herein, there is provided a lighting device that emits light of any desired correlated color temperature.

In some aspects of the present inventive subject matter, there are provided solid state light emitter lighting devices that provide good efficiency and that are within the size and shape constraints of the lamp for which the solid state light emitter lighting device is a replacement. In some embodiments of this type, there are provided solid state light emitter lighting devices that provide lumen output of at least 600 lumens, and in some embodiments at least 750 lumens, at least 900 lumens, at least 1000 lumens, at least 1100 lumens, at least 1200 lumens, at least 1300 lumens, at least 1400 lumens, at least 1500 lumens, at least 1600 lumens, at least 1700 lumens, at least 1800 lumens.

In some embodiments of the present inventive subject matter, including some embodiments that include or do not include any of the features as discussed herein, a combination of light exiting the lighting device has a CRI Ra of at least 70 (and in some cases at least 75, in some cases at least 80, in some cases at least 85, in some cases at least 90 and in some cases at least 95).

Lighting devices according to the present inventive subject matter can be configured to emit (when supplied with electricity) light of any color or hue. For example, in some embodiments, lighting devices can emit white light (e.g., they can include light emitting diodes and/or luminescent material which emit light that, when blended, mix to produce light that is perceived as white light). Alternatively, in some embodiments, lighting devices can emit light that is blue, green, yellow, orange, red, or any other color or hue.

Lighting devices according to the present inventive subject matter can provide a beam of light that has a variety of desired properties, e.g., a brightness full width half max (FWHM) of between 8 and 60 degrees with exceptional cutoff, e.g., greater than 60% (or greater than 70%, greater than 80%, greater than 85%, or greater than 90%) of total flux within the FWHM, and therefore very low glare.

Energy can be supplied to the lighting device from any source or combination of sources, for example, the grid (e.g., line voltage), one or more batteries, one or more photovoltaic energy collection devices (i.e., a device that includes one or more photovoltaic cells that convert energy from the sun into electrical energy), one or more windmills, etc.

In some embodiments according to the present inventive subject matter, the lighting device is a self-ballasted device. For example, in some embodiments, the lighting device can be directly connected to AC current (e.g., by being plugged into a wall receptacle, by being screwed into an Edison socket, by being hard-wired into a circuit, etc.).

In some embodiments according to the present inventive subject matter, including some embodiments that include or do not include any of the features as discussed herein, the lighting device has a wall plug efficiency of at least 25 lumens per watt, in some cases at least 35 lumens per watt, in some cases at least 50 lumens per watt, in some cases at least 60 lumens per watt, in some cases at least 70 lumens per watt, and in some cases at least 80 lumens per watt, and in some cases at least 90 lumens per watt, and in some cases at least 100 lumens per watt, and in some cases at least 110 lumens per watt, and in some cases at least 120 lumens per watt.

In some embodiments according to the present inventive subject matter, including some embodiments that include or do not include any of the features as discussed herein, there is provided a lighting device in which if electricity is supplied to the lighting device (1) the lighting device emits light having a CRI Ra of at least 70 (and in some cases at least 75, in some cases at least 80, in some cases at least 85, in some cases at least 90 and in some cases at least 95), and (2) the wall plug efficiency of the lighting device, based on the brightness of light emitted from the lighting device and the energy supplied to the lighting device, is at least 25 lumens per watt, in some cases at least 35 lumens per watt, in some cases at least 50 lumens per watt, in some cases at least 60 lumens per watt, in some cases at least 70 lumens per watt, and in some cases at least 80 lumens per watt, and in some cases at least 90 lumens per watt, and in some cases at least 100 lumens per watt, and in some cases at least 110 lumens per watt, and in some cases at least 120 lumens per watt, e.g.,

- the lighting device emits light having a CRI Ra of at least 70 and the wall plug efficiency of the lighting device, based on the brightness of light emitted from the lighting device and the energy supplied to the lighting device, is at least 25 lumens per watt;
- the lighting device emits light having a CRI Ra of at least 70 and the wall plug efficiency of the lighting device, based on the brightness of light emitted from the lighting device and the energy supplied to the lighting device, is at least 35 lumens per watt;
- the lighting device emits light having a CRT Ra of at least 70 and the wall plug efficiency of the lighting device, based on the brightness of light emitted from the lighting device and the energy supplied to the lighting device, is at least 50 lumens per watt;
- the lighting device emits light having a CRT Ra of at least 70 and the wall plug efficiency of the lighting device, based on the brightness of light emitted from the lighting device and the energy supplied to the lighting device, is at least 60 lumens per watt;

the lighting device emits light having a CRI Ra of at least 70 and the wall plug efficiency of the lighting device, based on the brightness of light emitted from the lighting device and the energy supplied to the lighting device, is at least 70 lumens per watt;

the lighting device emits light having a CRT Ra of at least 70 and the wall plug efficiency of the lighting device, based on the brightness of light emitted from the lighting device and the energy supplied to the lighting device, is at least 80 lumens per watt;

the lighting device emits light having a CRT Ra of at least 70 and the wall plug efficiency of the lighting device, based on the brightness of light emitted from the lighting device and the energy supplied to the lighting device, is at least 90 lumens per watt;

the lighting device emits light having a CRI Ra of at least 70 and the wall plug efficiency of the lighting device, based on the brightness of light emitted from the lighting device and the energy supplied to the lighting device, is at least 100 lumens per watt;

the lighting device emits light having a CRI Ra of at least 70 and the wall plug efficiency of the lighting device, based on the brightness of light emitted from the lighting device and the energy supplied to the lighting device, is at least 110 lumens per watt;

the lighting device emits light having a CRI Ra of at least 70 and the wall plug efficiency of the lighting device, based on the brightness of light emitted from the lighting device and the energy supplied to the lighting device, is at least 120 lumens per watt;

the lighting device emits light having a CRI Ra of at least 75 and the wall plug efficiency of the lighting device, based on the brightness of light emitted from the lighting device and the energy supplied to the lighting device, is at least 25 lumens per watt;

the lighting device emits light having a CRI Ra of at least 75 and the wall plug efficiency of the lighting device, based on the brightness of light emitted from the lighting device and the energy supplied to the lighting device, is at least 35 lumens per watt;

the lighting device emits light having a CRI Ra of at least 75 and the wall plug efficiency of the lighting device, based on the brightness of light emitted from the lighting device and the energy supplied to the lighting device, is at least 50 lumens per watt;

the lighting device emits light having a CRI Ra of at least 75 and the wall plug efficiency of the lighting device, based on the brightness of light emitted from the lighting device and the energy supplied to the lighting device, is at least 60 lumens per watt;

the lighting device emits light having a CRI Ra of at least 75 and the wall plug efficiency of the lighting device, based on the brightness of light emitted from the lighting device and the energy supplied to the lighting device, is at least 70 lumens per watt;

the lighting device emits light having a CRI Ra of at least 75 and the wall plug efficiency of the lighting device, based on the brightness of light emitted from the lighting device and the energy supplied to the lighting device, is at least 80 lumens per watt;

the lighting device emits light having a CRI Ra of at least 75 and the wall plug efficiency of the lighting device, based on the brightness of light emitted from the lighting device and the energy supplied to the lighting device, is at least 90 lumens per watt;

the lighting device emits light having a CRI Ra of at least 75 and the wall plug efficiency of the lighting device, based on the brightness of light emitted from the lighting device and the energy supplied to the lighting device, is at least 100 lumens per watt;

the lighting device emits light having a CRI Ra of at least 75 and the wall plug efficiency of the lighting device, based on the brightness of light emitted from the lighting device and the energy supplied to the lighting device, is at least 110 lumens per watt;

the lighting device emits light having a CRI Ra of at least 75 and the wall plug efficiency of the lighting device, based on the brightness or light emitted from the lighting device and the energy supplied to the lighting device, is at least 120 lumens per watt;

the lighting device emits light having a CRI Ra of at least 80 and the wall plug efficiency of the lighting device, based on the brightness of light emitted from the lighting device and the energy supplied to the lighting device, is at least 25 lumens per watt;

the lighting device emits light having a CRI Ra of at least 80 and the wall plug efficiency of the lighting device, based on the brightness of light emitted from the lighting device and the energy supplied to the lighting device, is at least 35 lumens per watt;

the lighting device emits light having a CRI Ra of at least 80 and the wall plug efficiency of the lighting device, based on the brightness of light emitted from the lighting device and the energy supplied to the lighting device, is at least 50 lumens per watt;

the lighting device emits light having a CRI Ra of at least 80 and the wall plug efficiency of the lighting device, based on the brightness of light emitted from the lighting device and the energy supplied to the lighting device, is at least 60 lumens per watt;

the lighting device emits light having a CRI Ra of at least 80 and the wall plug efficiency of the lighting device, based on the brightness of light emitted from the lighting device and the energy supplied to the lighting device, is at least 70 lumens per watt;

the lighting device emits light having a CRI Ra of at least 80 and the wall plug efficiency of the lighting device, based on the brightness of light emitted from the lighting device and the energy supplied to the lighting device, is at least 80 lumens per watt;

the lighting device emits light having a CRI Ra of at least 80 and the wall plug efficiency of the lighting device, based on the brightness of light emitted from the lighting device and the energy supplied to the lighting device, is at least 90 lumens per watt;

the lighting device emits light having a CRT Ra of at least 80 and the wall plug efficiency of the lighting device, based on the brightness of light emitted from the lighting device and the energy supplied to the lighting device, is at least 100 lumens per watt;

the lighting device emits light having a CRT Ra of at least 80 and the wall plug efficiency of the lighting device, based on the brightness of light emitted from the lighting device and the energy supplied to the lighting device, is at least 110 lumens per watt;

the lighting device emits light having a CRI Ra of at least 80 and the wall plug efficiency of the lighting device, based on the brightness of light emitted from the lighting device and the energy supplied to the lighting device, is at least 120 lumens per watt;

the lighting device emits light having a CRT Ra of at least 85 and the wall plug efficiency of the lighting device, based on the brightness of light emitted from the lighting device and the energy supplied to the lighting device, is at least 25 lumens per watt;

the lighting device emits light having a CRI Ra of at least 85 and the wall plug efficiency of the lighting device, based on the brightness of light emitted from the lighting device and the energy supplied to the lighting device, is at least 35 lumens per watt;

the lighting device emits light having a CRI Ra of at least 85 and the wall plug efficiency of the lighting device, based on the brightness of light emitted from the lighting device and the energy supplied to the lighting device, is at least 50 lumens per watt;

the lighting device emits light having a CRI Ra of at least 85 and the wall plug efficiency of the lighting device, based on the brightness of light emitted from the lighting device and the energy supplied to the lighting device, is at least 60 lumens per watt;

the lighting device emits light having a CRI Ra of at least 85 and the wall plug efficiency of the lighting device, based on the brightness of light emitted from the lighting device and the energy supplied to the lighting device, is at least 70 lumens per watt;

the lighting device emits light having a CRI Ra of at least 85 and the wall plug efficiency of the lighting device, based on the brightness of light emitted from the lighting device and the energy supplied to the lighting device, is at least 80 lumens per watt;

the lighting device emits light having a CRI Ra of at least 85 and the wall plug efficiency of the lighting device, based on the brightness of light emitted from the lighting device and the energy supplied to the lighting device, is at least 90 lumens per watt;

the lighting device emits light having a CRI Ra of at least 85 and the wall plug efficiency of the lighting device, based on the brightness of light emitted from the lighting device and the energy supplied to the lighting device, is at least 100 lumens per watt;

the lighting device emits light having a CRT Ra of at least 85 and the wall plug efficiency of the lighting device, based on the brightness of light emitted from the lighting device and the energy supplied to the lighting device, is at least 110 lumens per watt;

the lighting device emits light having a CRI Ra of at least 85 and the wall plug efficiency of the lighting device, based on the brightness of light emitted from the lighting device and the energy supplied to the lighting device, is at least 120 lumens per watt;

the lighting device emits light having a CRT Ra of at least 90 and the wall plug efficiency of the lighting device, based on the brightness of light emitted from the lighting device and the energy supplied to the lighting device, is at least 25 lumens per watt;

the lighting device emits light having a CRT Ra of at least 90 and the wall plug efficiency of the lighting device, based on the brightness of light emitted from the lighting device and the energy supplied to the lighting device, is at least 35 lumens per watt;

the lighting device emits light having a CRT Ra of at least 90 and the wall plug efficiency of the lighting device, based on the brightness of light emitted from the lighting device and the energy supplied to the lighting device, is at least 50 lumens per watt;

the lighting device emits light having a CRI Ra of at least 90 and the wall plug efficiency of the lighting device, based on the brightness of light emitted from the lighting device and the energy supplied to the lighting device, is at least 60 lumens per watt;

the lighting device emits light having a CRI Ra of at least 90 and the wall plug efficiency of the lighting device, based on the brightness of light emitted from the lighting device and the energy supplied to the lighting device, is at least 70 lumens per watt;

the lighting device emits light having a CRI Ra of at least 90 and the wall plug efficiency of the lighting device, based on the brightness of light emitted from the lighting device and the energy supplied to the lighting device, is at least 80 lumens per watt;

the lighting device emits light having a CRI Ra of at least 90 and the wall plug efficiency of the lighting device, based on the brightness of light emitted from the lighting device and the energy supplied to the lighting device, is at least 90 lumens per watt;

the lighting device emits light having a CRI Ra of at least 90 and the wall plug efficiency of the lighting device, based on the brightness of light emitted from the lighting device and the energy supplied to the lighting device, is at least 100 lumens per watt;

the lighting device emits light having a CRI Ra of at least 90 and the wall plug efficiency of the lighting device, based on the brightness of light emitted from the lighting device and the energy supplied to the lighting device, is at least 110 lumens per watt;

the lighting device emits light having a CRI Ra of at least 90 and the wall plug efficiency of the lighting device, based on the brightness of light emitted from the lighting device and the energy supplied to the lighting device, is at least 120 lumens per watt;

the lighting device emits light having a CRI Ra of at least 95 and the wall plug efficiency of the lighting device, based on the brightness of light emitted from the lighting device and the energy supplied to the lighting device, is at least 25 lumens per watt;

the lighting device emits light having a CRT Ra of at least 95 and the wall plug efficiency of the lighting device, based on the brightness of light emitted from the lighting device and the energy supplied to the lighting device, is at least 35 lumens per watt;

the lighting device emits light having a CRI Ra of at least 95 and the wall plug efficiency of the lighting device, based on the brightness of light emitted from the lighting device and the energy supplied to the lighting device, is at least 50 lumens per watt;

the lighting device emits light having a CRI Ra of at least 95 and the wall plug efficiency of the lighting device, based on the brightness of light emitted from the lighting device and the energy supplied to the lighting device, is at least 60 lumens per watt;

the lighting device emits light having a CRI Ra of at least 95 and the wall plug efficiency of the lighting device, based on the brightness of light emitted from the lighting device and the energy supplied to the lighting device, is at least 70 lumens per watt;

the lighting device emits light having a CRI Ra of at least 95 and the wall plug efficiency of the lighting device, based on the brightness of light emitted from the lighting device and the energy supplied to the lighting device, is at least 80 lumens per watt;

the lighting device emits light having a CRI Ra of at least 95 and the wall plug efficiency of the lighting device, based on the brightness of light emitted from the lighting device and the energy supplied to the lighting device, is at least 90 lumens per watt;

the lighting device emits light having a CRI Ra of at least 95 and the wall plug efficiency of the lighting device, based on the brightness of light emitted from the lighting device and the energy supplied to the lighting device, is at least 100 lumens per watt;

the lighting device emits light having a CRT Ra of at least 95 and the wall plug efficiency of the lighting device, based on the brightness of light emitted from the lighting device and the energy supplied to the lighting device, is at least 110 lumens per watt; or the lighting device emits light having a CRT Ra of at least 95 and the wall plug efficiency of the lighting device, based on the brightness of light emitted from the lighting device and the energy supplied to the lighting device, is at least 120 lumens per watt.

In some embodiments according to the present inventive subject matter, including some embodiments that include or do not include any of the features as discussed herein, the light exiting the lighting device can have any suitable color temperature (or correlated color temperature).

In some embodiments, one or more luminescent materials can be employed in view of the correlated color temperature to which the output light from the lighting device will be targeted, e.g., for output light having a correlated color temperature in the range of from about 2,700 K to about 4,000 K, one might employ a BOSE luminescent material; for output light having a higher correlated color temperature, one might employ a LuAG luminescent material.

In some embodiments, the range of hues with which red light is mixed can be selected based on the correlated color temperature of the desired output light, e.g., for output light having a higher correlated color temperature (e.g., 5,000 K or higher), one might construct a lighting device that emits a mixture of red light and BSG light.

Embodiments in accordance with the present inventive subject matter are described herein in detail in order to provide exact features of representative embodiments that are within the overall scope of the present inventive subject matter. The present inventive subject matter should not be understood to be limited to such detail.

Embodiments in accordance with the present inventive subject matter are also described with reference to cross-sectional (and/or plan view) illustrations that are schematic illustrations of idealized embodiments of the present inventive subject matter. As such, variations from the shapes of the illustrations as a result, for example, of manufacturing techniques and/or tolerances, are to be expected. Thus, embodiments of the present inventive subject matter should not be construed as being limited to the particular shapes of regions illustrated herein but are to include deviations in shapes that result, for example, from manufacturing. For example, a molded region illustrated or described as a rectangle will, typically, have rounded or curved features. Thus, the regions illustrated in the figures are schematic in nature and their shapes are not intended to illustrate the precise shape of a region of a device and are not intended to limit the scope of the present inventive subject matter.

The lighting devices illustrated herein are illustrated with reference to cross-sectional drawings. These cross sections may be rotated around a central axis to provide lighting devices that are circular in nature. Alternatively, the cross sections may be replicated to form sides of a polygon, such as a square, rectangle, pentagon, hexagon or the like, to provide a lighting device. Thus, in some embodiments, objects in a center of the cross-section may be surrounded, either completely or partially, by objects at the edges of the cross-section.

FIG. 1 depicts a first embodiment of a lighting device in accordance with the present inventive subject matter.

Referring to FIG. 1, there is shown a lighting device 10 that includes a heat spreading element 11 (formed of aluminum), electrically insulating regions 12 (comprising any desired material which is thermally conductive and not electrically conductive, a wide variety of which are well-known to those skilled in the art, e.g., ceramic, epoxy or silicone optionally filled with silicon carbide, diamond, cubic boron nitride, alumina, etc), a highly reflective surface 13 (which can be formed in situ by polishing the surface of the aluminum heat spreading element, or made of MCPET® (marketed by Furukawa, a Japanese corporation)), conductive traces 14 formed of copper, lead frames 15 formed of silver-plated copper (or silver-plated mild steel), packaged LEDs 16*a*, 16*b* (described in more detail below), a reflective cone 17 (made of MCPET®) with a diffuse light scattering surface and a diffusing element 18 (the diffusing element 18 performs a light scattering function).

The thickness of the heat spreading element 11 is, in this embodiment, about 3.0 mm.

The reflective cone 17 is, in this embodiment, about 1 mm thick.

The diffusing element 18 is, in this embodiment, about 3.0 mm thick and is made of glass or plastic with surface features.

The device depicted in FIG. 1 further includes a printed circuit board (PCB) 28 with the conductive traces 14. The PCB is about 1.6 mm thick and is FR4.

Figure 2:
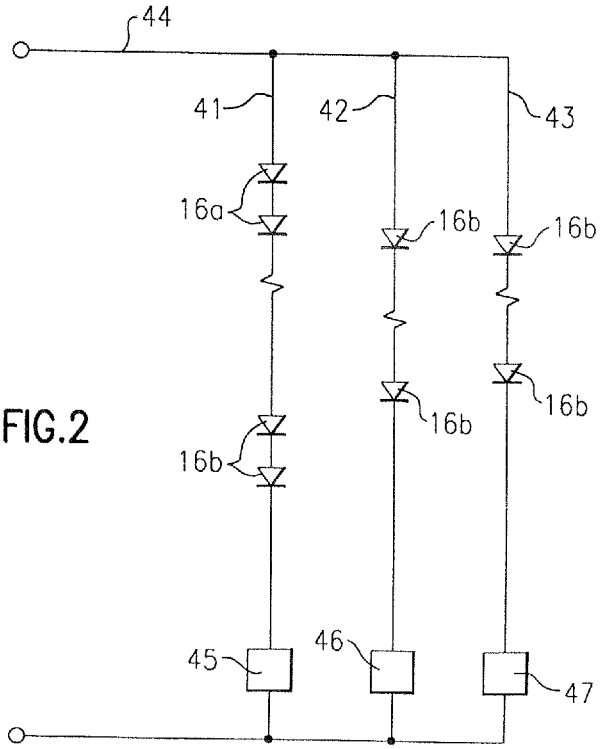
FIG. 2 is a schematic electrical diagram of a portion of the circuitry in the device depicted in FIG. 1

Referring to FIG. 2, which is a schematic electrical diagram of a portion of the circuitry in the device depicted in FIG. 1, the lighting device includes a set of strings comprising a first string 41 of LEDs, a second string 42 of LEDs and a third string 43 of LEDs arranged in parallel with one another, the set of strings being electrically connected in series with a common power line 44.

Figure 3:
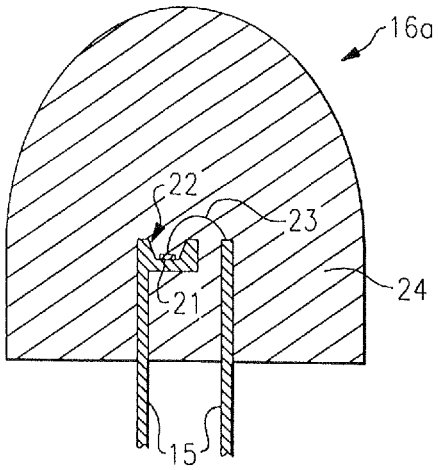
FIG. 3 is a cross-sectional view of a red LED 16*a* in the embodiment depicted in FIG. 1.
Figure 4:
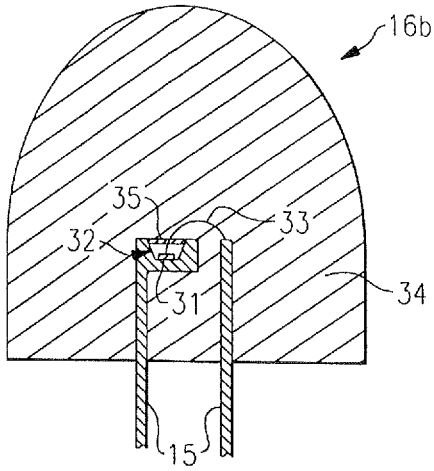
FIG. 4 is a cross-sectional view of a greenish-yellowish emitter 16*b* in the embodiment depicted in FIG. 1.

Connected to the first string 41 of LED emitters are a current regulator 45, forty-seven red LEDs 16*a* (one is shown in more detail in FIG. 3—only two are depicted in FIG. 2), and twenty-one greenish-yellowish emitters 16*b* (each comprising a blue light emitting diode and a broad spectrum emitting luminescent material) (one is shown in more detail in FIG. 4—only two are depicted in FIG. 2).

Connected to the second string 42 of LED emitters are a current regulator 46, zero red LEDs and fifty-one greenish-yellowish emitters 16*b* (only two are depicted in FIG. 2).

Connected to the third string 43 of LED emitters are a current regulator 47, zero red LEDs and fifty-one greenish-yellowish emitters 16*b* (only two are depicted in FIG. 2).

The voltage drop across each of the red LEDs 16*a* is about 2 volts.

The voltage drop across each of the blue LEDs (in the greenish-yellowish emitters 16*b*) is about 3 volts.

The voltage drop across each of the current regulators is about 7 volts.

The current passing through the first string 41 of LED emitters is regulated to be about 20 milliamps.

The current passing through the second string 42 of LED emitters is regulated to be about 20 milliamps.

The current passing through the third string 43 of LED emitters is regulated to be about 20 milliamps.

The diffusing element 18 is located about two inches from the highly reflective surface 13. The diffusing element 18 is attached to a top region of the reflective cone 17. The insulating element 28 is attached to a bottom region of the reflective cone 17.

The heat spreading element 11 serves to spread out the heat, act as a heat sink, and dissipate the heat from the LEDs. Likewise, the reflective cone 17 functions as a heat sink.

Figure 5:
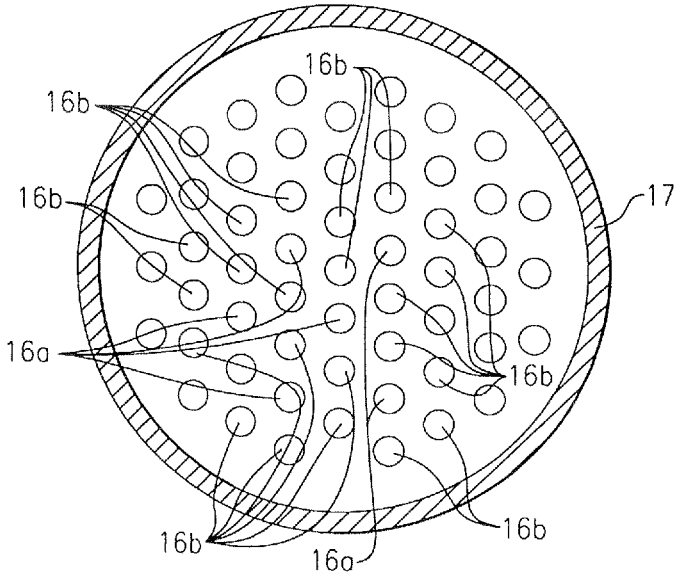
FIG. 5 is a sectional view taken along plane V-V shown in FIG. 1.

FIG. 5 is a sectional view taken along plane V-V shown in FIG. 1.

As shown in FIG. 5, each of the red LEDs 16*a* is surrounded by five or six greenish-yellowish emitters 16*b*, i.e., the red LEDs 16*a* and the greenish-yellowish emitters 16*b* are arranged in generally laterally arranged rows and spaced from one another substantially evenly, each row being laterally offset from the next adjacent (in a longitudinal direction) row by half the distance between laterally adjacent LEDs, with, in most locations, two greenish-yellowish emitters 16*b* being located between each red LED 16*a* and its nearest red LED 16*a* neighbor in the same row, and with the red LEDs 16*a* in each row being offset from the nearest red LED(s) 16*a* in the next adjacent (in a longitudinal direction) row by one and a half times the distance between laterally spaced adjacent LEDs. The spacing between each adjacent LED in each row is about 6 mm.

FIG. 3 is a cross-sectional view of one of the red LEDs 16*a* employed in the embodiment depicted in FIGS. 1 and 5.

Figure 18:
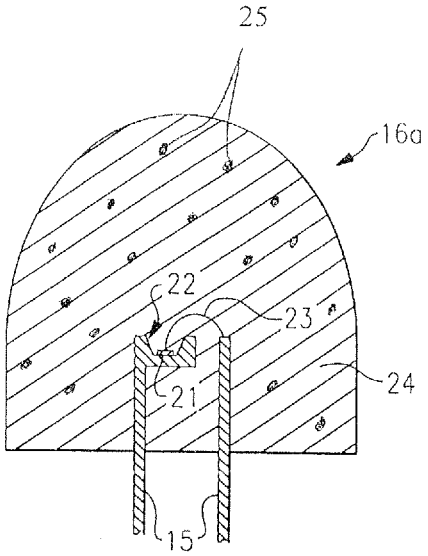
FIG. 18 is a cross-sectional view of an alternative red LED 16*a* in the embodiment depicted in FIG. 1.

Referring to FIG. 3, each of the red LEDs 16*a* includes a red light emitting diode chip 21 (from Epistar in Taiwan, measuring 14 mils×14 mils, comprising AlInGaP and having a brightness of not less than 600 mcd), a lead frame 15 having a reflective surface 22, a copper wire 23, and an encapsulant region 24. The reflective surface 22 is made of silver. The encapsulant region 24 is made of Hysol OS 4000. The red LEDs 16*a* are nearly saturated, i.e., they have a purity of at least 85%, the term "purity" having a well-known meaning to persons skilled in the art, and procedures for calculating purity being well-known to those of skill in the art. The red LEDs 16*a* can emit light having a dominant wavelength in the range of from about 600 nm to about 640 nm (and in some embodiments, from about 615 nm to about 620 nm). FIG. 18 depict an alternative LED 16*a* that is similar to the one depicted in FIG. 3, except that the LED 16*a* in FIG. 18 further comprised luminescent material 25

FIG. 4 is a cross-sectional view of one of the greenish-yellowish emitters 16*b* employed in the embodiment depicted in FIGS. 1 and 5.

Referring to FIG. 4, each of the greenish-yellowish emitters 16*b* includes a blue light emitting diode chip 31 (namely, it can be a Cree XT LED (C460XT290) die with a wavelength range of from about 441 nm to about 448 nm (and in some embodiments, from about 444 nm to about 446 nm), and optical power greater than 24 mW), a lead frame 15 having a reflective surface 32, a copper wire 33, an encapsulant region 34, and a broad spectrum emitting lumiphor 35. The reflective surface 32 is made of silver. The encapsulant region 34 is made of Hysol OS400 or GE/Toshiba Invisil 5332. The lumiphor 35 comprises a luminescent material consisting of QMK58/F-U1 YAG:Ce by Phosphor Teck—UK dispersed in a binder made of Hysol OS400 or GE/Toshiba 5332. The luminescent material is loaded in the binder in an amount in the range of from about 10 to about 12 percent by weight, based on the total weight of the binder and the luminescent material. The luminescent material particles can have particle sizes in the range of from about 1.6 micrometers to about 8.6 micrometers, with the mean particle size being in the range of from about 4 micrometers to about 5 micrometers. The lumiphor 35 is spaced from the chip 31 by a distance in the range of from about 100 micrometers to about 750 micrometers (for example, from about 500 micrometers to about 750 micrometers, e.g., about 750 micrometers).

The combined light exiting the LED 16*b* (i.e., a mixture of (1) light including light emitted by the blue chip 31 which passes through the lumiphor and exits the LED 16*b* and (2) light emitted by the luminescent material upon being excited by light emitted from the blue chip 31 which exits the LED 16*b*), corresponds to a point on the 1931 CIE Chromaticity Diagram having x, y color coordinates which are within one or more of first, second, third, fourth and fifth areas on the 1931 CIE Chromaticity Diagram, the first area enclosed by first, second, third, fourth and fifth line segments, the first line segment connecting a first point to a second point, the second line segment connecting the second point to a third point, the third line segment connecting the third point to a fourth point, the fourth line segment connecting the fourth point to a fifth point, and the fifth line segment connecting the fifth point to the first point, the first point having x, y coordinates of 0.32, 0.40, the second point having x, y coordinates of 0.36, 0.48, the third point having x, y coordinates of 0.43, 0.45, the fourth point having x, y coordinates of 0.42, 0.42, and the fifth point having x, y coordinates of 0.36, 0.38;

the second area enclosed by sixth, seventh, eighth, ninth and tenth line segments, the sixth line segment connecting a sixth point to a seventh point, the seventh line segment connecting the seventh point to a eighth point, the eighth line segment connecting the eighth point to a ninth point, the ninth line segment connecting the ninth point to a tenth point, and the tenth line segment connecting the tenth point to the sixth point, the sixth point having x, y coordinates of 0.29, 0.36, the seventh point having x, y coordinates of 0.32, 0.35, the eighth point having x, y coordinates of 0.41, 0.43, the ninth point having x, y coordinates of 0.44, 0.49, and the tenth point having x, y coordinates of 0.38, 0.53;

the third area enclosed by eleventh, twelfth, thirteenth, fourteenth and fifteenth line segments, the eleventh line segment connecting a eleventh point to a twelfth point, the twelfth line segment connecting the twelfth point to a thirteenth point, the thirteenth line segment connecting the thirteenth point to a fourteenth point, the fourteenth line segment connecting the fourteenth point to a fifteenth point, and the fifteenth line segment connecting the fifteenth point to the eleventh point, the eleventh point having x, y coordinates of 0.35, 0.48, the twelfth point having x, y coordinates of 0.26, 0.50, the thirteenth point having x, y coordinates of 0.13, 0.26, the fourteenth point having x, y coordinates of 0.15, 0.20, and the fifteenth point having x, y coordinates of 0.26, 0.28;

the fourth area enclosed by sixteenth, seventeenth, eighteenth and nineteenth line segments, the sixteenth line segment connecting a sixteenth point to a seventeenth point, the seventeenth line segment connecting the seventeenth point to a eighteenth point, the eighteenth line segment connecting the eighteenth point to a nineteenth point, the nineteenth line segment connecting the nineteenth point to the sixteenth point, the sixteenth point having x, y coordinates of 0.21, 0.28, the seventeenth point having x, y coordinates of 0.26, 0.28, the eighteenth point having x, y coordinates of 0.32, 0.42, and the nineteenth point having x, y coordinates of 0.28, 0.44; and the fifth area enclosed by twentieth, twenty-first, twenty-second and twenty-third line segments, the twentieth line segment connecting a twentieth point to a twenty-first point, the twenty-first line segment connecting a twenty-first point to a twenty-second point, the twenty-second line segment connecting the twenty-second point to a twenty-third point, the twenty-third line segment connecting the twenty-third point to the twentieth point, the twentieth point having x, y coordinates of 0.30, 0.49, the twenty-first point having x, y coordinates of 0.35, 0.48, the twenty-second point having x, y coordinates of 0.32, 0.42, and the twenty-third point having x, y coordinates of 0.28, 0.44.

The combined light exiting the lighting device 10, i.e., a combination of (1) light exiting the lighting device 10 which was emitted by the first group of solid state light emitters 16*b*, (2) light exiting the lighting device 10 which was emitted by the lumiphors 35, and (3) light exiting the lighting device 10 which was emitted by the second group of solid state light emitters 16*a* corresponds to a point on a 1931 CIE Chromaticity Diagram which is within ten MacAdam ellipses of at least one point on the blackbody locus on a 1931 CIE Chromaticity Diagram.

Figure 6:
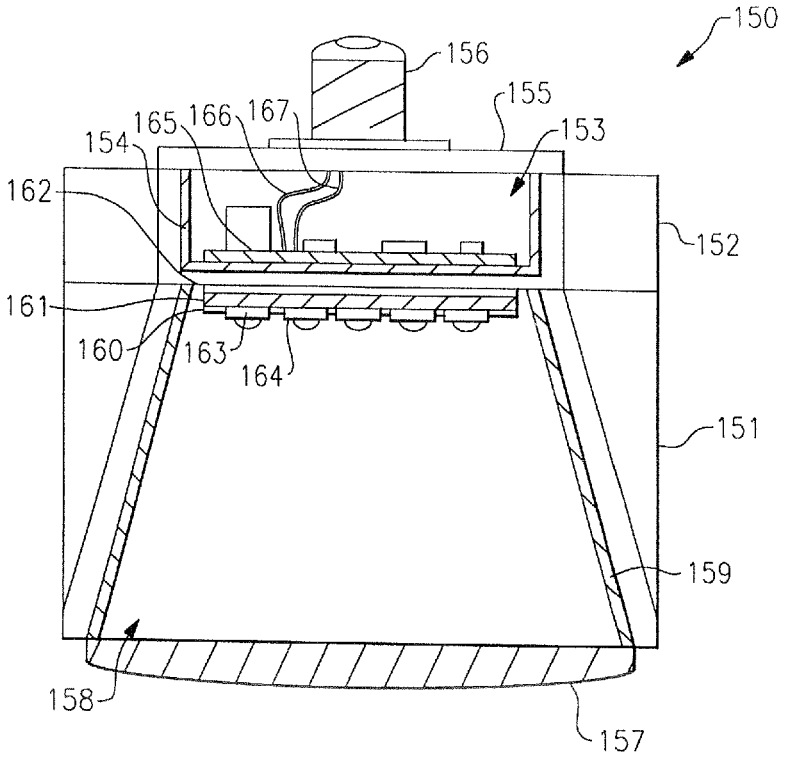
FIG. 6 is a schematic diagram of a high efficiency lamp 150 according to a second embodiment in accordance with the inventive subject matter.

FIG. 6 is a schematic diagram of a high efficiency lamp 150 according to a second embodiment in accordance with the inventive subject matter. The lamp 150 includes a lower housing 151 and an upper housing 152, greenish-yellowish emitters 163 and red light emitting diodes 164. The lower housing 151 is a cast aluminum housing having fins surrounding the circumference and provides sidewalls of the mixing enclosure 158. The lower housing may be a lower housing of an LR6 fixture from Cree, Inc., Durham, N.C., with the trim flange removed such that the housing does not extend past the lens 157. Other suitable lower housing materials having similar thermal properties could also be utilized. The lower housing 151 and the lens 157, in combination, comprise an enclosing structure that surrounds the greenish-yellowish emitters 163 and the red light emitting diodes 164.

The upper housing 152 includes a cavity 153 and also has fins to increase the overall area for heat extraction. In the present embodiment, the upper housing 152 is made from copper. Other suitable upper housing materials having similar thermal properties could also be utilized. For example, the upper housing could be made from aluminum or other thermally conductive material. An electrically insulating layer 154 is provided within the upper housing 152 to isolate the power supply 165 from the upper housing 152. The insulating layer 154 may, for example, be Formex. A thermal gasket (not shown) is provided between the upper housing 152 and the lower housing 151 to assure a good thermal coupling between the two housings. The thermal gasket may, for example, be Sil-Pad from The Bergquist Company.

A top plate 155 is provided on the upper housing 152 and encloses the cavity 153. A connector 156, such as an Edison type screw connector, is provided on the top plate 155 to allow connection of the lamp 150 to a power source, such as an AC line. Other connector types could be utilized and may depend on the power source to which the lamp 150 is to be connected.

A lens 157 is provided on the opening of the lower housing 151 to provide a mixing enclosure 158 having sidewalls defined by the lower housing 151 and opposing ends formed by the upper housing 152 and the lens 157. The mixing enclosure 158 is a frustoconical shape with a height of about 2.15" and with a diameter at one end of 2.91" and of 4.56" at the opposing end. The lens 157 includes optical features on the side facing the light sources that obscures the light sources and mixes the light. The lens used in the present embodiment is a lens that is provided by RPC Photonics, Rochester, N.Y. In general, the lens 157 has a full width, half max (FWHM) of between 50° and 60°, which balances light transmission with diffusion to obscure the light sources.

The mixing enclosure 158 is lined with a highly reflective material 159, such as MCPET® from Furakawa, to reduce losses from light reflected back into the mixing enclosure 158 by the lens. The highly reflective material 159 reflects between 98% and 99% of the light across the visible spectrum. A reflective material 160 is also provided on a copper metal core circuit board 161 and may be provided on any exposed portions of the upper housing 152. The reflective material 160 can also be MCPET®, laser cut to fit around the greenish-yellowish emitters 163 and the red light emitting diodes 164.

The greenish-yellowish emitters 163 emit light which has x, y color coordinates which define a point which is within one or more of the first, second, third, fourth and fifth areas on the 1931 CIE Chromaticity Diagram as described above, and light emitting diodes 164 that emit red light within the range of from about 600 nm to about 640 nm. In this particular embodiment, 21 greenish-yellowish emitters 163 and 11 red light emitting diodes 164 are utilized. The greenish-yellowish emitters 163 are Cree X Lamps from Cree, Inc., Durham, N.C. The red light emitting diodes 164 are OSRAM Golden Dragon parts to which lenses are attached to improve light extraction. In particular, an optical adhesive can be used to attach lenses, such as the lenses from Cree XRE parts, to the Golden Dragons. The brightnesses of the parts are sufficiently high to achieve the desired light output and wall plug efficiency.

The greenish-yellowish emitters 163 and the red light emitting diodes 164 are serially connected in a single string. This provides a high voltage string that allows for increased efficiency in driving the greenish-yellowish emitters 163 and the red light emitting diodes 164. The greenish-yellowish emitters 163 have color points that are close to a line between x,y coordinates of the 1931 CIE diagram of 0.3431, 0.3642; and 0.3625, 0.3979 and light emitting diodes having color points that are close to a line between x,y coordinates of the 1931 CIE diagram of 0.3638, 0.4010; and 0.3844, 0.4400. The greenish-yellowish emitters 163 have outputs that are within the range of from 108.2 lumens to 112.6 lumens at 350 mA. The red light emitting diodes have a dominant emission wavelength in the range of from about 615 nm to about 620 nm.

The greenish-yellowish emitters 163 and the red light emitting diodes 164 are mounted on the circuit board 161 which is mounted with a thermal gasket material 162 to the upper housing 152. A conformal coating (not shown) of HumiSeal 1C49LV is applied to the circuit board 161. The circuit board 161 is connected to the power supply 165 through the upper housing 152.

Figure 7:
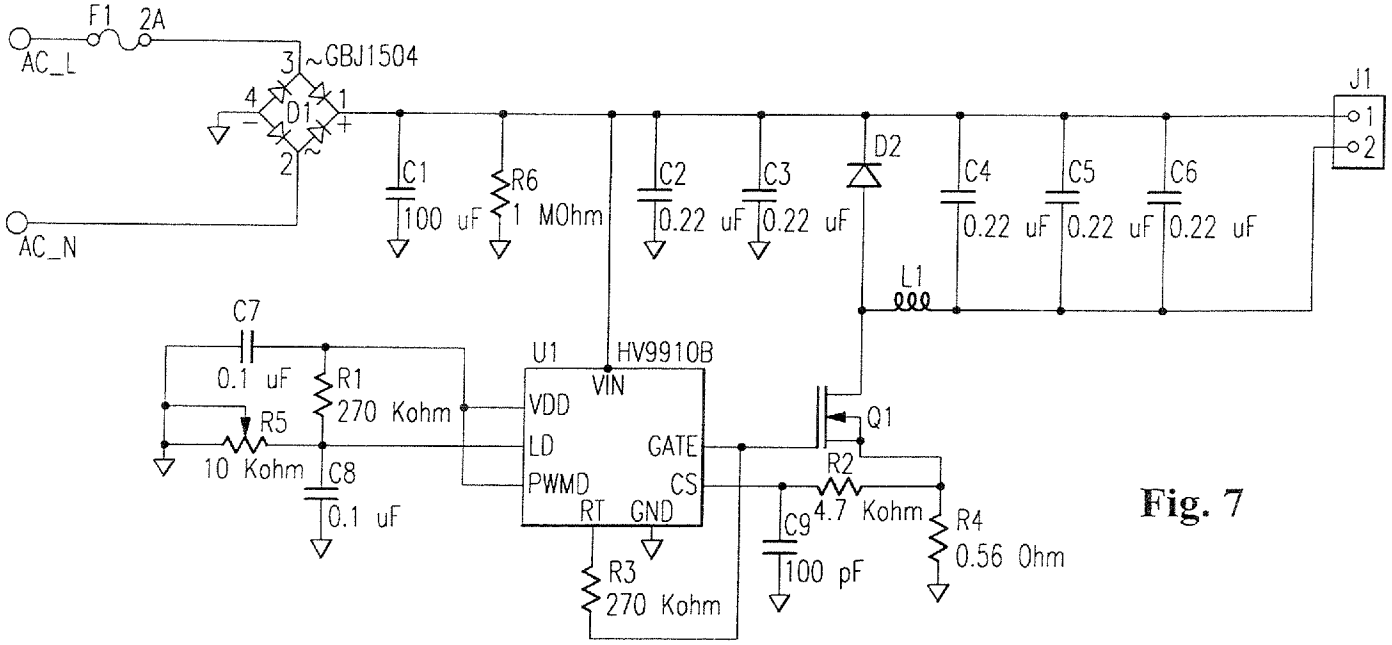
FIG. 7 is a schematic diagram of the power supply 165 shown in FIG. 6.

The power supply 165 is connected to the Edison connector 156 through wires 166 and 167. A schematic of the power supply 165 is provided in FIG. 7. In FIG. 7, the string of greenish-yellowish emitters 163 and light emitting diodes 164 is connected between pins 1 and 2 of J1. With regard to specific parts, the values in the present embodiment are provided in FIG. 7 for the majority of parts. With regard to parts without values, the diode D2 is a MURS140 from Digikey, the inductor L1 is 3.9 mH and the transistor Q1 is an nFET FQP3N30-ND from Digikey. The HV9910B is a universal high brightness light emitting diode driver from Supertex, Inc, Sunnyvale, Calif. The variable resistance R5 is provided to adjust the current through the string connected across J1.

Figure 8:
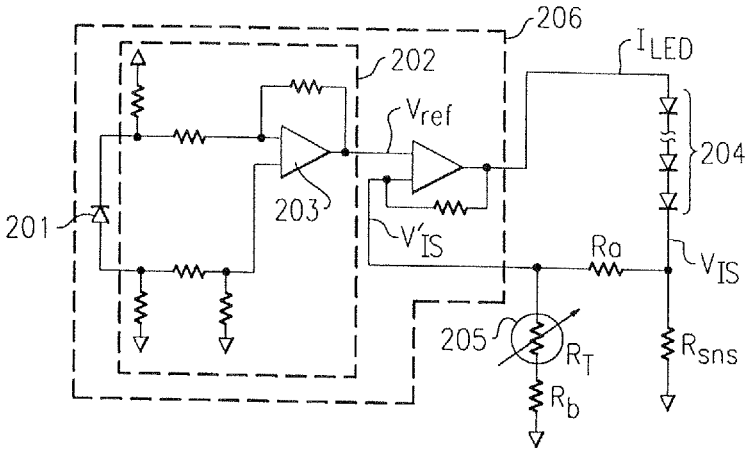
FIGS. 8 and 9 are diagrams of circuitry that can be employed in the methods and devices of the present inventive subject matter.

Another embodiment is depicted in FIG. 8, which is a diagram of a circuit which can be employed in the methods and devices of the present inventive subject matter. The circuit shown in FIG. 8 includes a sensor 201, a differential amplifier circuit 202 (which includes a comparator 203), a plurality of red light emitting diodes 204 and a thermistor 205. Features of this circuit include:

This circuit increases the red light emitting diode current with increasing temperature by altering the light emitting diode sense signal as seen by the controlling element.

Figure 9:
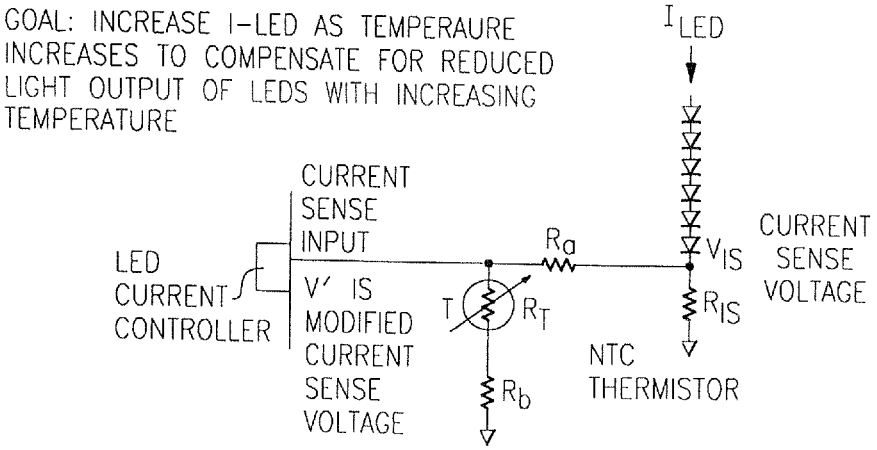

In normal operation, the controller 206 will maintain constant current by adjusting the light emitting diode current to maintain a constant voltage as seen at the current sense input (see FIG. 9). A) if $I_{LED}$ increases, $V'_{IS}$ increases, and the controller 206 will reduce current in response. B) If $I_{LED}$ decreases, $V'_{IS}$ decreases, and the controller 206 will increase current in response.

A voltage divider circuit consisting of $R_a$, $R_b$ and $R_T$ modifies the signal to the current sense input.

a) $V'_{IS}=V_{IS}\times(R_T+R_b)/(R_a+R_b+R_T)$ b) As the temperature at $R_T$ increases, voltage $V'_{IS}$ decreases, and the controller 206 will increase $I_{LED}$ in response.

c) As the temperature at $R_T$ decreases, voltage $V'_{IS}$ increases, and the controller 206 decreases $I_{LED}$ in response.

In another representative example, there is provided a lighting device that comprises a first group of solid state light emitters that emit light having a dominant wavelength of about 443 nm, a second group of solid state light emitters that emit light having a dominant wavelength in the range of from about 555 nm to about 585 nm, and a third group of solid state light emitters that emit light having a dominant wavelength of about 609 nm. The hue of the combined light from the first and second groups of solid state light emitters corresponds to a point on the 1931 CIE Chromaticity Diagram having x, y color coordinates which are within one or more of the first, second, third, fourth and fifth areas on the 1931 CIE Chromaticity Diagram described above. The hue of the combined light from the first, second and third groups of solid state light emitters corresponds to a point on a 1931 CIE Chromaticity Diagram which is within ten MacAdam ellipses of at least one point on the blackbody locus on a 1931 CIE Chromaticity Diagram, has a color temperature (or a correlated color temperature) of about 2700 K, and has a CRI of less than 90, e.g., about 80.

In another representative example, there is provided a lighting device that comprises a first group of solid state light emitters that emit light having a dominant wavelength of about 444 nm, a second group of solid state light emitters that emit light having a dominant wavelength in the range of from about 555 nm to about 585 nm, and a third group of solid state light emitters that emit light having a dominant wavelength of about 606 nm. The hue of the combined light from the first and second groups of solid state light emitters corresponds to a point on the 1931 CIE Chromaticity Diagram having x, y color coordinates which are within one or more of the first, second, third, fourth and fifth areas on the 1931 CIE Chromaticity Diagram described above. The hue of the combined light from the first, second and third groups of solid state light emitters corresponds to a point on a 1931 CIE Chromaticity Diagram which is within ten MacAdam ellipses of at least one point on the blackbody locus on a 1931 CIE Chromaticity Diagram, has a color temperature (or a correlated color temperature) of about 3000 K, and has a CRI of less than 90, e.g., about 80.

In another representative example, there is provided a lighting device that comprises a first group of solid state light emitters that emit light having a dominant wavelength of about 450 nm, a second group of solid state light emitters that emit light having a dominant wavelength in the range of from about 555 nm to about 585 nm, and a third group of solid state light emitters that emit light having a dominant wavelength of about 605 nm. The hue of the combined light from the first and second groups of solid state light emitters corresponds to a point on the 1931 CIE Chromaticity Diagram having x, y color coordinates which are within one or more of the first, second, third, fourth and fifth areas on the 1931 CIE Chromaticity Diagram described above. The hue of the combined light from the first, second and third groups of solid state light emitters corresponds to a point on a 1931 CIE Chromaticity Diagram which is within ten MacAdam ellipses of at least one point on the blackbody locus on a 1931 CIE Chromaticity Diagram, has a color temperature (or a correlated color temperature) of about 3500 K, and has a CRI of less than 90, e.g., about 80.

In another representative example, there is provided a lighting device that comprises a first group of solid state light emitters that emit light having a dominant wavelength of about 451 nm, a second group of solid state light emitters that emit light having a dominant wavelength in the range of from about 555 nm to about 585 nm, and a third group of solid state light emitters that emit light having a dominant wavelength of about 603 nm. The hue of the combined light from the first and second groups of solid state light emitters corresponds to a point on the 1931 CIE Chromaticity Diagram having x, y color coordinates which are within one or more of the first, second, third, fourth and fifth areas on the 1931 CIE Chromaticity Diagram described above. The hue of the combined light from the first, second and third groups of solid state light emitters corresponds to a point on a 1931 CIE Chromaticity Diagram which is within ten MacAdam ellipses of at least one point on the blackbody locus on a 1931 CIE Chromaticity Diagram, has a color temperature (or a correlated color temperature) of about 4000 K, and has a CRI of less than 90, e.g., about 80.

Below are a series of numbered passages, each of which defines subject matter within the scope of the present inventive subject matter:

Passage 1. A lighting device comprising:

a first group of solid state light emitters, the first group of solid state light emitters including at least one solid state light emitter; and a second group of solid state light emitters, the second group of solid state light emitters including at least one solid state light emitter, the first group of solid state light emitters, if illuminated, emits light having a dominant wavelength in the range of from about 441 nm to about 448 nm;

the second group of solid state light emitters, if illuminated, emits light having a dominant wavelength in the range of from about 555 nm to about 585 nm;

if the first group of solid state light emitters is illuminated and the second group of solid state light emitters is illuminated, a mixture of (1) light exiting the lighting device that was emitted from the first group of solid state light emitters and (2) light exiting the lighting device that was emitted from the second group of solid state light emitters would, in the absence of any additional light, have a first group-second group mixed illumination having x, y color coordinates which define a point which is within one or more of first, second, third, fourth and fifth areas on the 1931 CIE Chromaticity Diagram, the first area enclosed by first, second, third, fourth and fifth line segments, the first line segment connecting a first point to a second point, the second line segment connecting the second point to a third point, the third line segment connecting the third point to a fourth point, the fourth line segment connecting the fourth point to a fifth point, and the fifth line segment connecting the fifth point to the first point, the first point having x, y coordinates of 0.32, 0.40, the second point having x, y coordinates of 0.36, 0.48, the third point having x, y coordinates of 0.43, 0.45, the fourth point having x, y coordinates of 0.42, 0.42, and the fifth point having x, y coordinates of 0.36, 0.38;

the second area enclosed by sixth, seventh, eighth, ninth and tenth line segments, the sixth line segment connecting a sixth point to a seventh point, the seventh line segment connecting the seventh point to a eighth point, the eighth line segment connecting the eighth point to a ninth point, the ninth line segment connecting the ninth point to a tenth point, and the tenth line segment connecting the tenth point to the sixth point, the sixth point having x, y coordinates of 0.29, 0.36, the seventh point having x, y coordinates of 0.32, 0.35, the eighth point having x, y coordinates of 0.41, 0.43, the ninth point having x, y coordinates of 0.44, 0.49, and the tenth point having x, y coordinates of 0.38, 0.53;

the third area enclosed by eleventh, twelfth, thirteenth, fourteenth and fifteenth line segments, the eleventh line segment connecting a eleventh point to a twelfth point, the twelfth line segment connecting the twelfth point to a thirteenth point, the thirteenth line segment connecting the thirteenth point to a fourteenth point, the fourteenth line segment connecting the fourteenth point to a fifteenth point, and the fifteenth line segment connecting the fifteenth point to the eleventh point, the eleventh point having x, y coordinates of 0.35, 0.48, the twelfth point having x, y coordinates of 0.26, 0.50, the thirteenth point having x, y coordinates of 0.13, 0.26, the fourteenth point having x, y coordinates of 0.15, 0.20, and the fifteenth point having x, y coordinates of 0.26, 0.28;

the fourth area enclosed by sixteenth, seventeenth, eighteenth and nineteenth line segments, the sixteenth line segment connecting a sixteenth point to a seventeenth point, the seventeenth line segment connecting the seventeenth point to a eighteenth point, the eighteenth line segment connecting the eighteenth point to a nineteenth point, the nineteenth line segment connecting the nineteenth point to the sixteenth point, the sixteenth point having x, y coordinates of 0.21, 0.28, the seventeenth point having x, y coordinates of 0.26, 0.28, the eighteenth point having x, y coordinates of 0.32, 0.42, and the nineteenth point having x, y coordinates of 0.28, 0.44; and the fifth area enclosed by twentieth, twenty-first, twenty-second and twenty-third line segments, the twentieth line segment connecting a twentieth point to a twenty-first point, the twenty-first line segment connecting a twenty-first point to a twenty-second point, the twenty-second line segment connecting the twenty-second point to a twenty-third point, the twenty-third line segment connecting the twenty-third point to the twentieth point, the twentieth point having x, y coordinates of 0.30, 0.49, the twenty-first point having x, y coordinates of 0.35, 0.48, the twenty-second point having x, y coordinates of 0.32, 0.42, and the twenty-third point having x, y coordinates of 0.28, 0.44.

Passage 2. A lighting device as recited in passage 1, wherein the first group of solid state light emitters comprises one or more light emitting diodes.

Passage 3. A lighting device as recited in passage 1, wherein the second group of solid state light emitters comprises at least a first luminescent material.

Passage 4. A lighting device as recited in passage 1, wherein:

the first group of solid state light emitters comprises one or more light emitting diodes, the second group of solid state light emitters comprises at least a first luminescent material, and at least one of the light emitting diodes from the first group of solid state light emitters is embedded within an encapsulant element in which at least some of the first luminescent material is also embedded.

Passage 5. A lighting device as recited in passage 1, wherein the first group of solid state light emitters, if illuminated, emits light having a dominant wavelength in the range of from about 444 nm to about 446 nm.

Passage 6. A lighting device as recited in passage 1, wherein:

the lighting device further comprises a third group of solid state light emitters, the third group of solid state light emitters includes at least one solid state light emitter, and the third group of solid state light emitters, if illuminated, emits light having a dominant wavelength in the range of from about 600 nm to about 640 nm.

Passage 7. A lighting device as recited in passage 1, wherein:

the lighting device further comprises a third group of solid state light emitters, the third group of solid state light emitters includes at least one solid state light emitter, and the third group of solid state light emitters, if illuminated, emits light having a dominant wavelength in the range of from about 615 nm to about 620 nm, Passage 8. A lighting device as recited in passage 6, wherein the third group of solid state light emitters comprises one or more light emitting diodes.

Passage 9. A lighting device as recited in passage 6, wherein the third group of solid state light emitters comprises at least a second luminescent material.

Passage 10. A lighting device as recited in passage 6, wherein if the first group of solid state light emitters is illuminated, the second group of solid state light emitters and the third group of solid state light emitters is illuminated, a mixture of (1) light exiting the lighting device which was emitted by the first group of solid state light emitters, (2) light exiting the lighting device which was emitted by the second group of solid state light emitters, and (3) light exiting the lighting device which was emitted by the third group of solid state light emitters would, in an absence of any additional light, produce a first group-second group-third group mixed illumination having x, y coordinates on a 1931 CIE Chromaticity Diagram which define a point which is within ten MacAdam ellipses of at least one point on the blackbody locus on a 1931 CIE Chromaticity Diagram.

Passage 11. A lighting device as recited in passage 6, wherein if electricity is supplied to the lighting device:

the lighting device emits light having a CRI Ra of at least 70, and the wall plug efficiency of the lighting device, based on the brightness of light emitted from the lighting device and the energy supplied to the lighting device, is at least 25 lumens per watt.

Passage 12. A lighting device as recited in passage 1, wherein:

the first group of solid state light emitters comprises one or more light emitting diodes, the second group of solid state light emitters comprises at least a first luminescent material, and if all of the light emitting diodes in the first group of solid state light emitters are illuminated, at least some of the first luminescent material in the second group of solid state light emitters would be excited by light emitted from the first group of solid state light emitters.

Passage 13. A lighting device comprising:

a first group of solid state light emitters, the first group of solid state light emitters including at least one solid state light emitter;

a second group of solid state light emitters, the second group of solid state light emitters including at least one solid state light emitter; and at least a first power line, the first group of solid state light emitters, if illuminated, emits light having a dominant wavelength in the range of from about 441 nm to about 448 nm;

the second group of solid state light emitters, if illuminated, emits light having a dominant wavelength in the range of from about 555 nm to about 585 nm;

if electricity is supplied to the first power line, a mixture of (1) light exiting the lighting device that was emitted from the first group of solid state light emitters and (2) light exiting the lighting device that was emitted from the second group of solid state light emitters would, in the absence of any additional light, have a first group-second group mixed illumination having x, y color coordinates which define a point which is within one or more of first, second, third, fourth and fifth areas on the 1931 CIE Chromaticity Diagram, the first area enclosed by first, second, third, fourth and fifth line segments, the first line segment connecting a first point to a second point, the second line segment connecting the second point to a third point, the third line segment connecting the third point to a fourth point, the fourth line segment connecting the fourth point to a fifth point, and the fifth line segment connecting the fifth point to the first point, the first point having x, y coordinates of 0.32, 0.40, the second point having x, y coordinates of 0.36, 0.48, the third point having x, y coordinates of 0.43, 0.45, the fourth point having x, y coordinates of 0.42, 0.42, and the fifth point having x, y coordinates of 0.36, 0.38;

the second area enclosed by sixth, seventh, eighth, ninth and tenth line segments, the sixth line segment connecting a sixth point to a seventh point, the seventh line segment connecting the seventh point to a eighth point, the eighth line segment connecting the eighth point to a ninth point, the ninth line segment connecting the ninth point to a tenth point, and the tenth line segment connecting the tenth point to the sixth point, the sixth point having x, y coordinates of 0.29, 0.36, the seventh point having x, y coordinates of 0.32, 0.35, the eighth point having x, y coordinates of 0.41, 0.43, the ninth point having x, y coordinates of 0.44, 0.49, and the tenth point having x, y coordinates of 0.38, 0.53;

the third area enclosed by eleventh, twelfth, thirteenth, fourteenth and fifteenth line segments, the eleventh line segment connecting a eleventh point to a twelfth point, the twelfth line segment connecting the twelfth point to a thirteenth point, the thirteenth line segment connecting the thirteenth point to a fourteenth point, the fourteenth line segment connecting the fourteenth point to a fifteenth point, and the fifteenth line segment connecting the fifteenth point to the eleventh point, the eleventh point having x, y coordinates of 0.35, 0.48, the twelfth point having x, y coordinates of 0.26, 0.50, the thirteenth point having x, y coordinates of 0.13, 0.26, the fourteenth point having x, y coordinates of 0.15, 0.20, and the fifteenth point having x, y coordinates of 0.26, 0.28;

the fourth area enclosed by sixteenth, seventeenth, eighteenth and nineteenth line segments, the sixteenth line segment connecting a sixteenth point to a seventeenth point, the seventeenth line segment connecting the seventeenth point to a eighteenth point, the eighteenth line segment connecting the eighteenth point to a nineteenth point, the nineteenth line segment connecting the nineteenth point to the sixteenth point, the sixteenth point having x, y coordinates of 0.21, 0.28, the seventeenth point having x, y coordinates of 0.26, 0.28, the eighteenth point having x, y coordinates of 0.32, 0.42, and the nineteenth point having x, y coordinates of 0.28, 0.44; and the fifth area enclosed by twentieth, twenty-first, twenty-second and twenty-third line segments, the twentieth line segment connecting a twentieth point to a twenty-first point, the twenty-first line segment connecting a twenty-first point to a twenty-second point, the twenty-second line segment connecting the twenty-second point to a twenty-third point, the twenty-third line segment connecting the twenty-third point to the twentieth point, the twentieth point having x, y coordinates of 0.30, 0.49, the twenty-first point having x, y coordinates of 0.35, 0.48, the twenty-second point having x, y coordinates of 0.32, 0.42, and the twenty-third point having x, y coordinates of 0.44.

Passage 14. A lighting device as recited in passage 13, wherein the first group of solid state light emitters comprises one or more light emitting diodes.

Passage 15. A lighting device as recited in passage 13, wherein the second group of solid state light emitters comprises at least a first luminescent material.

Passage 16. A lighting device as recited in passage 13, wherein:

the lighting device further comprises a third group of solid state light emitters, the third group of solid state light emitters includes at least one solid state light emitter, and the third group of solid state light emitters, if illuminated, emits light having a dominant wavelength in the range of from about 600 nm to about 640 nm.

Passage 17. A lighting device as recited in passage 16, wherein the third group of solid state light emitters comprises one or more light emitting diodes.

Passage 18. A lighting device as recited in passage 16, wherein the third group of solid state light emitters comprises at least a second luminescent material.

Passage 19. A lighting device as recited in passage 16, wherein if the first group of solid state light emitters is illuminated, the second group of solid state light emitters and the third group of solid state light emitters is illuminated, a mixture of (1) light exiting the lighting device which was emitted by the first group of solid state light emitters, (2) light exiting the lighting device which was emitted by the second group of solid state light emitters, and (3) light exiting the lighting device which was emitted by the third group of solid state light emitters would, in an absence of any additional light, produce a first group-second group-third group mixed illumination having x, y coordinates on a 1931 CIE Chromaticity Diagram which define a point which is within ten MacAdam ellipses of at least one point on the blackbody locus on a 1931 CIE Chromaticity Diagram.

Passage 20. A lighting device as recited in passage 16, wherein if electricity is supplied to the lighting device:

the lighting device emits light having a CRI Ra of at least 75, and the wall plug efficiency of the lighting device, based on the brightness of light emitted from the lighting device and the energy supplied to the lighting device, is at least 25 lumens per watt.

Passage 21. A lighting device as recited in passage 13, wherein:

the first group of solid state light emitters comprises one or more light emitting diodes, the second group of solid state light emitters comprises at least a first luminescent material, and if all of the light emitting diodes in the first group of solid state light emitters are illuminated, at least some of the first luminescent material in the second group of solid state light emitters would be excited by light emitted from the first group of solid state light emitters.

Passage 22. A lighting device as recited in passage 13, wherein each of the first group of solid state light emitters is electrically connected to the first power line.

Passage 23. A method of lighting comprising:

illuminating a first group of solid state light emitters, the first group of solid state light emitters including at least one solid state light emitter, such that the first group of solid state light emitters emits light having a dominant wavelength in the range of from about 441 nm to about 448 nm; and illuminating a second group of solid state light emitters, the second group of solid state light emitters including at least one solid state light emitter, such that the second group of solid state light emitters emits light having a dominant wavelength in the range of from about 555 nm to about 585 nm, the first group of solid state light emitters and the second group of solid state light emitters in a lighting device, a mixture of (1) light exiting the lighting device that was emitted from the first group of solid state light emitters and (2) light exiting the lighting device that was emitted from the second group of solid state light emitters would, in the absence of any additional light, have a first group-second group mixed illumination having x, y color coordinates which define a point which is within one or more of first, second, third, fourth and fifth areas on the 1931 CIE Chromaticity Diagram, the first area enclosed by first, second, third, fourth and fifth line segments, the first line segment connecting a first point to a second point, the second line segment connecting the second point to a third point, the third line segment connecting the third point to a fourth point, the fourth line segment connecting the fourth point to a fifth point, and the fifth line segment connecting the fifth point to the first point, the first point having x, y coordinates of 0.32, 0.40, the second point having x, y coordinates of 0.36, 0.48, the third point having x, y coordinates of 0.43, 0.45, the fourth point having x, y coordinates of 0.42, 0.42, and the fifth point having x, y coordinates of 0.36, 0.38;

the second area enclosed by sixth, seventh, eighth, ninth and tenth line segments, the sixth line segment connecting a sixth point to a seventh point, the seventh line segment connecting the seventh point to a eighth point, the eighth line segment connecting the eighth point to a ninth point, the ninth line segment connecting the ninth point to a tenth point, and the tenth line segment connecting the tenth point to the sixth point, the sixth point having x, y coordinates of 0.29, 0.36, the seventh point having x, y coordinates of 0.32, 035, the eighth point having x, y coordinates of 0.41, 0.43, the ninth point having x, y coordinates of 0.44, 0.49, and the tenth point having x, y coordinates of 0.38, 0.53;

the third area enclosed by eleventh, twelfth, thirteenth, fourteenth and fifteenth line segments, the eleventh line segment connecting a eleventh point to a twelfth point, the twelfth line segment connecting the twelfth point to a thirteenth point, the thirteenth line segment connecting the thirteenth point to a fourteenth point, the fourteenth line segment connecting the fourteenth point to a fifteenth point, and the fifteenth line segment connecting the fifteenth point to the eleventh point, the eleventh point having x, y coordinates of 0.35, 0.48, the twelfth point having x, y coordinates of 0.26, 0.50, the thirteenth point having x, y coordinates of 0.13, 0.26, the fourteenth point having x, y coordinates of 0.15, 0.20, and the fifteenth point having x, y coordinates of 0.26, 0.28;

the fourth area enclosed by sixteenth, seventeenth, eighteenth and nineteenth line segments, the sixteenth line segment connecting a sixteenth point to a seventeenth point, the seventeenth line segment connecting the seventeenth point to a eighteenth point, the eighteenth line segment connecting the eighteenth point to a nineteenth point, the nineteenth line segment connecting the nineteenth point to the sixteenth point, the sixteenth point having x, y coordinates of 0.21, 0.28, the seventeenth point having x, y coordinates of 0.26, 0.28, the eighteenth point having x, y coordinates of 0.32, 0.42, and the nineteenth point having x, y coordinates of 0.28, 0.44; and the fifth area enclosed by twentieth, twenty-first, twenty-second and twenty-third line segments, the twentieth line segment connecting a twentieth point to a twenty-first point, the twenty-first line segment connecting a twenty-first point to a twenty-second point, the twenty-second line segment connecting the twenty-second point to a twenty-third point, the twenty-third line segment connecting the twenty-third point to the twentieth point, the twentieth point having x, y coordinates of 0.30, 0.49, the twenty-first point having x, y coordinates of 0.35, 0.48, the twenty-second point having x, y coordinates of 0.32, 0.42, and the twenty-third point having x, y coordinates of 0.28, 0.44.

Passage 24. A method as recited in passage 23, wherein the first group of solid state light emitters comprises one or more light emitting diodes.

Passage 25. A method as recited in passage 23, wherein the second group of solid state light emitters comprises at least a first luminescent material.

Passage 26. A method as recited in passage 23, wherein:

the method further comprises illuminating a third group of solid state light emitters, the third group of solid state light emitters includes at least one solid state light emitter, such that the third group of solid state light emitters emits light having a dominant wavelength in the range of from about 600 nm to about 640 nm.

Passage 27. A method as recited in passage 26, wherein a mixture of (1) light exiting the lighting device that was emitted from the first group of solid state light emitters, (2) light exiting the lighting device that was emitted from the second group of solid state light emitters and (3) light exiting the lighting device that was emitted from the third group of solid state light emitters would, in the absence of any additional light, produce a first group-second group-third group mixed illumination having x, y coordinates on a 1931 CIE Chromaticity Diagram which define a point which is within ten MacAdam ellipses of at least one point on the blackbody locus on a 1931 CIE Chromaticity Diagram.

Passage 28. A method as recited in passage 26, wherein:

the lighting device emits light having a CRI Ra of at least 70, and the wall plug efficiency of the lighting device, based on the brightness of light emitted from the lighting device and the energy supplied to the lighting device, is at least 25 lumens per watt.

Passage 29. A method as recited in passage 23, wherein:

the first group of solid state light emitters comprises one or more light emitting diodes, the second group of solid state light emitters comprises at least a first luminescent material, and at least some of the first luminescent material in the second group of solid state light emitters is excited by light emitted from the first group of solid state light emitters.

Passage 30. A method as recited in passage 23, wherein:

the first group of solid state light emitters are electrically connected to a first power line; and the first group of solid state light emitters are illuminated by supplying current to the first power line.

Passage 31. A lighting device comprising:

a first group of solid state light emitters, the first group of solid state light emitters including at least one solid state light emitter; and a second group of solid state light emitters, the second group of solid state light emitters including at least one solid state light emitter, the first group of solid state light emitters, if illuminated, emits light having a dominant wavelength in the range of from about 442 nm to about 450 nm;

the second group of solid state light emitters, if illuminated, emits light having a dominant wavelength in the range of from about 555 nm to about 585 nm;

if the first group of solid state light emitters is illuminated and the second group of solid state light emitters is illuminated, a mixture of (1) light exiting the lighting device that was emitted from the first group of solid state light emitters and (2) light exiting the lighting device that was emitted from the second group of solid state light emitters would, in the absence of any additional light, have a first group-second group mixed illumination having x, y color coordinates which define a point which is within one or more of first, second, third, fourth and fifth areas on the 1931 CIE Chromaticity Diagram, the first area enclosed by first, second, third, fourth and fifth line segments, the first line segment connecting a first point to a second point, the second line segment connecting the second point to a third point, the third line segment connecting the third point to a fourth point, the fourth line segment connecting the fourth point to a fifth point, and the fifth line segment connecting the fifth point to the first point, the first point having x, y coordinates of 0.32, 0.40, the second point having x, y coordinates of 0.36, 0.48, the third point having x, y coordinates of 0.43, 0.45, the fourth point having x, y coordinates of 0.42, 0.42, and the fifth point having x, y coordinates of 0.36, 0.38;

the second area enclosed by sixth, seventh, eighth, ninth and tenth line segments, the sixth line segment connecting a sixth point to a seventh point, the seventh line segment connecting the seventh point to a eighth point, the eighth line segment connecting the eighth point to a ninth point, the ninth line segment connecting the ninth point to a tenth point, and the tenth line segment connecting the tenth point to the sixth point, the sixth point having x, y coordinates of 0.29, 0.36, the seventh point having x, y coordinates of 0.32, 0.35, the eighth point having x, y coordinates of 0.41, 0.43, the ninth point having x, y coordinates of 0.44, 0.49, and the tenth point having x, y coordinates of 0.38, 0.53;

the third area enclosed by eleventh, twelfth, thirteenth, fourteenth and fifteenth line segments, the eleventh line segment connecting a eleventh point to a twelfth point, the twelfth line segment connecting the twelfth point to a thirteenth point, the thirteenth line segment connecting the thirteenth point to a fourteenth point, the fourteenth line segment connecting the fourteenth point to a fifteenth point, and the fifteenth line segment connecting the fifteenth point to the eleventh point, the eleventh point having x, y coordinates of 0.35, 0.48, the twelfth point having x, y coordinates of 0.26, 0.50, the thirteenth point having x, y coordinates of 0.13, 0.26, the fourteenth point having x, y coordinates of 0.15, 0.20, and the fifteenth point having x, y coordinates of 0.26, 0.28;

the fourth area enclosed by sixteenth, seventeenth, eighteenth and nineteenth line segments, the sixteenth line segment connecting a sixteenth point to a seventeenth point, the seventeenth line segment connecting the seventeenth point to a eighteenth point, the eighteenth line segment connecting the eighteenth point to a nineteenth point, the nineteenth line segment connecting the nineteenth point to the sixteenth point, the sixteenth point having x, y coordinates of 0.21, 0.28, the seventeenth point having x, y coordinates of 0.26, 0.28, the eighteenth point having x, y coordinates of 0.32, 0.42, and the nineteenth point having x, y coordinates of 0.28, 0.44; and the fifth area enclosed by twentieth, twenty-first, twenty-second and twenty-third line segments, the twentieth line segment connecting a twentieth point to a twenty-first point, the twenty-first line segment connecting a twenty-first point to a twenty-second point, the twenty-second line segment connecting the twenty-second point to a twenty-third point, the twenty-third line segment connecting the twenty-third point to the twentieth point, the twentieth point having x, y coordinates of 0.30, 0.49, the twenty-first point having x, y coordinates of 0.35, 0.48, the twenty-second point having x, y coordinates of 0.32, 0.42, and the twenty-third point having x, y coordinates of 0.28, 0.44.

Passage 32. A lighting device as recited in passage 31, wherein the first group of solid state light emitters comprises one or more light emitting diodes.

Passage 33. A lighting device as recited in passage 31, wherein the second group of solid state light emitters comprises at least a first luminescent material.

Passage 34. A lighting device as recited in passage 31, wherein the first group of solid state light emitters, if illuminated, emits light having a dominant wavelength in the range of from about 442 nm to about 445 nm.

Passage 35. A lighting device as recited in passage 31, wherein:

the lighting device further comprises a third group of solid state light emitters, the third group of solid state light emitters includes at least one solid state light emitter, and the third group of solid state light emitters, if illuminated, emits light having a dominant wavelength in the range of from about 605 nm to about 610 nm.

Passage 36. A lighting device as recited in passage 35, wherein if the first group of solid state light emitters is illuminated, the second group of solid state light emitters and the third group of solid state light emitters is illuminated, a mixture of (1) light exiting the lighting device which was emitted by the first group of solid state light emitters, (2) light exiting the lighting device which was emitted by the second group of solid state light emitters, and (3) light exiting the lighting device which was emitted by the third group of solid state light emitters would, in an absence of any additional light, produce a first group-second group-third group mixed illumination having x, y coordinates on a 1931 CIE Chromaticity Diagram which define a point which is within ten MacAdam ellipses of at least one point on the blackbody locus on a 1931 CIE Chromaticity Diagram.

Passage 37. A lighting device as recited in passage 35, wherein if electricity is supplied to the lighting device:

the lighting device emits light having a CRI Ra of at least 70, and the wall plug efficiency of the lighting device, based on the brightness of light emitted from the lighting device and the energy supplied to the lighting device, is at least 25 lumens per watt.

Passage 38. A lighting device as recited in passage 31, wherein:

the lighting device further comprises a third group of solid state light emitters, the third group of solid state light emitters includes at least one solid state light emitter, and the third group of solid state light emitters, if illuminated, emits light having a dominant wavelength in the range of from about 605 nm to about 607 nm.

Passage 39. A lighting device as recited in passage 35, wherein if the first group of solid state light emitters is illuminated, the second group of solid state light emitters and the third group of solid state light emitters is illuminated, a mixture of (1) light exiting the lighting device which was emitted by the first group of solid state light emitters, (2) light exiting the lighting device which was emitted by the second group of solid state light emitters, and (3) light exiting the lighting device which was emitted by the third group of solid state light emitters would have a color temperature of not greater than 3000 K.

Passage 40. A lighting device comprising:

a first group of solid state light emitters, the first group of solid state light emitters including at least one solid state light emitter; and a second group of solid state light emitters, the second group of solid state light emitters including at least one solid state light emitter, the first group of solid state light emitters, if illuminated, emits light having a dominant wavelength in the range of from about 444 nm to about 455 nm;

the second group of solid state light emitters, if illuminated, emits light having a dominant wavelength in the range of from about 555 nm to about 585 nm;

if the first group of solid state light emitters is illuminated and the second group of solid state light emitters is illuminated, a mixture of (1) light exiting the lighting device that was emitted from the first group of solid state light emitters and (2) light exiting the lighting device that was emitted from the second group of solid state light emitters would, in the absence of any additional light, have a first group-second group mixed illumination having x, y color coordinates which define a point which is within one or more of first, second, third, fourth and fifth areas on the 1931 CIE Chromaticity Diagram, the first area enclosed by first, second, third, fourth and fifth line segments, the first line segment connecting a first point to a second point, the second line segment connecting the second point to a third point, the third line segment connecting the third point to a fourth point, the fourth line segment connecting the fourth point to a fifth point, and the fifth line segment connecting the fifth point to the first point, the first point having x, y coordinates of 0.32, 0.40, the second point having x, y coordinates of 0.36, 0.48, the third point having x, y coordinates of 0.43, 0.45, the fourth point having x, y coordinates of 0.42, 0.42, and the fifth point having x, y coordinates of 0.36, 0.38;

the second area enclosed by sixth, seventh, eighth, ninth and tenth line segments, the sixth line segment connecting a sixth point to a seventh point, the seventh line segment connecting the seventh point to a eighth point, the eighth line segment connecting the eighth point to a ninth point, the ninth line segment connecting the ninth point to a tenth point, and the tenth line segment connecting the tenth point to the sixth point, the sixth point having x, y coordinates of 0.29, 0.36, the seventh point having x, y coordinates of 0.32, 0.35, the eighth point having x, y coordinates of 0.41, 0.43, the ninth point having x, y coordinates of 0.44, 0.49, and the tenth point having x, y coordinates of 0.38, 0.53;

the third area enclosed by eleventh, twelfth, thirteenth, fourteenth and fifteenth line segments, the eleventh line segment connecting a eleventh point to a twelfth point, the twelfth line segment connecting the twelfth point to a thirteenth point, the thirteenth line segment connecting the thirteenth point to a fourteenth point, the fourteenth line segment connecting the fourteenth point to a fifteenth point, and the fifteenth line segment connecting the fifteenth point to the eleventh point, the eleventh point having x, y coordinates of 0.35, 0.48, the twelfth point having x, y coordinates of 0.26, 0.50, the thirteenth point having x, y coordinates of 0.13, 0.26, the fourteenth point having x, y coordinates of 0.15, 0.20, and the fifteenth point having x, y coordinates of 0.26, 0.28;

the fourth area enclosed by sixteenth, seventeenth, eighteenth and nineteenth line segments, the sixteenth line segment connecting a sixteenth point to a seventeenth point, the seventeenth line segment connecting the seventeenth point to a eighteenth point, the eighteenth line segment connecting the eighteenth point to a nineteenth point, the nineteenth line segment connecting the nineteenth point to the sixteenth point, the sixteenth point having x, y coordinates of 0.21, 0.28, the seventeenth point having x, y coordinates of 0.26, 0.28, the eighteenth point having x, y coordinates of 0.32, 0.42, and the nineteenth point having x, y coordinates of 0.28, 0.44; and the fifth area enclosed by twentieth, twenty-first, twenty-second and twenty-third line segments, the twentieth line segment connecting a twentieth point to a twenty-first point, the twenty-first line segment connecting a twenty-first point to a twenty-second point, the twenty-second line segment connecting the twenty-second point to a twenty-third point, the twenty-third line segment connecting the twenty-third point to the twentieth point, the twentieth point having x, y coordinates of 0.30, 0.49, the twenty-first point having x, y coordinates of 0.35, 0.48, the twenty-second point having x, y coordinates of 0.32, 0.42, and the twenty-third point having x, y coordinates of 0.28, 0.44.

Passage 41. A lighting device as recited in passage 40, wherein the first group of solid state light emitters comprises one or more light emitting diodes.

Passage 42. A lighting device as recited in passage 40, wherein the second group of solid state light emitters comprises at least a first luminescent material.

Passage 43. A lighting device as recited in passage 40, wherein the first group of solid state light emitters, if illuminated, emits light having a dominant wavelength in the range of from about 444 nm to about 452 nm.

Passage 44. A lighting device as recited in passage 40, wherein:

the lighting device further comprises a third group of solid state light emitters, the third group of solid state light emitters includes at least one solid state light emitter, and the third group of solid state light emitters, if illuminated, emits light having a dominant wavelength in the range of from about 600 nm to about 606 nm.

Passage 45. A lighting device as recited in passage 44, wherein if the first group of solid state light emitters is illuminated, the second group of solid state light emitters and the third group of solid state light emitters is illuminated, a mixture of (1) light exiting the lighting device which was emitted by the first group of solid state light emitters, (2) light exiting the lighting device which was emitted by the second group of solid state light emitters, and (3) light exiting the lighting device which was emitted by the third group of solid state light emitters would, in an absence of any additional light, produce a first group-second group-third group mixed illumination having x, y coordinates on a 1931 CIE Chromaticity Diagram which define a point which is within ten MacAdam ellipses of at least one point on the blackbody locus on a 1931 CIE Chromaticity Diagram.

Passage 46. A lighting device as recited in passage 44, wherein if electricity is supplied to the lighting device:

the lighting device emits light having a CRI Ra of at least 70, and the wall plug efficiency of the lighting device, based on the brightness of light emitted from the lighting device and the energy supplied to the lighting device, is at least 25 lumens per watt.

Passage 47. A lighting device as recited in passage 40, wherein:

the lighting device further comprises a third group of solid state light emitters, the third group of solid state light emitters includes at least one solid state light emitter, and the third group of solid state light emitters, if illuminated, emits light having a dominant wavelength in the range of from about 602 nm to about 606 nm.

Passage 48. A lighting device as recited in passage 44, wherein if the first group of solid state light emitters is illuminated, the second group of solid state light emitters and the third group of solid state light emitters is illuminated, a mixture of (1) light exiting the lighting device which was emitted by the first group of solid state light emitters, (2) light exiting the lighting device which was emitted by the second group of solid state light emitters, and (3) light exiting the lighting device which was emitted by the third group of solid state light emitters would have a color temperature of greater than 3000 K.

Furthermore, while certain embodiments of the present inventive subject matter have been illustrated with reference to specific combinations of elements, various other combinations may also be provided without departing from the teachings of the present inventive subject matter. Thus, the present inventive subject matter should not be construed as being limited to the particular exemplary embodiments described herein and illustrated in the Figures, but may also encompass combinations of elements of the various illustrated embodiments.

Many alterations and modifications may be made by those having ordinary skill in the art, given the benefit of the present disclosure, without departing from the spirit and scope of the inventive subject matter. Therefore, it must be understood that the illustrated embodiments have been set forth only for the purposes of example, and that it should not be taken as limiting the inventive subject matter as defined by the following claims. The following claims are, therefore, to be read to include not only the combination of elements which are literally set forth but all equivalent elements for performing substantially the same function in substantially the same way to obtain substantially the same result. The claims are thus to be understood to include what is specifically illustrated and described above, what is conceptually equivalent, and also what incorporates the essential idea of the inventive subject matter.

Any two or more structural parts of the lighting devices described herein can be integrated. Any structural part of the lighting devices described herein can be provided in two or more parts (which may be held together in any known way, e.g., with adhesive, screws, bolts, rivets, staples, etc.). Similarly, any two or more functions can be conducted simultaneously, and/or any function can be conducted in a series of steps.

The invention claimed is:

1. A lighting device comprising:

a first group of solid state light emitters, the first group of solid state light emitters including at least one solid state light emitter; and a second group of solid state light emitters, the second group of solid state light emitters including at least one solid state light emitter, the first group of solid state light emitters, if illuminated, emits light having a dominant wavelength in the range of from about 441 nm to about 448 nm;

the second group of solid state light emitters, if illuminated, emits light having a dominant wavelength in the range of from about 555 nm to about 585 nm;

if the first group of solid state light emitters is illuminated and the second group of solid state light emitters is illuminated, a mixture of (1) light exiting the lighting device that was emitted from the first group of solid state light emitters and (2) light exiting the lighting device that was emitted from the second group of solid state light emitters would, in the absence of any additional light, have a first group-second group mixed illumination having x, y color coordinates which define a point which is within one or more of first, second, third, fourth and fifth areas on the 1931 CIE Chromaticity Diagram, the first area enclosed by first, second, third, fourth and fifth line segments, the first line segment connecting a first point to a second point, the second line segment connecting the second point to a third point, the third line segment connecting the third point to a fourth point, the fourth line segment connecting the fourth point to a fifth point, and the fifth line segment connecting the fifth point to the first point, the first point having x, y coordinates of 0.32, 0.40, the second point having x, y coordinates of 0.36, 0.48, the third point having x, y coordinates of 0.43, 0.45, the fourth point having x, y coordinates of 0.42, 0.42, and the fifth point having x, y coordinates of 0.36, 0.38;

the second area enclosed by sixth, seventh, eighth, ninth and tenth line segments, the sixth line segment connecting a sixth point to a seventh point, the seventh line segment connecting the seventh point to a eighth point, the eighth line segment connecting the eighth point to a ninth point, the ninth line segment connecting the ninth point to a tenth point, and the tenth line segment connecting the tenth point to the sixth point, the sixth point having x, y coordinates of 0.29, 0.36, the seventh point having x, y coordinates of 0.32, 0.35, the eighth point having x, y coordinates of 0.41, 0.43, the ninth point having x, y coordinates of 0.44, 0.49, and the tenth point having x, y coordinates of 0.38, 0.53;

the third area enclosed by eleventh, twelfth, thirteenth, fourteenth and fifteenth line segments, the eleventh line segment connecting a eleventh point to a twelfth point, the twelfth line segment connecting the twelfth point to a thirteenth point, the thirteenth line segment connecting the thirteenth point to a fourteenth point, the fourteenth line segment connecting the fourteenth point to a fifteenth point, and the fifteenth line segment connecting the fifteenth point to the eleventh point, the eleventh point having x, y coordinates of 0.35, 0.48, the twelfth point having x, y coordinates of 0.26, 0.50, the thirteenth point having x, y coordinates of 0.13, 0.26, the fourteenth point having x, y coordinates of 0.15, 0.20, and the fifteenth point having x, y coordinates of 0.26, 0.28;

the fourth area enclosed by sixteenth, seventeenth, eighteenth and nineteenth line segments, the sixteenth line segment connecting a sixteenth point to a seventeenth point, the seventeenth line segment connecting the seventeenth point to a eighteenth point, the eighteenth line segment connecting the eighteenth point to a nineteenth point, the nineteenth line segment connecting the nineteenth point to the sixteenth point, the sixteenth point having x, y coordinates of 0.21, 0.28, the seventeenth point having x, y coordinates of 0.26, 0.28, the eighteenth point having x, y coordinates of 0.32, 0.42, and the nineteenth point having x, y coordinates of 0.28, 0.44; and the fifth area enclosed by twentieth, twenty-first, twenty-second and twenty-third line segments, the twentieth line segment connecting a twentieth point to a twenty-first point, the twenty-first line segment connecting a twenty-first point to a twenty-second point, the twenty-second line segment connecting the twenty-second point to a twenty-third point, the twenty-third line segment connecting the twenty-third point to the twentieth point, the twentieth point having x, y coordinates of 0.30, 0.49, the twenty-first point having x, y coordinates of 0.35, 0.48, the twenty-second point having x, y coordinates of 0.32, 0.42, and the twenty-third point having x, y coordinates of 0.28, 0.44.

2. A lighting device as recited in claim 1, wherein the first group of solid state light emitters comprises one or more light emitting diodes.

3. A lighting device as recited in claim 1, wherein the second group of solid state light emitters comprises at least a first luminescent material.

4. A lighting device as recited in claim 1, wherein:

the first group of solid state light emitters comprises one or more light emitting diodes, the second group of solid state light emitters comprises at least a first luminescent material, and at least one of the light emitting diodes from the first group of solid state light emitters is embedded within an encapsulant element in which at least some of the first luminescent material is also embedded.

5. A lighting device as recited in claim 1, wherein the first group of solid state light emitters, if illuminated, emits light having a dominant wavelength in the range of from about 444 nm to about 446 nm.

6. A lighting device as recited in claim 1, wherein:

the lighting device further comprises a third group of solid state light emitters, the third group of solid state light emitters includes at least one solid state light emitter, and the third group of solid state light emitters, if illuminated, emits light having a dominant wavelength in the range of from about 600 nm to about 640 nm.

7. A lighting device as recited in claim 1, wherein:

the lighting device further comprises a third group of solid state light emitters, the third group of solid state light emitters includes at least one solid state light emitter, and the third group of solid state light emitters, if illuminated, emits light having a dominant wavelength in the range of from about 615 nm to about 620 nm.

8. A lighting device as recited in claim 6, wherein the third group of solid state light emitters comprises one or more light emitting diodes.

9. A lighting device as recited in claim 6, wherein the third group of solid state light emitters comprises at least a second luminescent material.

10. A lighting device as recited in claim 6, wherein if the first group of solid state light emitters is illuminated, the second group of solid state light emitters and the third group of solid state light emitters is illuminated, a mixture of (1) light exiting the lighting device which was emitted by the first group of solid state light emitters, (2) light exiting the lighting device which was emitted by the second group of solid state light emitters, and (3) light exiting the lighting device which was emitted by the third group of solid state light emitters would, in an absence of any additional light, produce a first group-second group-third group mixed illumination having x, y coordinates on a 1931 CIE Chromaticity Diagram which define a point which is within ten MacAdam ellipses of at least one point on the blackbody locus on a 1931 CIE Chromaticity Diagram.

11. A lighting device as recited in claim 6, wherein if electricity is supplied to the lighting device:

the lighting device emits light having a CRI Ra of at least 70, and the wall plug efficiency of the lighting device, based on the brightness of light emitted from the lighting device and the energy supplied to the lighting device, is at least 25 lumens per watt.

12. A lighting device as recited in claim 1, wherein:

the first group of solid state light emitters comprises one or more light emitting diodes, the second group of solid state light emitters comprises at least a first luminescent material, and if all of the light emitting diodes in the first group of solid state light emitters are illuminated, at least some of the first luminescent material in the second group of solid state light emitters would be excited by light emitted from the first group of solid state light emitters.

13. A lighting device comprising:

a first group of solid state light emitters, the first group of solid state light emitters including at least one solid state light emitter;

a second group of solid state light emitters, the second group of solid state light emitters including at least one solid state light emitter; and at least a first power line, the first group of solid state light emitters, if illuminated, emits light having a dominant wavelength in the range of from about 441 nm to about 448 nm;

the second group of solid state light emitters, if illuminated, emits light having a dominant wavelength in the range of from about 555 nm to about 585 nm;

if electricity is supplied to the first power line, a mixture of (1) light exiting the lighting device that was emitted from the first group of solid state light emitters and (2) light exiting the lighting device that was emitted from the second group of solid state light emitters would, in the absence of any additional light, have a first group-second group mixed illumination having x, y color coordinates which define a point which is within one or more of first, second, third, fourth and fifth areas on the 1931 CIE Chromaticity Diagram, the first area enclosed by first, second, third, fourth and fifth line segments, the first line segment connecting a first point to a second point, the second line segment connecting the second point to a third point, the third line segment connecting the third point to a fourth point, the fourth line segment connecting the fourth point to a fifth point, and the fifth line segment connecting the fifth point to the first point, the first point having x, y coordinates of 0.32, 0.40, the second point having x, y coordinates of 0.36, 0.48, the third point having x, y coordinates of 0.43, 0.45, the fourth point having x, y coordinates of 0.42, 0.42, and the fifth point having x, y coordinates of 0.36, 0.38;

the second area enclosed by sixth, seventh, eighth, ninth and tenth line segments, the sixth line segment connecting a sixth point to a seventh point, the seventh line segment connecting the seventh point to a eighth point, the eighth line segment connecting the eighth point to a ninth point, the ninth line segment connecting the ninth point to a tenth point, and the tenth line segment connecting the tenth point to the sixth point, the sixth point having x, y coordinates of 0.29, 0.36, the seventh point having x, y coordinates of 0.32, 0.35, the eighth point having x, y coordinates of 0.41, 0.43, the ninth point having x, y coordinates of 0.44, 0.49, and the tenth point having x, y coordinates of 0.38, 0.53;

the third area enclosed by eleventh, twelfth, thirteenth, fourteenth and fifteenth line segments, the eleventh line segment connecting a eleventh point to a twelfth point, the twelfth line segment connecting the twelfth point to a thirteenth point, the thirteenth line segment connecting the thirteenth point to a fourteenth point, the fourteenth line segment connecting the fourteenth point to a fifteenth point, and the fifteenth line segment connecting the fifteenth point to the eleventh point, the eleventh point having x, y coordinates of 0.35, 0.48, the twelfth point having x, y coordinates of 0.26, 0.50, the thirteenth point having x, y coordinates of 0.13, 0.26, the fourteenth point having x, y coordinates of 0.15, 0.20, and the fifteenth point having x, y coordinates of 0.26, 0.28;

the fourth area enclosed by sixteenth, seventeenth, eighteenth and nineteenth line segments, the sixteenth line segment connecting a sixteenth point to a seventeenth point, the seventeenth line segment connecting the seventeenth point to a eighteenth point, the eighteenth line segment connecting the eighteenth point to a nineteenth point, the nineteenth line segment connecting the nineteenth point to the sixteenth point, the sixteenth point having x, y coordinates of 0.21, 0.28, the seventeenth point having x, y coordinates of 0.26, 0.28, the eighteenth point having x, y coordinates of 0.32, 0.42, and the nineteenth point having x, y coordinates of 0.28, 0.44; and the fifth area enclosed by twentieth, twenty-first, twenty-second and twenty-third line segments, the twentieth line segment connecting a twentieth point to a twenty-first point, the twenty-first line segment connecting a twenty-first point to a twenty-second point, the twenty-second line segment connecting the twenty-second point to a twenty-third point, the twenty-third line segment connecting the twenty-third point to the twentieth point, the twentieth point having x, y coordinates of 0.30, 0.49, the twenty-first point having x, y coordinates of 0.35, 0.48, the twenty-second point having x, y coordinates of 0.32, 0.42, and the twenty-third point having x, y coordinates of 0.28, 0.44.

14. A method of lighting comprising:

illuminating a first group of solid state light emitters, the first group of solid state light emitters including at least one solid state light emitter, such that the first group of solid state light emitters emits light having a dominant wavelength in the range of from about 441 nm to about 448 nm; and illuminating a second group of solid state light emitters, the second group of solid state light emitters including at least one solid state light emitter, such that the second group of solid state light emitters emits light having a dominant wavelength in the range of from about 555 nm to about 585 nm, the first group of solid state light emitters and the second group of solid state light emitters in a lighting device, a mixture of (1) light exiting the lighting device that was emitted from the first group of solid state light emitters and (2) light exiting the lighting device that was emitted from the second group of solid state light emitters would, in the absence of any additional light, have a first group-second group mixed illumination having x, y color coordinates which define a point which is within one or more of first, second, third, fourth and fifth areas on the 1931 CIE Chromaticity Diagram, the first area enclosed by first, second, third, fourth and fifth line segments, the first line segment connecting a first point to a second point, the second line segment connecting the second point to a third point, the third line segment connecting the third point to a fourth point, the fourth line segment connecting the fourth point to a fifth point, and the fifth line segment connecting the fifth point to the first point, the first point having x, y coordinates of 0.32, 0.40, the second point having x, y coordinates of 0.36, 0.48, the third point having x, y coordinates of 0.43, 0.45, the fourth point having x, y coordinates of 0.42, 0.42, and the fifth point having x, y coordinates of 0.36, 0.38;

the second area enclosed by sixth, seventh, eighth, ninth and tenth line segments, the sixth line segment connecting a sixth point to a seventh point, the seventh line segment connecting the seventh point to a eighth point, the eighth line segment connecting the eighth point to a ninth point, the ninth line segment connecting the ninth point to a tenth point, and the tenth line segment connecting the tenth point to the sixth point, the sixth point having x, y coordinates of 0.29, 0.36, the seventh point having x, y coordinates of 0.32, 0.35, the eighth point having x, y coordinates of 0.41, 0.43, the ninth point having x, y coordinates of 0.44, 0.49, and the tenth point having x, y coordinates of 0.38, 0.53;

the third area enclosed by eleventh, twelfth, thirteenth, fourteenth and fifteenth line segments, the eleventh line segment connecting a eleventh point to a twelfth point, the twelfth line segment connecting the twelfth point to a thirteenth point, the thirteenth line segment connecting the thirteenth point to a fourteenth point, the fourteenth line segment connecting the fourteenth point to a fifteenth point, and the fifteenth line segment connecting the fifteenth point to the eleventh point, the eleventh point having x, y coordinates of 0.35, 0.48, the twelfth point having x, y coordinates of 0.26, 0.50, the thirteenth point having x, y coordinates of 0.13, 0.26, the fourteenth point having x, y coordinates of 0.15, 0.20, and the fifteenth point having x, y coordinates of 0.26, 0.28;

the fourth area enclosed by sixteenth, seventeenth, eighteenth and nineteenth line segments, the sixteenth line segment connecting a sixteenth point to a seventeenth point, the seventeenth line segment connecting the seventeenth point to a eighteenth point, the eighteenth line segment connecting the eighteenth point to a nineteenth point, the nineteenth line segment connecting the nineteenth point to the sixteenth point, the sixteenth point having x, y coordinates of 0.21, 0.28, the seventeenth point having x, y coordinates of 0.26, 0.28, the eighteenth point having x, y coordinates of 0.32, 0.42, and the nineteenth point having x, y coordinates of 0.28, 0.44; and the fifth area enclosed by twentieth, twenty-first, twenty-second and twenty-third line segments, the twentieth line segment connecting a twentieth point to a twenty-first point, the twenty-first line segment connecting a twenty-first point to a twenty-second point, the twenty-second line segment connecting the twenty-second point to a twenty-third point, the twenty-third line segment connecting the twenty-third point to the twentieth point, the twentieth point having x, y coordinates of 0.30, 0.49, the twenty-first point having x, y coordinates of 0.35, 0.48, the twenty-second point having x, y coordinates of 0.32, 0.42, and the twenty-third point having x, y coordinates of 0.28, 0.44.

15. A method as recited in claim 14, wherein:

the method further comprises illuminating a third group of solid state light emitters, the third group of solid state light emitters includes at least one solid state light emitter, such that the third group of solid state light emitters emits light having a dominant wavelength in the range of from about 600 nm to about 640 nm.

16. A lighting device comprising:

a first group of solid state light emitters, the first group of solid state light emitters including at least one solid state light emitter; and a second group of solid state light emitters, the second group of solid state light emitters including at least one solid state light emitter, the first group of solid state light emitters, if illuminated, emits light having a dominant wavelength in the range of from about 442 nm to about 450 nm;

the second group of solid state light emitters, if illuminated, emits light having a dominant wavelength in the range of from about 555 nm to about 585 nm;

if the first group of solid state light emitters is illuminated and the second group of solid state light emitters is illuminated, a mixture of (1) light exiting the lighting device that was emitted from the first group of solid state light emitters and (2) light exiting the lighting device that was emitted from the second group of solid state light emitters would, in the absence of any additional light, have a first group-second group mixed illumination having x, y color coordinates which define a point which is within one or more of first, second, third, fourth and fifth areas on the 1931 CIE Chromaticity Diagram, the first area enclosed by first, second, third, fourth and fifth line segments, the first line segment connecting a first point to a second point, the second line segment connecting the second point to a third point, the third line segment connecting the third point to a fourth point, the fourth line segment connecting the fourth point to a fifth point, and the fifth line segment connecting the fifth point to the first point, the first point having x, y coordinates of 0.32, 0.40, the second point having x, y coordinates of 0.36, 0.48, the third point having x, y coordinates of 0.43, 0.45, the fourth point having x, y coordinates of 0.42, 0.42, and the fifth point having x, y coordinates of 0.36, 0.38;

the second area enclosed by sixth, seventh, eighth, ninth and tenth line segments, the sixth line segment connecting a sixth point to a seventh point, the seventh line segment connecting the seventh point to a eighth point, the eighth line segment connecting the eighth point to a ninth point, the ninth line segment connecting the ninth point to a tenth point, and the tenth line segment connecting the tenth point to the sixth point, the sixth point having x, y coordinates of 0.29, 0.36, the seventh point having x, y coordinates of 0.32, 0.35, the eighth point having x, y coordinates of 0.41, 0.43, the ninth point having x, y coordinates of 0.44, 0.49, and the tenth point having x, y coordinates of 0.38, 0.53;

the third area enclosed by eleventh, twelfth, thirteenth, fourteenth and fifteenth line segments, the eleventh line segment connecting a eleventh point to a twelfth point, the twelfth line segment connecting the twelfth point to a thirteenth point, the thirteenth line segment connecting the thirteenth point to a fourteenth point, the fourteenth line segment connecting the fourteenth point to a fifteenth point, and the fifteenth line segment connecting the fifteenth point to the eleventh point, the eleventh point having x, y coordinates of 0.35, 0.48, the twelfth point having x, y coordinates of 0.26, 0.50, the thirteenth point having x, y coordinates of 0.13, 0.26, the fourteenth point having x, y coordinates of 0.15, 0.20, and the fifteenth point having x, y coordinates of 0.26, 0.28;

the fourth area enclosed by sixteenth, seventeenth, eighteenth and nineteenth line segments, the sixteenth line segment connecting a sixteenth point to a seventeenth point, the seventeenth line segment connecting the seventeenth point to a eighteenth point, the eighteenth line segment connecting the eighteenth point to a nineteenth point, the nineteenth line segment connecting the nineteenth point to the sixteenth point, the sixteenth point having x, y coordinates of 0.21, 0.28, the seventeenth point having x, y coordinates of 0.26, 0.28, the eighteenth point having x, y coordinates of 0.32, 0.42, and the nineteenth point having x, y coordinates of 0.28, 0.44; and the fifth area enclosed by twentieth, twenty-first, twenty-second and twenty-third line segments, the twentieth line segment connecting a twentieth point to a twenty-first point, the twenty-first line segment connecting a twenty-first point to a twenty-second point, the twenty-second line segment connecting the twenty-second point to a twenty-third point, the twenty-third line segment connecting the twenty-third point to the twentieth point, the twentieth point having x, y coordinates of 0.30, 0.49, the twenty-first point having x, y coordinates of 0.35, 0.48, the twenty-second point having x, y coordinates of 0.32, 0.42, and the twenty-third point having x, y coordinates of 0.28, 0.44.

17. A lighting device as recited in claim 16, wherein the first group of solid state light emitters, if illuminated, emits light having a dominant wavelength in the range of from about 442 nm to about 445 nm.

18. A lighting device as recited in claim 16, wherein:

the lighting device further comprises a third group of solid state light emitters, the third group of solid state light emitters includes at least one solid state light emitter, and the third group of solid state light emitters, if illuminated, emits light having a dominant wavelength in the range of from about 605 nm to about 610 nm.

19. A lighting device as recited in claim 16, wherein:

the lighting device further comprises a third group of solid state light emitters, the third group of solid state light emitters includes at least one solid state light emitter, and the third group of solid state light emitters, if illuminated, emits light having a dominant wavelength in the range of from about 605 nm to about 607 nm.

20. A lighting device comprising:

a first group of solid state light emitters, the first group of solid state light emitters including at least one solid state light emitter; and a second group of solid state light emitters, the second group of solid state light emitters including at least one solid state light emitter, the first group of solid state light emitters, if illuminated, emits light having a dominant wavelength in the range of from about 444 nm to about 455 nm;

the second group of solid state light emitters, if illuminated, emits light having a dominant wavelength in the range of from about 555 nm to about 585 nm;

if the first group of solid state light emitters is illuminated and the second group of solid state light emitters is illuminated, a mixture of (1) light exiting the lighting device that was emitted from the first group of solid state light emitters and (2) light exiting the lighting device that was emitted from the second group of solid state light emitters would, in the absence of any additional light, have a first group-second group mixed illumination having x, y color coordinates which define a point which is within one or more of first, second, third, fourth and fifth areas on the 1931 CIE Chromaticity Diagram, the first area enclosed by first, second, third, fourth and fifth line segments, the first line segment connecting a first point to a second point, the second line segment connecting the second point to a third point, the third line segment connecting the third point to a fourth point, the fourth line segment connecting the fourth point to a fifth point, and the fifth line segment connecting the fifth point to the first point, the first point having x, y coordinates of 0.32, 0.40, the second point having x, y coordinates of 0.36, 0.48, the third point having x, y coordinates of 0.43, 0.45, the fourth point having x, y coordinates of 0.42, 0.42, and the fifth point having x, y coordinates of 0.36, 0.38;

the second area enclosed by sixth, seventh, eighth, ninth and tenth line segments, the sixth line segment connecting a sixth point to a seventh point, the seventh line segment connecting the seventh point to a eighth point, the eighth line segment connecting the eighth point to a ninth point, the ninth line segment connecting the ninth point to a tenth point, and the tenth line segment connecting the tenth point to the sixth point, the sixth point having x, y coordinates of 0.29, 0.36, the seventh point having x, y coordinates of 0.32, 0.35, the eighth point having x, y coordinates of 0.41, 0.43, the ninth point having x, y coordinates of 0.44, 0.49, and the tenth point having x, y coordinates of 0.38, 0.53;

the third area enclosed by eleventh, twelfth, thirteenth, fourteenth and fifteenth line segments, the eleventh line segment connecting a eleventh point to a twelfth point, the twelfth line segment connecting the twelfth point to a thirteenth point, the thirteenth line segment connecting the thirteenth point to a fourteenth point, the fourteenth line segment connecting the fourteenth point to a fifteenth point, and the fifteenth line segment connecting the fifteenth point to the eleventh point, the eleventh point having x, y coordinates of 0.35, 0.48, the twelfth point having x, y coordinates of 0.26, 0.50, the thirteenth point having x, y coordinates of 0.13, 0.26, the fourteenth point having x, y coordinates of 0.15, 0.20, and the fifteenth point having x, y coordinates of 0.26, 0.28;

the fourth area enclosed by sixteenth, seventeenth, eighteenth and nineteenth line segments, the sixteenth line segment connecting a sixteenth point to a seventeenth point, the seventeenth line segment connecting the seventeenth point to a eighteenth point, the eighteenth line segment connecting the eighteenth point to a nineteenth point, the nineteenth line segment connecting the nineteenth point to the sixteenth point, the sixteenth point having x, y coordinates of 0.21, 0.28, the seventeenth point having x, y coordinates of 0.26, 0.28, the eighteenth point having x, y coordinates of 0.32, 0.42, and the nineteenth point having x, y coordinates of 0.28, 0.44; and the fifth area enclosed by twentieth, twenty-first, twenty-second and twenty-third line segments, the twentieth line segment connecting a twentieth point to a twenty-first point, the twenty-first line segment connecting a twenty-first point to a twenty-second point, the twenty-second line segment connecting the twenty-second point to a twenty-third point, the twenty-third line segment connecting the twenty-third point to the twentieth point, the twentieth point having x, y coordinates of 0.30, 0.49, the twenty-first point having x, y coordinates of 0.35, 0.48, the twenty-second point having x, y coordinates of 0.32, 0.42, and the twenty-third point having x, y coordinates of 0.28, 0.44.

21. A lighting device as recited in claim 20, wherein the first group of solid state light emitters, if illuminated, emits light having a dominant wavelength in the range of from about 444 nm to about 452 nm.

22. A lighting device as recited in claim 20, wherein:

the lighting device further comprises a third group of solid state light emitters, the third group of solid state light emitters includes at least one solid state light emitter, and the third group of solid state light emitters, if illuminated, emits light having a dominant wavelength in the range of from about 600 nm to about 606 nm.

23. A lighting device as recited in claim 20, wherein:

the lighting device further comprises a third group of solid state light emitters, the third group of solid state light emitters includes at least one solid state light emitter, and the third group of solid state light emitters, if illuminated, emits light having a dominant wavelength in the range of from about 602 nm to about 606 nm.

* * * * *